US005188925A

United States Patent [19]

Hagiwara et al.

[11] Patent Number: 5,188,925

[45] Date of Patent: Feb. 23, 1993

[54] PROCESSING METHOD FOR SILVER HALIDE COLOR PHOTOGRAPHIC LIGHT-SENSITIVE MATERIAL

[75] Inventors: Moeko Hagiwara, Kokubunji; Shigeharu Koboshi, Sagamihara, both of Japan

[73] Assignee: Konica Corporation, Tokyo, Japan

[21] Appl. No.: 754,803

[22] Filed: Sep. 4, 1991

[30] Foreign Application Priority Data

Sep. 5, 1990 [JP] Japan ..... 2-234779
Nov. 21, 1990 [JP] Japan ..... 2-317034

[51] Int. Cl.[5] ..... G03C 7/40

[52] U.S. Cl. ..... 430/372; 430/357; 430/428

[58] Field of Search ..... 430/357, 372, 393, 428, 430/430, 434, 455, 460, 461

[56] References Cited

U.S. PATENT DOCUMENTS 5,104,775 4/1992 Abe et al. ..... 430/372

*Primary Examiner*—Hoa Van Le
*Attorney, Agent, or Firm*—Finnegan, Henderson, Farabow, Garrett and Dunner

[57] ABSTRACT

A method for processing a silver halide color photographic light-sensitive material, wherein a silver halide color photographic material A comprising silver halide grains with a total amount of silver coated of 2 g/m$^2$ to 10 g/m$^2$ and another silver halide color photographic light-sensitive material B comprising silver halide grains with a total amount of silver coated of not more than 1 g/m$^2$ are processed with a stabilizer solution containing a hexamethylenetetramine compound or at least one compound selected from the group consisting the compounds represented by the following formulas:

10 Claims, 3 Drawing Sheets

PROCESSING METHOD FOR SILVER HALIDE COLOR PHOTOGRAPHIC LIGHT-SENSITIVE MATERIAL

FIELD OF THE INVENTION

The present invention relates to a processing method of a silver halide color photographic light-sensitive material, more specifically to a silver halide color photographic light-sensitive material processing method wherein the occurrence of sludge and scum in the stabilizer is suppressed, yellow stain and magenta dye fading during storage of color negative films are prevented and the darkening and fading of the cyan dye during storage of color paper is suppressed.

BACKGROUND OF THE INVENTION

Silver halide color photographic light-sensitive materials are processed in color photographic processing laboratories and smaller-scale laboratories known as "mini-labs". It is a common practice to develop a color negative film for picture taking to obtain a negative image, which is printed onto a color negative light-sensitive material for print using a printing machine, which color negative light-sensitive material for print is then developed using a developing apparatus other than that used to develop the color negative film for picture taking to yield a positive image thereon. Such a process for obtaining a color photographic image requires three processing systems, namely an automatic developing machine for color negative films, an automatic developing machine for color negative paper and an automatic photographic printing machine. These systems each need a given area of working space around them.

Particularly, the automatic developing machines require a large area of replenishing work space including a space for installing the tank solution exchange tanks and replenisher tanks, a space for preparing the replenishers by dissolution, a space for transferring the replenisher solutions to the replenisher tanks and a space for handling the replenisher tank cocks, which accounts for a considerable percentage in the area of the processing laboratory. In addition, the processing of light-sensitive material comprises two or more procedures as described above, each of which requires a replenisher and thus requires a large area of space. The replenishing work also requires much time because replenisher solutions must be frequently prepared.

When separately using an automatic developing machine for color negative films and an automatic developing machine for color negative paper, each must be equipped with a temperature controller, a processing solution circulator, a filtering apparatus, a replenisher tank, a replenisher supplying apparatus and other units of equipment, which hampers size reduction, cost reduction and other desired aspects for automatic developing machines. As a solution to this problem, an automatic developing machine exists which is capable of processing a negative light-sensitive material and a positive light-sensitive material with the same processing bath or the same replenisher, but this type of automatic developing machines pose various problems.

Particularly, when the stabilizers are processed with the same tank solution or the same replenisher, considerable sludge and scum occur in the stabilizers, which results in filter clogging in the automatic developing machine and other equipment, which can cause an operational failure. Moreover, in the case of color paper, magenta stain can occur after processing, and the dye image stability deteriorates, specifically the cyan dye shows considerable fading.

Through long-term research work, the present inventors found that the former problem arises from a reduction in the stability of the stabilizer itself when processing light-sensitive materials with different amounts of silver coated or different silver halide compositions, and the latter problem arises from the formaldehyde contained in the stabilizer. However, it has been a difficult problem to avoid the use of formaldehyde in the stabilizing bath, since it has traditionally been used in the processing of color negative films with the recognition of its effect in the maintenance of dye image stability, particularly in the prevention of yellow stain.

SUMMARY OF THE INVENTION

It is an object of the present invention to provide a processing method of a silver halide color photographic light-sensitive material which permits processing of at least two light-sensitive materials with different amounts of silver coated with the same stabilizer. It is another object of the invention to provide a silver halide color photographic light-sensitive material processing method wherein the occurrence of sludge and scum in the stabilizer tank is suppressed. It is still another object of the invention to provide a silver halide color photographic light-sensitive material processing method wherein yellow stain during storage of color negative films after processing is suppressed and magenta dye fading is prevented. It is yet another object of the invention to provide a silver halide color photographic .light-sensitive material processing method which permits suppression of cyan dye darkening and fading during storage of color negative paper after color processing.

Other objects will become obvious through the description which follows.

To accomplish the objects described above, a processing method of a silver halide color photographic light-sensitive material of the present invention is characterized in that at least two kinds of light-sensitive materials, namely a silver halide color photographic light-sensitive material A containing a silver halide with a total amount of silver coated of 2 g/m$^2$ to 10 g/m$^2$ and another silver halide color photographic light-sensitive material B containing a silver halide with a total amount of silver coated of not more than 1 g/m$^2$, are processed with a stabilizer containing a hexamethylenetetramine compound or at least one compound selected from the group comprising the compounds represented by the following Formulas F-1 through F-10.

Formula F-1

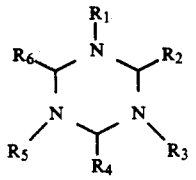

wherein $R_1$ through $R_6$ independently represent a hydrogen atom or monovalent organic group.

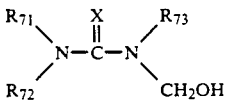

Formula F-2

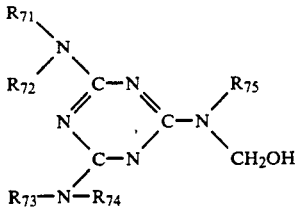

Formula F-3

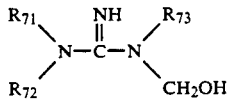

Formula F-4 wherein $R_{71}$ through $R_{75}$ independently represent a hydrogen atom or methylol group; X represents an oxygen atom or sulfur atom.

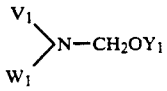

Formula F-5

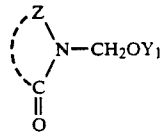

Formula F-6 wherein $V_1$ and $W_1$ independently represent a hydrogen atom, lower alkyl group or electron-attracting group; $V_1$ and $W_1$ may bind together to form a 5- or 6-membered nitrogen-containing heterocyclic ring; $Y_1$ represents a hydrogen atom or a group which splits off upon hydrolysis; Z represents a group of non-metallic atoms necessary for the formation of a monocyclic or condensed nitrogen-containing heterocyclic ring together with a nitrogen atom and a >C=O group.

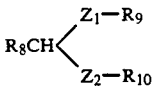

Formula F-7 wherein $R_8$ represents a hydrogen atom or aliphatic group; $R_9$ and $R_{10}$ independently represent an aliphatic group or aryl group; $R_9$ and $R_{10}$ may bind together to form a ring; $Z_1$ and $Z_2$ independently represent an oxygen atom, sulfur atom or an —N($R_{11}$)— group, wherein $Z_1$ and $Z_2$ do not represent an oxygen atom concurrently; $R_{11}$ represents a hydrogen atom, hydroxyl group, aliphatic group or aryl group.

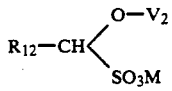

Formula F-8

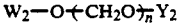

Formula F-9

-continued

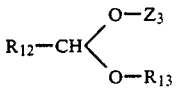

Formula F-10 wherein $R_{12}$ represents a hydrogen atom or aliphatic hydrocarbon group; $V_2$ represents a group which splits off upon hydrolysis; M represents a cation; $W_2$ and $Y_2$ independently represent a hydrogen atom or a group which splits off upon hydrolysis; n represents an integer of 1 to 10; $Z_3$ and $R_{13}$ independently represent a hydrogen atom aliphatic hydrocarbon group, aryl group or a group which splits off upon hydrolysis; $Z_3$ may bind to $R_{13}$ to form a ring.

Another preferred mode of embodiment of the present invention is characterized in that silver chloride accounts for at least 50 mol % of the silver halide grains contained in the silver halide emulsion layer of the silver halide color photographic light-sensitive material B.

DETAILED DESCRIPTION OF THE INVENTION

Figure 1:
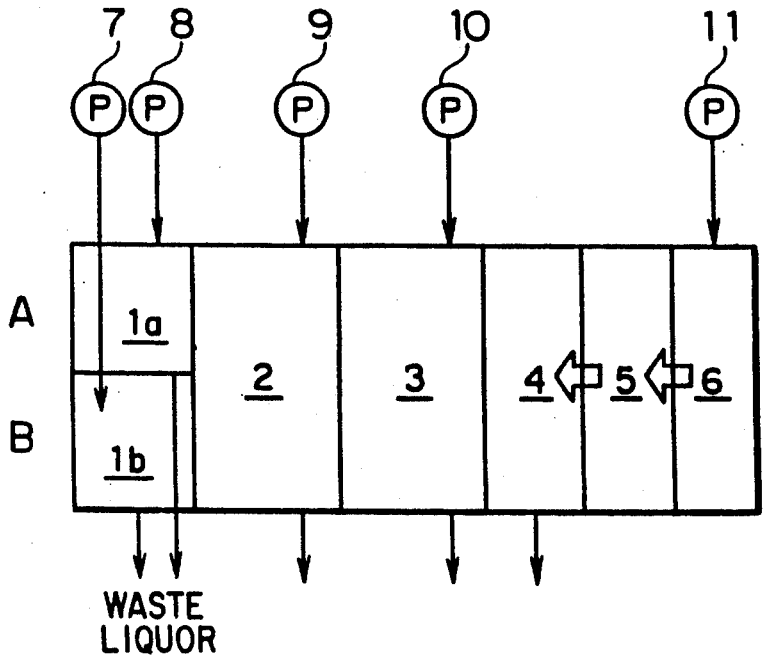
FIG. 1 is a flow diagram of a process in an automatic developing machined used in Examples of the present invention.

Presently, color negative films and color negative paper are separately processed using different processing machines. From the space saving viewpoint, it is preferable to process them with the same processing bath, which offers another advantage of halving the labor in solution management. It should be noted, however, that various problems arise when processing a color negative film and a color negative paper with the same processing bath.

Particularly, the use of the same stabilizing bath results in unstable processing because of unevenness in the processing of the high Ag light-sensitive material and the low Ag light-sensitive material, which in turn increases the possibility of silver sludge in the stabilizing bath and in addition increases the possibility of magenta stain after processing. Magenta stain is more likely to occur in the presence of formaldehyde.

On the other hand, in the case of color negative films, avoiding the use of formaldehyde can cause yellow stain and magenta dye fading during storage, while in the case of color negative paper, cyan dye darkening and fading aggravates in the presence of formaldehyde.

Adding a compound of the present invention to the stabilizing bath offers an improvement in the prevention of sludge and scum and prevents yellow stain, magenta dye fading during storage of color negative films and cyan dye darkening and fading in color negative paper.

The hexamethylenetetramine compound represented by the following Formula A-1 or its salt is preferably used in the stabilizer for the present invention.

Formula A-1

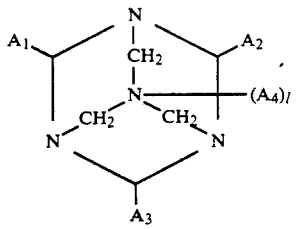

wherein A, through $A_4$ represent a hydrogen atom, alkyl group, alkenyl group or pyridyl group; l represents an integer of 0 or 1.

With respect to Formula A-1, the groups represented by $A_1$ through $A_4$ include those having a substituent. Examples of the substituent include carbamoyl groups, halogen atoms such as a chorine atom, aryl groups such as a phenyl group, hydroxyl groups, carboxyl groups and oxycarbonyl groups such as a methoxycarbonyl group.

The alkyl groups represented by $A_1$ through $A_4$ preferably have a carbon chain with a carbon number of 1 to 5.

Examples of the salt of the compound represented by Formula A-1 include inorganic salts such as hydrochloride, sulfate and nitrate, organic salts such as phenol salt, double or complex salts with metal, hydrated salts and intramolecular salts.

The compound represented by Formula A-1 is exemplified by the compounds described in "Beilsteins Handbuch der Organishen Chemie", vol. II, suppl. No. 26, pp. 200–212, of which water-soluble ones are preferred for the present invention.

Typical examples of the compound represented by Formula A-1 or its salt are given below.

A-1-1

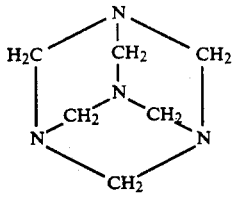

A-1-2

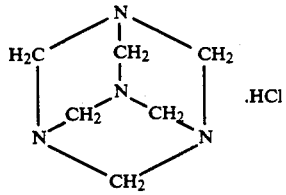

A-1-3

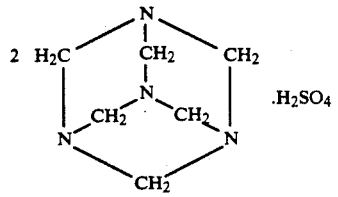

-continued

A-1-4

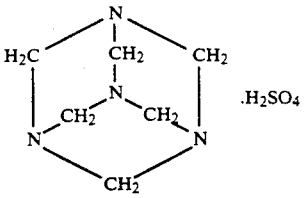

A-1-5

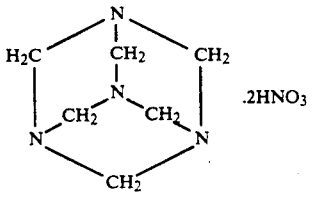

A-1-6

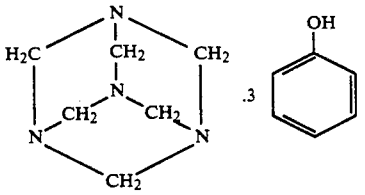

A-1-7

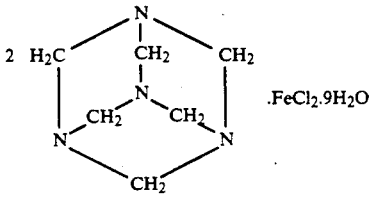

A-1-8

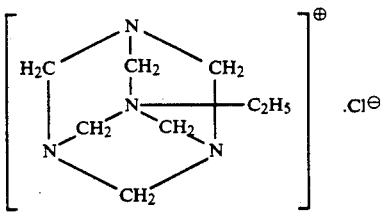

A-1-9

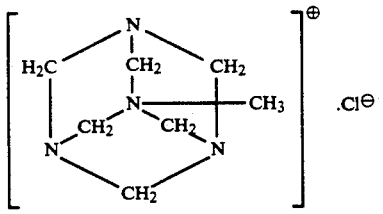

A-1-10

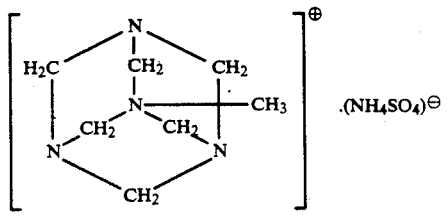

-continued
A-1-11
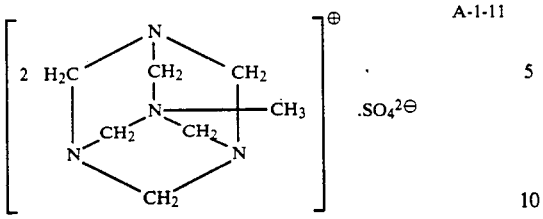
A-1-12
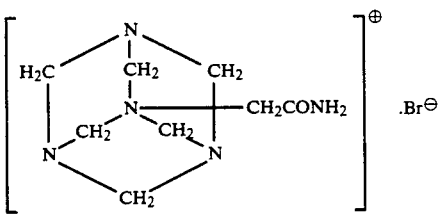
A-1-13
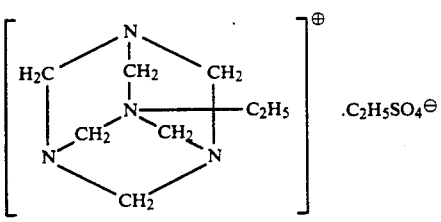
A-1-14
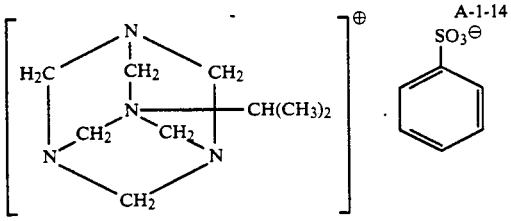
A-1-15
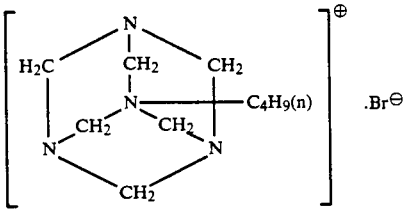
A-1-16
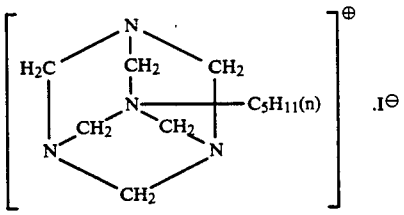
A-1-17
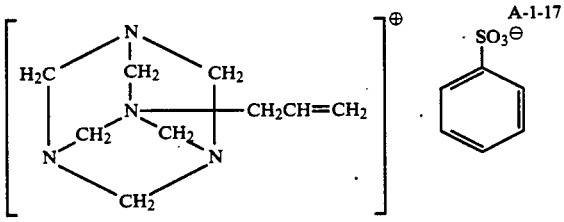
-continued
A-1-18
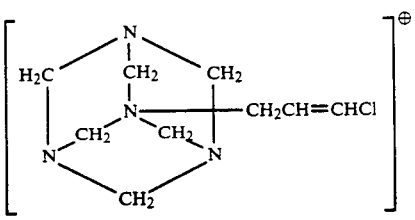
A-1-19
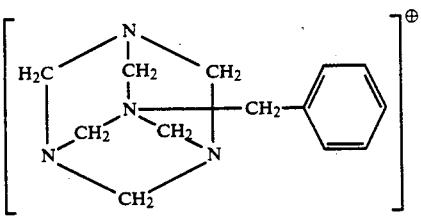
A-1-20
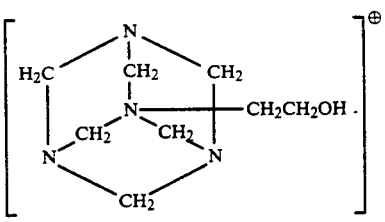
A-1-21
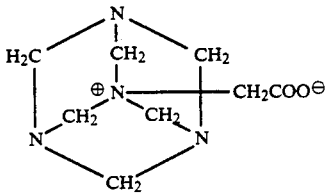
A-1-22
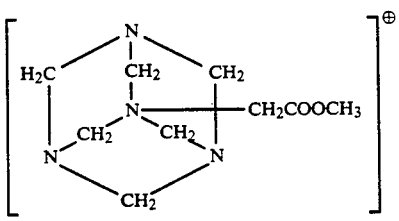
A-1-23
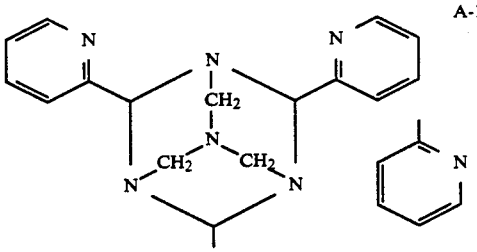
A-1-24
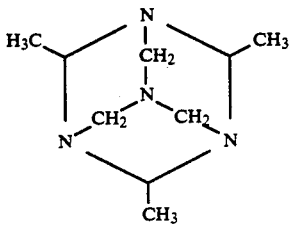

-continued

A-1-25

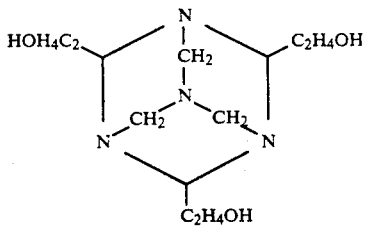

The compound of Formula A-1 is easily available as a commercial product, but can also easily be synthesized using the method described in the reference mentioned above.

The compound of Formula A-1 may be used singly or in combination of two or more kinds. The amount of its addition is preferably 0.01 to 20 g per liter of processing solution.

The compounds represented by Formulas F-1 through F-10 for the present invention are hereinafter described in detail.

With respect to Formula F-1, $R_1$ through $R_6$ independently represent a hydrogen atom or monovalent organic group. Examples of the monovalent organic group include an alkyl group, aryl group, alkenyl group, alkynyl group, aralkyl group, amino group, alkoxy group, hydroxyl group, acyl group, sulfonyl group, alkylthio group, arylthio group, heterocyclic ring residue, carbamoyl group, sulfamoyl group and alkylamino group.

These monovalent organic groups may have a substituent such as a hydroxyl group, acyl group, sulfonyl group, halogen atom, amino group or carboxyl group, with preference given to a hydroxyl group or halogen atom. The total carbon number of the substituents represented by $R_1$ through $R_6$ is preferably not more than 10.

The group of $R_1$, $R_3$ and $R_5$ and the group of $R_2$, $R_4$ and $R_6$ may be identical or not, but it is preferable that all members of either group are hydrogen atoms.

Examples of the compound represented by Formula F-1 are given below, but these examples are not to be construed as limitative.

F-1-1

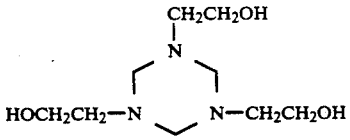

F-1-2

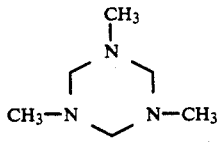

F-1-3

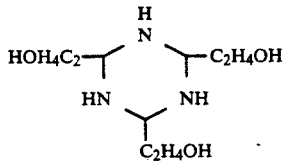

-continued

F-1-4

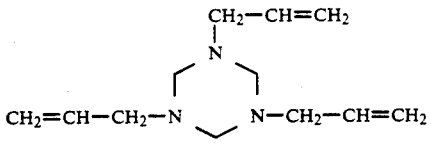

F-1-5

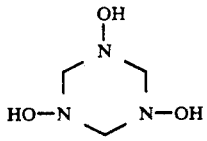

F-1-6

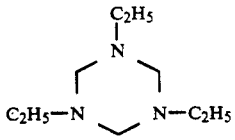

F-1-7

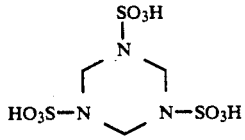

F-1-8

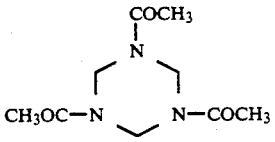

F-1-9

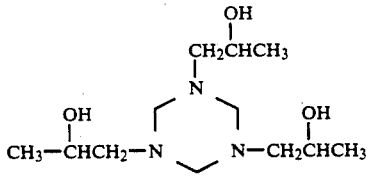

F-1-10

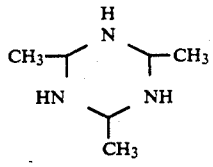

F-1-11

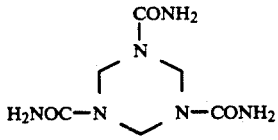

F-1-12

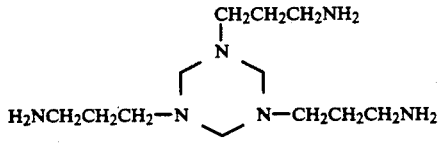

F-1-13

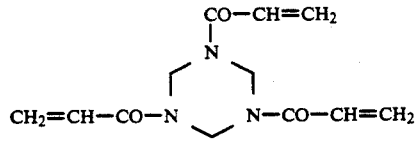

-continued

F-1-14

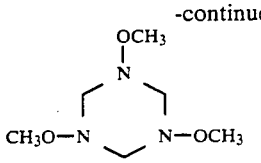

F-1-15

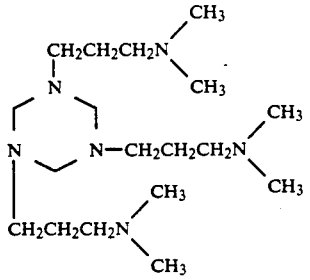

F-1-16

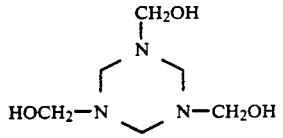

F-1-17

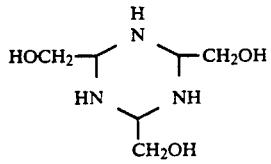

F-1-18

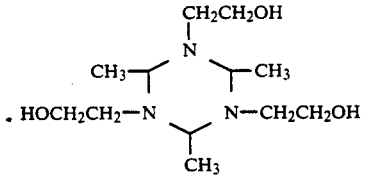

F-1-19

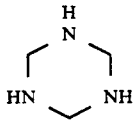

F-1-20

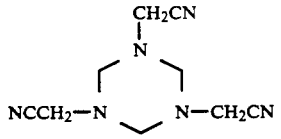

These triazine compounds represented by Formula F-1 are used preferably in the content range of from 0.01 to 50 g, more preferably 0.01 to 20 g per liter of stabilizer.

Examples of the methylol compound represented by Formula F-2, F-3 or F-4 include the following compounds.

(F-2-1) Dimethylolurea
(F-2-2) Trimethylolurea
(F-2-3) Monomethylolurea
(F-2-4) Tetramethylolurea
(F-2-5) Dimethylolthiourea
(F-2-6) Monomethylolthiourea
(F-3-1) Trimethylolmelamine
(F-3-2) Tetramethylolmelamine
(F-3-3) Pentamethylolmelamine
(F-3-4) Hexamethylolmelamine
(F-3-5) Monomethylolmelamine
(F-4-1) Dimethylolguanidine
(F-4-2) Monomethylolguanidine
(F-4-3) Trimethylolguanidine The amount of addition is preferably 0.01 to 20 g per liter of stabilizer, more preferably 0.05 to 10 g/l; the effect of the invention is enhanced in this content range.

With respect to Formulas F-5 and F-6, the electron-attracting groups represented by $V_1$ and $W_1$ are selected from groups having a positive value for Hammet's δp [Lange's Handbook of Chemistry, 12th ed. vol. 3, C. Hansch & A. Leo, Substituent Constants for Correlation Analysis in Chemistry and Biology, Jone Wiley & Sons. New York, 1979]. Examples of such groups include acyl groups such as acetyl, benzoyl and monochloroacetyl, alkoxycarbonyl groups such as ethoxycarbonyl and methoxyethoxycarbonyl, aryloxycarbonyl groups such as phenoxycarbonyl and p-chlorophenoxycarbonyl, carbamoyl groups such as N-methylcarbamoyl, N,N-tetramethylenecarbamoyl and N-phenylcarbamoyl, cyano groups, alkylsulfonyl groups such as methanesulfonyl and ethanesulfonyl, arylsulfonyl groups such as benzenesulfonyl and p-toluene sulfonyl and sulfamoyl groups such as sulfamoyl, N-methylsulfamoyl and N,N-pentamethylenesulfamoyl. Examples of lower alkyl groups include methyl, ethyl, propyl and butyl.

Examples of the group which splits off upon hydrolysis, represented by $Y_1$, include trialkyl-substituted silyl groups such as trimethylsilyl, acyl groups such as acetyl, benzoyl, monochloroacetyl and trifluoroacetyl, sulfate groups, aminocarbonyl groups such as N,N-dimethylcarbonyl, N-methylcarbonyl and N-phenylcarbonyl and sulfonate groups such as methanesulfonate, benzenesulfonate and p-toluenesulfonate.

Examples of the 5- or 6-membered nitrogen-containing heterocyclic ring formed along with a nitrogen atom and a >C=O group, represented by Z, include monocyclic groups having an element composition such as $[C_1N_4]$, $[C_2N_3]$, $[C_3N_2]$, $[C_4N]$, $[C_2N_4]$, $[C_3N_3]$, $[C_4N_2]$, $[C_5N]$, $[C_2N_2O]$, $[C_3NO]$, $[C_3N_2O]$, $[C_4NO]$, $[C_2N_2S]$, $[C_3NS]$, $[C_3N_2S]$, $[C_2N_2Se]$, $[C_3NSe]$, $[C_4NSe]$ or $[C_3NTe]$, and condensed rings comprising an element composition such as $[C_3N_2\text{-}C_6]$, $[C_4N\text{-}C_6]$, $[C_4N\text{-}C_3N_2]$, $[C_3N_2\text{-}C_3N_2]$, $[C_3NS\text{-}C_6]$, $[C_5N\text{-}C_5N]$, $[C_5N\text{-}C_6]$or $C_4N_2\text{-}C_6]$. These rings may have a substituent thereon. Examples of the substituent include alkyl groups such as methyl, ethyl, methoxyethyl, benzyl, carboxymethyl and sulfopropyl, aryl groups such as phenyl and p-methoxyphenyl, hydroxyl groups, alkoxy groups such as methoxy, ethoxy and methoxyethoxy, aryloxy groups such as phenoxy and p-carboxyphenyl, carboxyl groups, sulfo groups, alkoxycarbonyl groups such as methoxycarbonyl and ethoxycarbonyl, aryloxycarbonyl groups such as phenoxycarbonyl, amino groups such as N,N-dimethylamino, N-ethylamino and N-phenylamino, acylamide groups such as acetamide and benzamide, carbamoyl groups such as carbamoyl, N-methylcarbamoyl and N,N-tetramethylenecarbamoyl, sulfonamide groups such as methanesulfonamide and benzenesulfonamide, sulfamoyl groups such as N-ethylsulfamoyl and N,N-dimethylsulfamoyl, alkylsulfonyl groups such as methanesulfonyl and ethanesulfonyl, arylsulfonyl groups such as benzenesulfonyl and p-toluenesulfonyl and acyl groups such as acetyl and benzoyl.

With respect to Formula F-5, the 5- or 6-membered nitrogen-containing heterocyclic ring capable of being formed via divalent electron-attracting groups $V_1$ and $W_1$ is exemplified by the compound represented by the following Formula F-5-a.

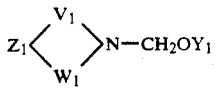

Formula F-5-a wherein $V_1$ and $W_1$ independently represent a —CO—, —CO—O—, —SO—, —$SO_2$ or —CS— group; $Z_1$ represents a group of metal atoms necessary for the formation of a 5- or 6-membered monocyclic or condensed ring along with $V_1$ and $W_1$.

The 5- or 6-membered monocyclic or condensed ring formed by $Z_1$ may have any arbitrarily selected substituent. Examples of the arbitrary substituent include alkyl groups such as methyl, ethyl, methoxyethyl, benzyl, carboxymethyl and sulfopropyl, aryl groups such as phenyl and p-methoxyphenyl, hydroxyl groups, alkoxy groups such as methoxy, ethoxy and methoxyethoxy, aryloxy groups such as phenoxy and p-carboxyphenyl, carboxyl groups, sulfo groups, alkoxycarbonyl groups such as methoxycarbonyl and ethoxycarbonyl, aryloxycarbonyl groups such as phenoxycarbonyl, amino groups such as N,N-dimethylamino, N-ethylamino and N-phenylamino, acylamide groups such as acetamide and benzamide, carbamoyl groups such as carbamoyl, N-methylcarbamoyl and N,N-tetramethylenecarbamoyl, sulfonamide groups such as methanesulfonamide and benzenesulfonamide sulfamoyl groups such as N-ethylsulfamoyl and N,N-dimethylsulfamoyl, alkylsulfonyl groups such as methanesulfonyl and ethanesulfonyl, arylsulfonyl groups such as benzenesulfonyl and p-toluenesulfonyl and acyl groups such as acetyl and benzoyl.

Examples of the compounds represented by Formulas F-5 and F-6 for the present invention are given below, but these examples are not to be construed as limitative.

F-5-1

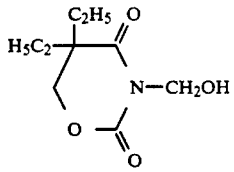

F-5-2

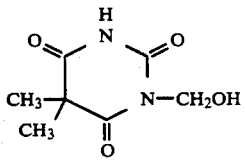

F-5-3

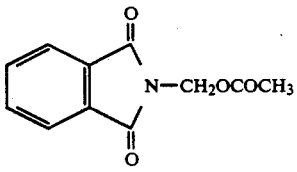

F-5-4

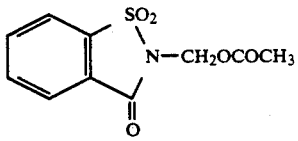

-continued

F-5-5

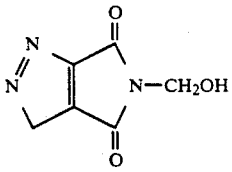

F-5-6

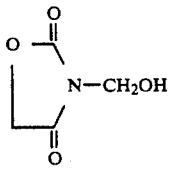

F-5-7

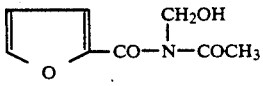

F-5-8

$C_2H_5CONCOCH_3$ ($CH_2OH$)

F-5-9

HOOC—$CH_2$NH—$CH_2$OH

F-5-10

$(CH_3)_2$N—$CH_2$OH

F-5-11

$CH_3$—NH—$CH_2$OH

F-5-12

$C_2H_5$OCONH—$CH_2$OH

F-5-13

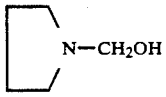

F-5-14

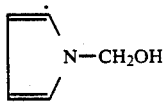

F-6-1

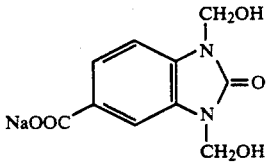

F-6-2

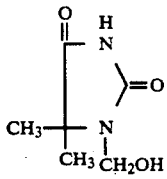

F-6-3

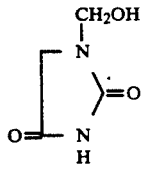

F-6-4

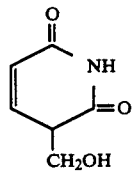

-continued

F-6-5

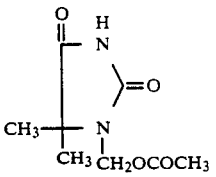

F-6-6

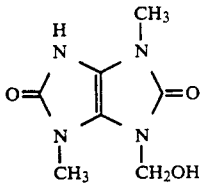

F-6-7

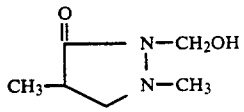

F-6-8

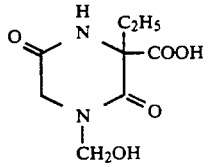

F-6-9

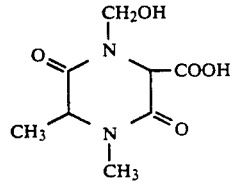

F-6-10

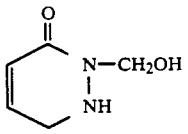

F-6-11

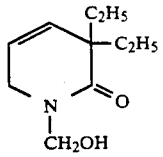

F-6-12

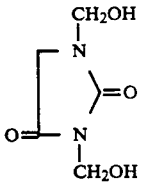

F-6-13

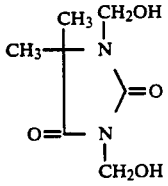

The amount of addition of the compound represented by Formula F-5 or F-6 is preferably 0.01 to 20 g, more preferably 0.03 to 15 g, and still more preferably 0.05 to 10 g per liter of stabilizer.

With respect to Formula F-7, the aliphatic groups represented by $R_8$, $R_9$ and $R_{10}$ are exemplified by saturated alkyl groups such as methyl, ethyl, butyl and other unsubstituted alkyl groups and benzyl, carboxymethyl, hydroxymethyl, methoxyethyl and other substituted alkyl groups, unsaturated alkyl groups such as allyl and 2-butenyl, and cycloalkyl groups such as cyclopentyl and cyclohexyl.

The aryl groups represented by $R_9$, $R_{10}$ and $R_{11}$ may be substituted. Examples of the substituent include alkyl groups such as methyl, ethyl, methoxyethyl, benzyl, carboxymethyl and sulfopropyl, aryl groups such as phenyl and p-methoxyphenyl, hydroxyl groups, alkoxy groups such as methoxy, ethoxy and methoxyethoxy, aryloxy groups such as phenoxy and p-carboxyphenyl, carboxyl groups, sulfo groups, alkoxycarbonyl groups such as methoxycarbonyl and ethoxycarbonyl, aryloxycarbonyl groups such as phenoxycarbonyl, amino groups such as N,N-dimethylamino, N-ethylamino and N-phenylamino, acylamide groups such as acetamide and benzamide carbamoyl groups such as carbamoyl, N-methylcarbamoyl and N,N-tetramethylenecarbamoyl, sulfonamide groups such as methanesulfonamide and benzenesulfonamide sulfamoyl groups such as N-ethylsulfamoyl and N,N-dimethylsulfamoyl, alkylsulfonyl groups such as methanesulfonyl and ethanesulfonyl, arylsulfonyl groups such as benzenesulfonyl and p-toluenesulfonyl and acyl groups such as acetyl and benzoyl.

The ring formed by $R_9$ and $R_{10}$ is a 5- to 8-membered heterocyclic ring, including those wherein some of the binding carbons are substituted by another hetero atom.

$R_8$ is preferably a hydrogen atom.

Examples of the compound represented by Formula F-7 for the present invention are given below, but these examples are not to be construed as limitative.

F-7-1

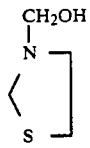

F-7-2

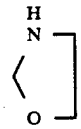

F-7-3

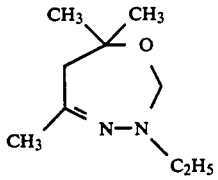

F-7-4

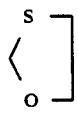

-continued

F-7-5

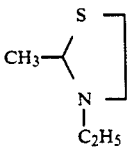

F-7-6

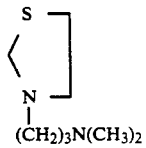

F-7-7

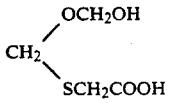

F-7-8

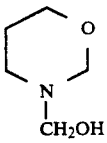

F-7-9

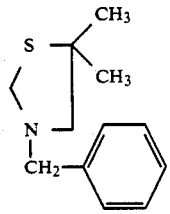

F-7-10

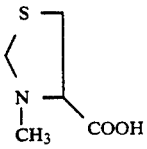

F-7-11

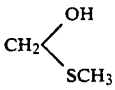

F-7-12

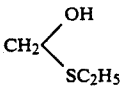

F-7-13

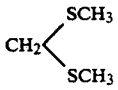

F-7-14

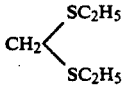

F-7-15

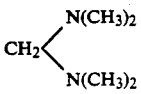

F-7-16

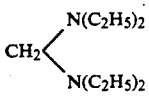

-continued

F-7-17

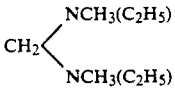

F-7-18

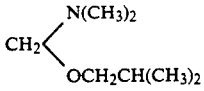

F-7-19

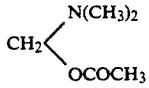

The amount of addition of the compound represented by Formula F-7 is preferably 0.01 to 20 g, more preferably 0.03 to 15 g, and still more preferably 0.05 to 10 g per liter of stabilizer.

With respect to Formulas F-8 through F-10, the aliphatic hydrocarbon groups represented by $R_{12}$, $R_{13}$ and $Z_3$ are exemplified by saturated alkyl groups such as methyl, ethyl, butyl and other unsubstituted alkyl groups and benzyl, carboxymethyl, methoxymethyl, methoxyethyl, hydroxyethyl, benzyl and other substituted alkyl groups, unsaturated alkyl groups such as allyl and 2-butenyl, cycloalkyl groups such as cyclopentyl and cyclohexyl. The aryl groups represented by $R_{13}$ and $Z_3$ may be substituted. Examples of the substituent include alkyl groups such as methyl, ethyl, methoxyethyl, benzyl, carboxymethyl and sulfopropyl, aryl groups such as phenyl and p-methoxyphenyl, hydroxyl groups, alkoxy groups such as methoxy, ethoxy and methoxyethoxy, aryloxy groups such as phenoxy and p-carboxyphenyl, carboxyl groups, sulfo groups, alkoxycarbonyl groups such as methoxycarbonyl and ethoxycarbonyl, aryloxycarbonyl groups such as phenoxycarbonyl, amino groups such as N,N-dimethylamino, N-ethylamino and N-phenylamino, acylamide groups such as acetamide and benzamide, carbamoyl groups such as carbamoyl, N-methylcarbamoyl and N,N-tetramethylenecarbamoyl, sulfonamide groups such as methanesulfonamide and benzenesulfonamide, sulfamoyl groups such as N-ethylsulfamoyl and N,N-diethylsulfamoyl, alkylsulfonyl groups such as methanesulfonyl and ethanesulfonyl, arylsulfonyl groups such as benzenesulfonyl and p-toluenesulfonyl and acyl groups such as acetyl and benzoyl.

Examples of the groups which split off upon hydrolysis represented by $V_2$, $W_2$, $Y_2$ and $Z_3$ include acyl groups such as acetyl, benzoyl, trifluoroacetyl and monochloroacetyl and trialkylsilyl groups such ass trimethylsilyl.

The ring formed by $R_{13}$ and $Z_3$ is a 5- to 8-membered saturated or condensed ring, including those wherein some of the binding carbons are substituted by another hetero atom. Examples of such rings include rings of 1,2-dioxacyclopentane, m-dioxane, trioxane, tetraoxane and benzdioxolane.

Examples of the cation represented by M include hydrogen ion, metal ions such as lithium, sodium and potassium ions, alkaline earth metal ions such as magnesium and calcium ions, ammonium ion, organic ammonium ions such as triethylammonium, tripropylammonium and tetramethylammonium ions and pyridinium ion.

With respect to Formulas F-8 through F-10, the aliphatic hydrocarbon group represented by $R_{12}$ is preferably a lower alkyl group having a carbon number of 1 or 2, with more preference given to a hydrogen atom for $R_{12}$.
Examples of the compounds represented by Formula F-8 through F-10 are given below, but these examples are not to be construed as limitative.
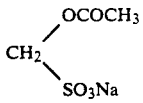
F-8-1
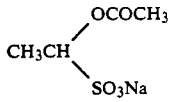
F-8-2
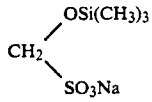
F-8-3
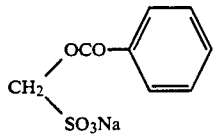
F-8-4
$CH_3COO(CH_2O)_3COCH_3$ F-9-1
$CH_3COO(CH_2O)_2COCH_3$ F-9-2
$CH_3COO(CH_2O)_4COCH_3$ F-9-3
$HO(CH_2O)_{10}H$ F-9-4
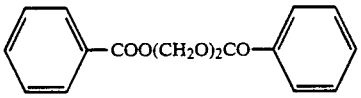
F-9-5
$CH_3OCH_2OH$ F-9-6
$ClCH_2COO(CH_2O)_4COCH_2Cl$ F-9-7
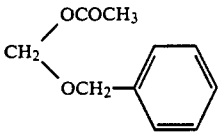
F-10-1
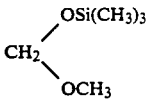
F-10-2
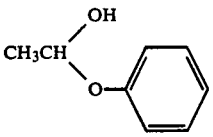
F-10-3
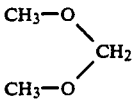
F-10-4
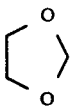
F-10-5
-continued
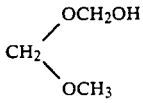
F-10-6
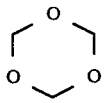
F-10-7
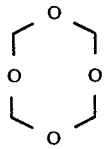
F-10-8
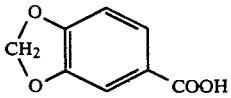
F-10-9
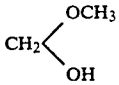
F-10-10
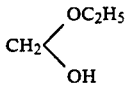
F-10-11
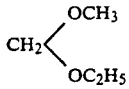
F-10-12
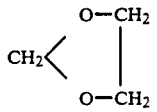
F-10-13
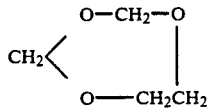
F-10-14
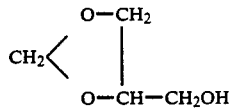
F-10-15
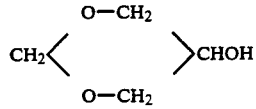
F-10-16
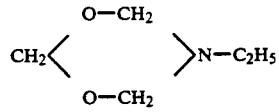
F-10-17
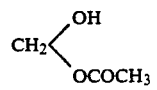
F-10-18
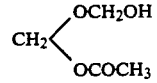
F-10-19

-continued

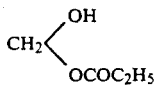

F-10-20

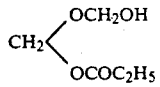

F-10-21

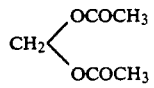

F-10-22

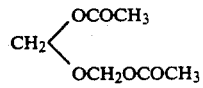

F-10-23

The amount of addition of the compound represented by Formula F-8, F-9 or F-10 is preferably 0.01 to 20 g, more preferably 0.03 to 15 g, and still more preferably 0.05 to 10 g per liter of processing solution.

In the present invention, it is preferable to add a chelating agent having an iron ion chelate stability constant of over 8 to the stabilizer. Here, the chelate stability constant is the constant which is well known in L. G. Sillen and A. E. Martell, "Stability Constants of Metal Ion Complexes", The Chemical Society, London (1964), S. Chaberek and A. E. Martell in "Organic Sequestering Agents", Wiley (1959) and other publications.

Examples of chelating agents having an iron ion chelate stability constant of over 8 include organic carboxylic acid chelating agents, organic phosphoric acid chelating agents, inorganic phosphoric acid chelating agents and polyhydroxy compounds. The iron ion means the ferric ion ($Fe^{3+}$).

Examples of chelating agents having a ferric ion chelate stability constant of over 8 include ethylenediaminediorthohydroxyphenylacetic acid, diaminopropanetetraacetic acid, nitrilotriacetic acid, hydroxyethylenediaminetriacetic acid, dihydroxyethyl glycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, trans-cyclohexanediaminetetraacetic acid, glycol ether diaminetetraacetic acid, ethylenediaminetetrakismethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrophosphate, sodium tetrapolyphosphate and sodium hexametaphosphate, but these are not to be construed as limitative. Of these compounds, diethylenetriaminepentaacetic acid, nitrilotriacetic acid, nitrilotrimethylenephosphonic acid, 1-hydroxyethylidene-1,1-diphosphonic acid and others are more preferable, with most preference given to 1-hydroxyethylidene-1,1-diphosphonic acid.

The amount of the chelating agent is preferably 0.01 to 50 g, more preferably 0.05 to 20 g per liter of stabilizer, in which content range good results are obtained.

Ammonium compounds are preferably added to the stabilizer, which are supplied by ammonium salts of various inorganic compounds, including ammonium hydroxide, ammonium bromide, ammonium carbonate, ammonium chloride, ammonium hypophosphite, ammonium phosphate, ammonium phosphite, ammonium fluoride, acidic ammonium fluoride, ammonium fluoroborate, ammonium arsenate, ammonium hydrogen carbonate, ammonium hydrogen fluoride, ammonium hydrogen sulfate, ammonium sulfate, ammonium iodide, ammonium nitrate, ammonium pentaborate, ammonium acetate, ammonium adipate, ammonium laurin tricarboxylate, ammonium benzoate, ammonium carbamate, ammonium citrate, ammonium diethyldithiocarbamate, ammonium formate, ammonium hydrogen malate, ammonium hydrogen oxalate, ammonium phthalate, ammonium hydrogen tartrate, ammonium thiosulfate, ammonium sulfite, ammonium ethylenediaminetetraacetate, ferric ammonium ethylenediaminetetraacetate, ammonium lactate, ammonium malate, ammonium maleate, ammonium oxalate, ammonium phthalate, ammonium picrate, ammonium pyrrolidinedithiocarbamate, ammonium salicylate, ammonium succinate, ammonium sulfanylate, ammonium tartrate, ammonium thioglycolate and 2,4,6-trinitrophenol ammonium. These ammonium compounds may be used singly or in combination. The amount of addition of the ammonium compound is preferably 0.001 to 1.0 mol, more preferably 0.002 to 2.0 mol per liter of stabilizer.

The stabilizer preferably contains a sulfite. Although any sulfite can be used, whether organic or inorganic, as long as it releases sulfite ion, an inorganic sulfite is preferred. Examples of sulfite compounds preferably used include sodium sulfite, potassium sulfite, ammonium sulfite, ammonium bisulfite, potassium bisulfite, sodium bisulfite, sodium metabisulfite, potassium metabisulfite, ammonium metabisulfite and hydrosulfite. The sulfite is added to the stabilizer to a final concentration of at least $1\times10^{-3}$ mol/l, more preferably $5\times10^{-3}$ to $10^{-}$mol/l. This addition serves to prevent staining. Although the sulfite may be added directly to the stabilizer, it is preferable to added it to a stabilizer replenisher.

The stabilizer preferably contains a metal salt in combination with the chelating agent described above. Examples of such a metal salt include salts of Ba, Ca, Ce, Co, In, La, Mn, Ni, Bi, Pb, Sn, Zn, Ti, Zr, Mg, Al and Sr, and it can be supplied as an inorganic salt such as halide, hydroxide, sulfate, carbonate, phosphate or acetate, or a water-soluble chelating agent. The amount of its addition is preferably $1\times10^{-4}$ to $1\times10^{-1}$ mol, more preferably $4\times10^{-4}$ to $2\times10^{-2}$ mol per liter of stabilizer.

The stabilizer may contain an organic salt such as citrate, acetate, succinate, oxalate or benzoate, and a pH regulator such as malate, borate, hydrochloride or sulfate. These compounds may be used in any combination, as long as the amount of their addition is necessary to maintain the desired pH in the stabilizing bath and as long as it does not adversely affect the stability of color photographic images or the occurrence of precipitation during storage.

In the present invention, a known antifungal agent such as 5-chloro-2-methylisothiazolin-3-one or benzisothiazoline can also be added, as long as the effect of the invention is not degraded.

The stabilizer may contain a surfactant. Examples of the surfactant include the compounds represented by Formulas I and II described in Japanese Patent Publication Open to Public Inspection (hereinafter referred to as Japanese Patent O.P.I. Publication) No. 250449/1987 and water-soluble organic siloxane compounds.

In the processing method of the present invention, silver may be recovered from the stabilizer. It is another preferred mode of embodiment of the invention to process the stabilizer by ion exchange, electrodialysis (Japanese Patent Application No. 96352/1984), reverse osmosis (Japanese Patent O.P.I. Publication Nos. 241053/1985, 254151/1987 and 132440/1990) and other treatments. It is also preferable to deionize the water to be used to prepare the stabilizer. This is because the antifungal preservativity and stability of the stabilizer and the image storage stability are improved. Any means of deionization can be used, as long as the concentration of Ca and Mg ions of the washing water after processing is not more than 5 ppm. It is preferable to use, for example, an exchange resin and a reverse osmotic membrane singly or in combination. Ion exchange resins and reverse osmosis membranes are described in detail in Journal of Technical Disclosure No. 1984/1987.

The salt concentration of the stabilizer is preferably not more than 1000 ppm, more preferably not more than 800 ppm, from the viewpoint of enhancement of the effect of the present invention.

The presence of a soluble salt of iron in the stabilizer is preferable from the viewpoint of enhancement of the effect of the invention. The soluble salt of iron is used preferably at a concentration of at least $5\times10^{-3}$ mol/l in the stabilizer, more preferably $8\times10^{-3}$ to $150\times10^{-3}$ mol/l, and still more preferably $12\times10^{-3}$ to $100\times10^{-3}$ mol/l.

In the present invention, it is preferable that the pH of the stabilizer range from 5.5 to 12.0, more preferably from 7.0 to 10.0, from the viewpoint of the enhancement of the invention. Any commonly known alkali or acid can be added as a pH regulator to the stabilizer.

The stabilizing temperature is preferably 15° to 70° C., more preferably 20° C. to 55° C. The processing time is preferably not more than 150 seconds, more preferably 3 to 120 seconds, and ideally 6 to 90 seconds.

From the viewpoint of rapid processing and dye image storage stability, it is preferable that the amount of stabilizer replenisher be not more than 1000 ml, more preferably not less than 150 ml and not more than 500 ml per $m^2$ of light-sensitive material In the present invention, the desired effect is obtained when at least two different light-sensitive materials A and B are processed with a stabilizer containing a hexamethylenetetramine compound or at least one compound selected from the group of compounds represented by Formulas F-1 through F-10. The stabilizer may be present in a single stabilizing bath which is common to the stabilizing procedures for the light-sensitive materials A and B as exemplified in FIG. 1 or in separate baths in such a manner that a part or all of the stabilizer overflow from the stabilizing bath for the light-sensitive material A is allowed to enter in the stabilizing bath for the light-sensitive material B or a part or all of the stabilizer overflow from the stabilizing bath for the light-sensitive material B is allowed to enter in the stabilizing bath for the light-sensitive material A as exemplified in FIG. 2. This method of processing makes it possible to reduce the total amount of replenisher in comparison with the single use of each stabilizer, which leads to reduction in the amount of waste stabilizer, a feature desirable from both the economic and socioenvironmental viewpoints, and which enhances the desired effect of the invention.

The stabilizing bath preferably comprises a plurality of tanks, more preferably two to six tanks, still more preferably two or three tanks, with most preference given to two tanks in combination with the counter current method (the stabilizer is supplied to the second bath and is allowed to overflow from the first bath).

Although washing is not necessary at all after stabilization, rinsing, surface washing, etc. with a small amount of water for a very short time can be added as necessary.

In the present invention, the desired effect of the invention is enhanced when processing a light-sensitive material having a high silver chloride content in the presence of a chloride at a concentration of at least $3\times10^{-2}$ mol per liter of color developer, with better results obtained at $3.5\times10^{-2}$ to $20\times10^{-2}$ mol per liter of color developer, more particularly $4.0\times10^{-2}$ to $12\times10^{-2}$ mol per liter of color developer.

The chloride may be any compound, as long as it releases a chloride ion in the color developer. Examples of such a compound include potassium chloride, sodium chloride, lithium chloride and magnesium chloride.

It is a common practice to add a sulfite as a preservative to the color developer. When using a sulfite at a concentration of not more than $1.6\times10^{-2}$ mol per liter of color developer, the reduction in color density, attributable to dissolution of a light-sensitive material based mainly on silver chloride, can be suppressed, and the reduction in the preservativity is minimized; therefore, a color developer which permits rapid processing of a light-sensitive material based mainly on silver chloride or a silver halide color photographic processing method using said color developer can be provided. For this reason, the sulfite concentration in the color developer is preferably not more than $1.6\times10^{-2}$ mol/l. This effect is enhanced at concentrations of not more than $1\times10^{-2}$ mol/l, more preferably not more than $4\times10^{-3}$ mol/l.

Examples of the sulfite include sodium sulfite, potassium sulfite, sodium bisulfite and potassium bisulfite.

However, when using silver halide color photographic light-sensitive materials with different silver halide compositions, for example, when the light-sensitive material A comprises a silver iodobromide emulsion and the light-sensitive material B comprises a silver chlorobromide or silver chloride emulsion, it is preferable to process them using separate color developing baths, with the sulfite concentration in the color developer for the light-sensitive material A kept at not less than $5\times10^{-3}$ mol/l, preferably $1\times10^{-2}$ mol/l, and more preferably $2\times10^{-2}$ mol/l.

As a color developing agent used in the color developer for the present invention, a p-phenylenediamine compound having a water-soluble group is preferably used, since it enhances the desired effect of the invention and it suppresses fogging.

A p-phenylenediamine compound having a water-soluble group not only surpasses a p-phenylenediamine compound having no water-soluble group such as N,N-diethyl-p-phenylenediamine in that it does not stain the light-sensitive material and even its skin contact is not likely to cause skin inflammation, but also permits accomplishment of the objects of the invention more efficiently when it used in combination with the color developer of the invention.

The p-phenylenediamine compound has at least one water-soluble group on the amino group or benzene nucleus. Examples of preferred water-soluble groups include —$(CH_2)_{n'}$—$CH_2OH$, —$(CH_2)_{m'}$—NH-$SO_2$—$(CH_2)_{n'}$—$CH_3$, —$(CH_2)_{m'}$—O—$(CH_2)_{n'}$—$CH_3$. —$(CH_2CH_2O)_{n'}C_{m'}H_{2m'+1}$ (m' and n' independently represent an integer of 0 or more), —COOH group and —$SO_3H$ group.

Color developing agents preferably used for the present invention are exemplified below.

Exemplified color developing agents (C-1)

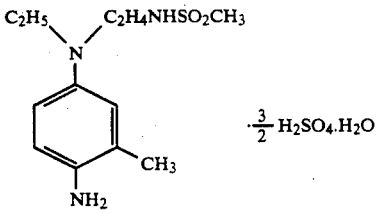

(C-2)

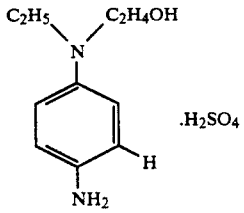

(C-3)

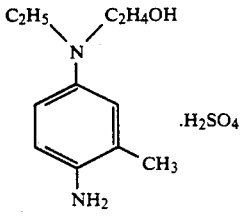

(C-4)

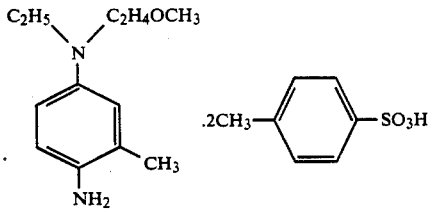

(C-5)

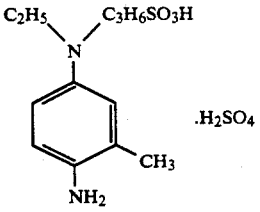

(C-6)

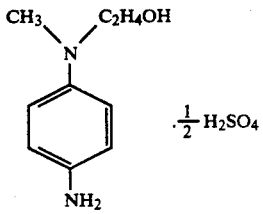

-continued

Exemplified color developing agents (C-7)

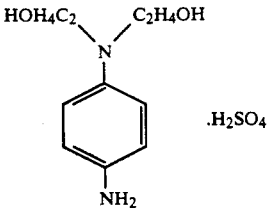

(C-8)

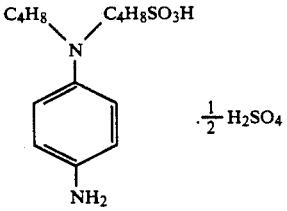

(C-9)

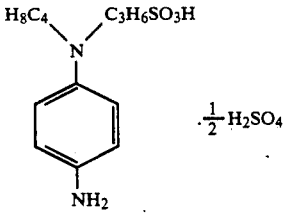

(C-10)

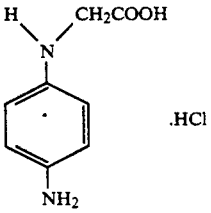

(C-11)

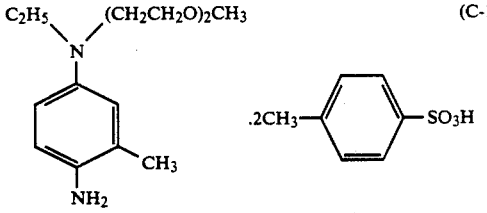

(C-12)

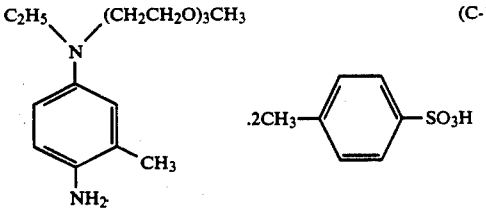

(C-13)

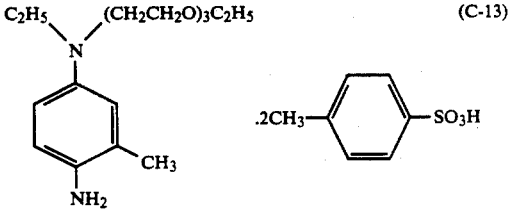

-continued

Exemplified color developing agents

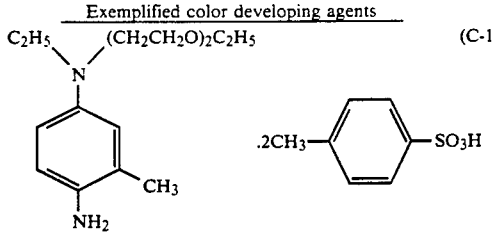

(C-14)

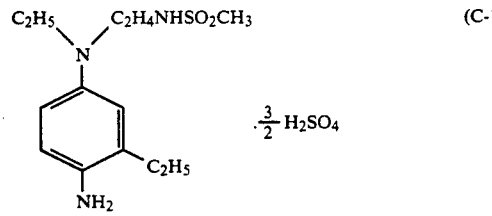

(C-15)

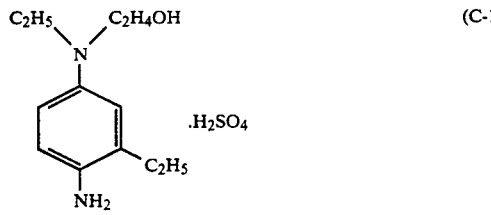

(C-16)

Of the color developing agents exemplified above, Exemplified Compound Nos. C-1, C-2, C-3, C-4, C-6, C-7 and C-15 are preferable, with more preference given to Nos. C-1 and C-3, since they are not likely cause fogging.

The color developing agent is normally used in the form of salt such as hydrochloride, sulfate or p-toluenesulfonate.

Although the color developing agent having a water-soluble group, preferably used for the present invention, is used preferably at concentrations of not less than 0.5 to $10^{-3}$ mol, more preferably $1\times10^{-2}$ to $2\times10^{-1}$ mol per liter of color developer, more preference is given to the concentration range of from $1.5\times10^{-2}$ to $2\times10^{-1}$ mol per liter of color developer from the viewpoint of rapid processing.

The color developing agents exemplified above may be used singly or in combination, and where necessary, may be used in combination with a black-and-white developing agent such as phenidone, 4-hydroxymethyl-4-methyl-1-phenyl-3-pyrazolidone or Metol.

The color developing agent may be added not to the color developer but to a photographic material. In this case, a dye precursor is used as a color developing agent. Typical dye precursors are described in Japanese Patent O.P.I. Publication Nos. 65429/1983 and 24137/1983. Examples of such dye precursors include 2',4'-bismethanesulfonamido-4-diethylaminodiphenylamine, 2'-methanesulfonamido-4'-(2,4,6-triisopropyl)benzenesulfonamido-2-methyl-4-N-(2-methanesulfonamidoethyl)ethylaminodiphenylamine, 2'-methanesulfonamido-4'-(2,4,6-triisopropyl)benzenesulfonamido-4-(hydroxytrisethoxy)diphenylamine, 4-N-(2-methanesulfonamidoethyl)ethylamino-2-methyl-2',4'-bis(2,4,6-triisopropyl)benzenesulfonamidodiphenylamine, 2,4'-bismethanesulfonamido-4-N,N-diethylaminodiphenylamine, 4-n-hexyloxy-2'-methanesulfonamido-2,4,6-triisopropyl)benzenesulfonamidodiphenylamine, 4-methoxy-2'-methanesulfonamido-4'-(2,4,6-triisopropyl)-benzenesulfonamidodiphenylamine, 4-dihexylamino-4'-(2,4,6-triisopropylbenzenesulfonamido)diphenylamine, 4-n-hexyloxy-3'-methyl-4'-(2,4,6-triisopropylbenzenesyulfonamido)diphenylamine, 4-N,N-diethylamino-4'-(2,4,6-triis4opropylbenzenesulfonamido)diphenylamine and 4-N,N-dimethylamino-2-phenylsulfonyl-4'-(2,4,6-triisopropylbenzenesulfonamido)diphenylamine.

The amount of dye precursor added to the light-sensitive material is preferably 0.5 to 22 mg, more preferably 4 to 12 mg per 100 $cm^2$ of light-sensitive material.

In the present invention, the color developing time may be arbitrarily selected, but it is normally 10 seconds to 4 minutes, preferably 20 seconds to 200 seconds, more preferably 30 to 200 seconds, and ideally 45 to 200 seconds for a light-sensitive material of the invention wherein the total amount of silver coated is not less than 2 $g/m^2$. For a light-sensitive material of the invention wherein the total amount of silver coated is not more than 1 $g/m^2$, the color developing time is normally 3 seconds to 4 minutes, preferably 5 seconds to 2 minutes, more preferably 7 to 60 seconds, and ideally 8 to 50 seconds. The processing times for these two light-sensitive materials with different total amounts of silver coated may be equal or not, but it is a common practice to process the light-sensitive material with a less amount of silver coated for a shorter time.

When the amount of replenisher for the color developer for the present invention is 10 to 900 ml per $m^2$ of light-sensitive material, more particularly 20 to 700 ml, and still more particularly 30 to 500 ml, the effect of the invention is enhanced for a light-sensitive material of the invention wherein the total amount of silver coated is 2 to 10 $g/m^2$. For a light-sensitive material of the invention wherein the total amount of silver coated is not more than 1 $g/m^2$, the effect of the invention is enhanced when the amount of replenisher for the color developer is 10 to 400 ml, particularly 20 to 200 ml, and more particularly 30 to 100 ml per $m^2$ of light-sensitive material.

In the present invention, color developing is normally followed by processing with a processing solution capable of bleaching.

As a bleaching agent used in the bleacher or bleach-fixer as a processing solution capable of bleaching, a metal complex salt of organic acid is used, which metal complex salt acts to oxidize the metal salt formed upon development to silver halide and comprises an organic acid such as aminopolycarboxylic acid, oxalic acid or citric acid and a metal ion such as iron, cobalt or copper ion. The most preferable organic acid for the formation of such a metal complex salt of organic acid is polycarboxylic acid or aminopolycarboxylic acid. The polycarboxylic acid or aminopolycarboxylic acid may be an alkali metal salt, ammonium salt or water-soluble amine salt.

Typical examples of these organic acids are given below.

(1) Ethylenediaminetetraacetic acid
(2) Diethylenetriaminepentaacetic acid
(3) Ethylenediamine-N-(β-oxyethyl)-N,N',N'-triacetic acid
(4) 1,3-propylenediaminetetraacetic acid
(5) Nitrilotriacetic acid
(6) Cyclohexanediaminetetraacetic acid
(7) Iminodiacetic acid
(8) Dihydroxyethylglycinecitric acid
(9) Ethyl ether diaminetetraacetic acid

(10) Glycol ether diaminetetraacetic acid
(11) Ethylenediaminetetrapropionic acid
(12) Phenylenediaminetetraacetic acid Of these aminopolycarboxylic acids for ferric salts Organic Acid Nos. 1, 2, 4 and 10 are preferably used, with more preference given to Nos. 1, 2 and 4.

The bleacher or bleach-fixer used may contain various additives in addition to a metal complex salt of organic acid described above as a bleaching agent. Particularly preferable additives are re-halogenating agents such as potassium bromide, sodium bromide, sodium chloride, ammonium bromide and other alkali halides or ammonium halides, metal salts, chelating agents, nitrates and commonly known bleaching accelerators. Compounds which are known to be added to bleacher, for example, pH buffers such as borates, oxalates, acetates, carbonates and phosphates, alkylamines and polyethyleneoxides, can be added appropriately.

Any kind of fixing agent can be used in the fixer or bleach-fixer. For example, thiosulfate and thiocyanate may be used singly or in combination, but there is no limitation. When using a thiosulfate, the amount of its addition is preferably at least 0.4 mol/l, and when using a thiocyanate, the amount of its addition is preferably at least 0.5 mol/l.

Moreover, the fixer and bleach-fixer may contain one or more pH buffers comprising a sulfite such as ammonium sulfite, potassium sulfite, sodium bisulfite, ammonium metabisulfite, potassium metabisulfite or sodium metabisulfite, or various acids or salts such as boric acid, borax, sodium hydroxide, potassium hydroxide, sodium carbonate, potassium carbonate, sodium bicarbonate, potassium bicarbonate, acetic acid, sodium acetate and ammonium hydroxide.

In the present invention, to increase the activity of the bleacher or bleach-fixer, air sparging or oxygen sparging may be added as desired in the bleacher bath or bleach-fixer bath and in the bleacher replenisher or bleach-fixer replenisher storage tank. An appropriate oxidant such as hydrogen peroxide, hydrobromate or persulfate may be appropriately added. It is also possible to place a highly oxygen permeable material such as a silicone tube in the circulation path to increase the aeration effect.

The pH of the bleacher for the present invention is normally 2.5 to 6.5, preferably 3.0 to 5.5.

The pH of the fixer or bleach-fixer for the present invention is normally 5.0 to 9.0, preferably 5.5 to 8.5.

In the processing method of the present invention, washing may precede stabilization after bleaching and fixation or bleach-fixation following color developing or may not do so, but it is preferable to immediately conduct stabilization, whereby the effect of the invention is enhanced. In addition to these processes, known auxiliary processes such as those for hardening, neutralization, black-and-white developing, reversion and washing with a small amount of water may be added as necessary. Typical examples of preferred processing flows include those shown in FIG. 3.

Figure 3:
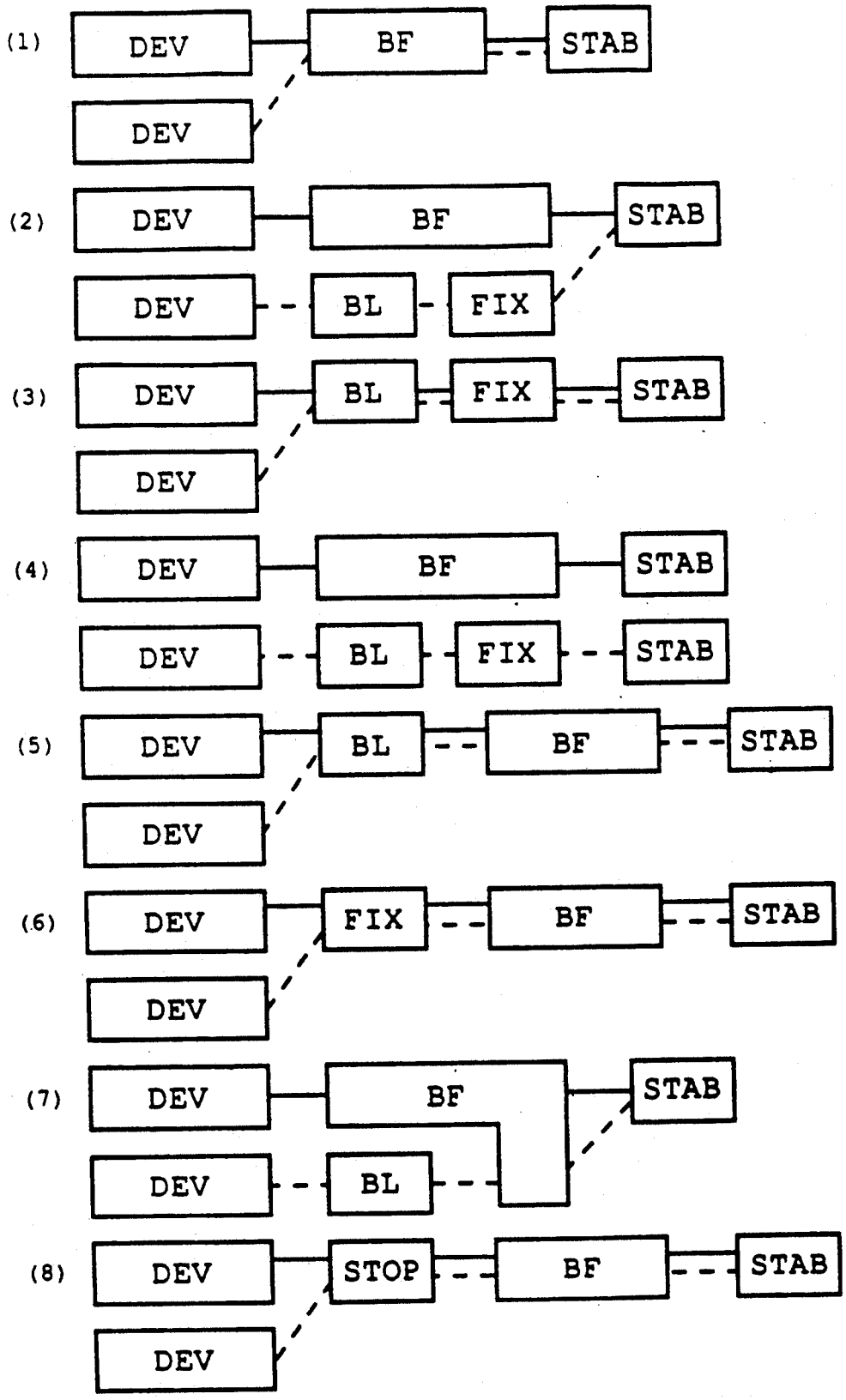
FIG. 3 represents flow diagrams of processing flows.
Figure 3:
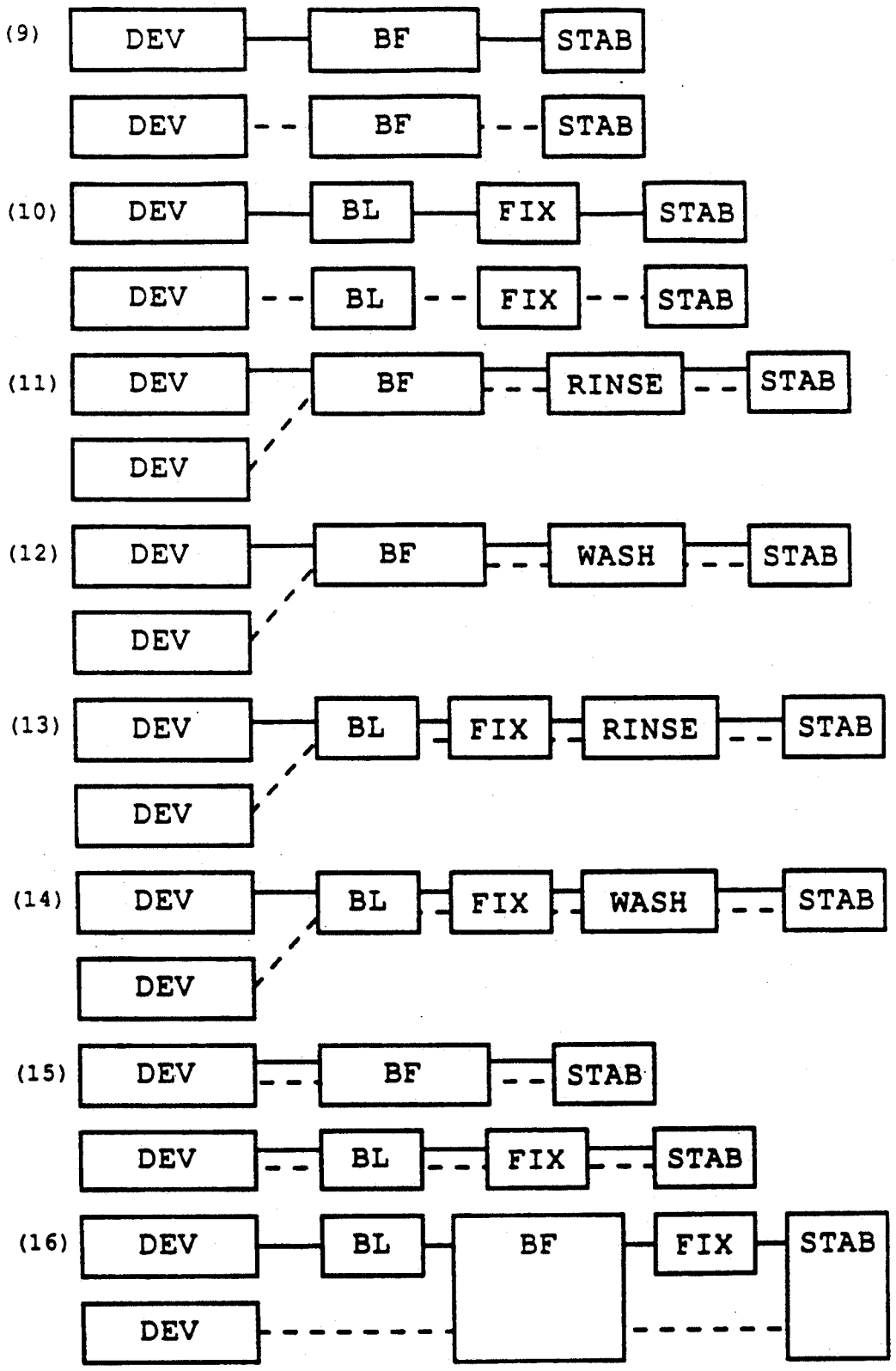

In the flow diagrams of FIG. 3, DEV, BL, BF, FIX, STAB, STOP, RINSE, and WASH represent color developing, bleaching, bleach-fixation, fixation, stabilization, s rinsing, and washing, respectively. The solid lines show the flows of processing of the light-sensitive material A of the present invention wherein the total amount of silver coated is not less than 2 g/m$^2$ and not more than 10 g/m$^2$; the dotted lines show the flows of processing of the light-sensitive material B of the invention wherein the total amount of silver coated is not more than 1 g/m$^2$. Of these processes, 1, 2 and 3 are preferably used.

Another preferred mode of embodiment of the processing method of the invention is to allow a part or all of the overflow from the color developer to enter in the bleacher or bleach-fixer in the procedure which follows. In this method, sludge formation in the bleacher or bleach-fixer is suppressed and the efficiency of silver recovery from the bleach-fixer is improved when a given amount of the color developer is allowed to enter in the bleacher or bleach-fixer.

The effect described above is enhanced when a part or all of the overflow from the stabilizer of the invention is allowed to enter in the bleach-fixer or fixer. Still another preferred mode of embodiment of the processing method of the present invention is to allow a part or all of the bleacher or fixer to enter in the processing tank for low silver content light-sensitive materials from the processing tank for high silver content light-sensitive materials, whereby the effect of the invention is enhanced.

Examples of processing solutions for the present invention include a color developer, bleacher, bleach-fixer, fixer, stabilizer, black-and-white developer, stopper, rinsing solution and hardening solution. For the bleacher, the bleaching agents, pH levels, acids, addition amounts of acids, and bleaching accelerators described in Japanese Patent O.P.I. Publication No. 44347/1990, pp. 3–4, and Japanese Patent O.P.I. Publication No. 43546/1990, pp, 37–38, and other ordinary additives are used. For the fixer, the fixing agents, fixation accelerators, preservatives and chelating agents described in Japanese Patent O.P.I. Publication No. 44347/1990, p. 4, and other ordinary additives are used. For the bleach-fixer, the additives described in Japanese Patent O.P.I. Publication No. 43546/1990, pp. 37–38 are used. For the stabilizer for the present invention, the bactericides, antifungal agents, chelating agents, surfactants and fluorescent brightening agents described in Japanese Patent O.P.I. Publication No. 43546/1990, pp. 38–39 and other additives are used.

As for the amount of replenisher for the bleacher, bleach-fixer and fixer, it is normally 50 to 900 ml, preferably 100 to 500 ml per m$^2$ of light-sensitive material for a light-sensitive material wherein the total amount of silver coated is not less than 2 g/m$^2$, and it is normally 10 to 400 ml, preferably 20 to 100 ml per m$^2$ of light-sensitive material for a light-sensitive material wherein the total amount of silver coated is not more than 1 g/m$^2$.

Light-sensitive materials preferable for the present invention are described below.

The silver halide grains for light-sensitive materials comprise silver chloride, silver chlorobromide, silver iodobromide or silver chloroiodobromide. A light-sensitive material A wherein the amount of silver coated is 2 to 10 g/m$^2$ preferably contains at least 1 mol % silver iodide, with more preference given to a silver iodobromide emulsion containing not less than 2 mol % and not more than 30 mol % silver iodide. Examples of such silver iodobromide emulsions include the high iodine light-sensitive materials described in Japanese Patent O.P.I. Publication Nos. 190854/1990 and 190855/1990.

For a light-sensitive material B wherein the amount of silver coated is not more than 1 g/m$^2$, silver chloride or silver chlorobromide is preferably used, with more preference given to an emulsion containing a high concentration of silver chloride, for example, not less than 50 mol % silver chloride.

Emulsions with high silver chloride content are described below.

Silver halide grains preferably used in light-sensitive materials are based mainly on silver chloride which contains at least 50 mol % silver chloride, more preferably not less than 80 mol %, still more preferably not less than 90 mol %, yet more preferably not less than 95 mol %, and ideally not less than 98 mol %.

The silver halide emulsion based mainly on silver chloride may contain silver bromide and/or silver iodide in addition to silver chloride in the silver halide composition. In this case, the silver bromide content is preferably not more than 20 mol %, more preferably not more than 10 mol %, and still more preferably not more than 3 mol %. When silver iodide is contained, its content is preferably not more than 1 mol %, more preferably not more than 0.5 mol %, and ideally zero. Such silver halide grains based mainly on silver chloride having a silver chloride content of not less than 50 mol % are added to at least one silver halide emulsion layer, but it is preferable to add them to all silver halide emulsion layers.

The crystal configuration of the silver halide grains may be normal crystal, twin crystal or any other crystal, and any ratio of the (1.0.0) plane and the (1.1.1) plane is usable. With respect to the crystal structure of these silver halide grains, it may be uniform from the core to the outer portion and may be of the core shell type wherein the core and the outer portion are of different layer structures. These silver halides may be of the type wherein latent images are formed mainly on the surface, or of the type wherein latent images are formed mainly inside the grains. Moreover, tabular grains of silver halide such as those described in Japanese Patent O.P.I. Publication No. 113934/1983 and Japanese Patent Application No. 170070/1984 may be used. Also usable are the silver halides described in Japanese Patent O.P.I. Publication Nos. 26837/1989, 26838/1989 and 77047/1989.

The silver halide grains may be prepared by any of the acid method, neutral method, ammoniacal method and other methods.

It is also possible to use the method in which seed grains are formed by the acid method and are grown to a given size by the ammoniacal method, which ensures rapid grain growth. In growing silver halide grains, it is preferable to control the pH, pAg and other factors in the reactor and to sequentially or simultaneously add and mix silver ions and halide ions in an amount according to the rate of growth of silver halide grains described in Japanese Patent O.P.I. Publication No. 48521/1979.

The silver halide emulsion layer of the light-sensitive material processed in accordance with the present invention contains color couplers. The color couplers form a non-diffusible dye upon reaction with the oxidation product of a color developing agent. The color couplers are bound together in, or in close contact with, the light-sensitive layer preferably in a non-diffusible form.

The red-sensitive layer may thus contain a non-diffusible color coupler which forms a cyan color image, normally a phenol or a-naphthol coupler. The green-sensitive layer may contain at least one non-diffusible color coupler which forms a magenta color image, normally a 5-pyrazolone color coupler and pyrazolotriazole. The blue-sensitive layer may contain at least one non-diffusible color coupler which forms a yellow color image, normally a color coupler having an open chain ketomethylene group. The color coupler may be a 6-, 4- or 2-equivalent coupler, for instance.

A 2-equivalent coupler is particularly preferred for the present invention.

Appropriate couplers are disclosed in the following and other publications: W. Pelz, "Color Coupler" (Farbkuppler) in Mitteilunglnausden Forschungslaboratorien der Agfa, Leverkusen/Munchen, vol. III, p. 111 (1961); K. Venkataraman, "The Chemistry of Synthetic Dyes", vol. 4, pp. 341–387 Academic Press; "The Theory of the Photographic Processes", 4th edition, pp. 353–362; Research Disclosure No. 17643, Section VII.

From the viewpoint of enhancement of the desired effect of the invention, it is preferable to use the magenta coupler represented by the Formula M-1 described in Japanese Patent O.P.I. Publication No. 106655/1988, p. 26 (exemplified by Magenta Coupler Nos. 1 through 77 described in Japanese Patent O.P.I. Publication No. 106655/1988, pp. 29–34), the cyan coupler represented by the Formula C-I or C-II described in Japanese Patent O.P.I. Publication No. 106655/1988, p. 34 (exemplified by Cyan Coupler Nos. C'-1 through C'-82 and C''-1 through C''-36 described in Japanese Patent O.P.I. Publication No. 106655/1988, pp. 37–42) and the rapid yellow coupler described in Japanese Patent O.P.I. Publication No. 106655/1988, p. 20 (exemplified by Cyan Coupler Nos. Y'-1 through Y'-39 described in Japanese Patent O.P.I. Publication No. 106655/1988, pp. 21–36).

The desired effect of the invention is enhanced when the magenta coupler represented by Formula M-1 is used.

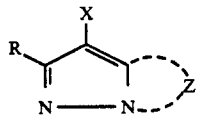

Formula M-I wherein

Z represents a group of non-metallic atoms necessary to form a nitrogen-containing heterocyclic ring, which ring may have a substituent.

X represents a hydrogen atom or a group capable of splitting off upon reaction with the oxidation product of a color developing agent.

R represents a hydrogen atom or substituent.

The substituent represented by R is not subject to limitation. Typical examples thereof include alkyl, aryl, aniline, acylamino, sulfonamide, alkylthio, arylthio, alkenyl and cycloalkyl groups, and halogen atoms, cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureide, sulfamoylamino, alkoxycarbonylamino, aryloxycarbonylamino, alkoxycarbonyl, aryloxycarbonyl and heterocyclic thio groups, and spiro compound residues and bridged hydrocarbon compound residues.

The alkyl group represented by R preferably has a carbon number of 1 to 32, whether linear or branched.

The aryl group represented by R is preferably a phenyl group.

Examples of the acylamino group represented by R include alkylcarbonylamino groups and arylcarbonylamino groups.

Examples of the sulfonamide group represented by R include alkylsulfonylamino groups and arylsulfonylamino groups.

The alkyl moiety and aryl moiety in the alkyl thio group and arylthio group represented by R include the alkyl groups and aryl groups represented by R.

The alkenyl group represented by R preferably has a carbon number of 2 to 32. The cycloalkyl group represented by R preferably has a carbon number of 3 to 12, particularly 5 to 7. The alkenyl group may be linear or branched.

The cycloalkenyl group represented by R preferably has a carbon number of 3 to 12, particularly 5 to 7.

Examples of the sulfonyl group represented by R include alkylsulfonyl groups and arylsulfonyl groups.

Examples of the sulfinyl group represented by R include alkylsulfinyl groups and arylsulfinyl groups.

Examples of the phosphonyl group represented by R include alkylphosphonyl groups, alkoxyphosphonyl groups, arylphosphonyl groups and arylphosphonyl groups.

Examples of the acyl group represented by R include alkylcarbonyl groups and arylcarbonyl groups.

Examples of the carbamoyl group represented by R include alkylcarbamoyl groups and arylcarbamoyl groups.

Examples of the sulfamoyl group represented by R include alkylsulfamoyl groups and arylsulfamoyl groups.

Examples of the acyloxy group represented by R include alkylcarbonyloxy groups and arylcarbonyloxy groups.

Examples of the carbamoyloxy group represented by R include alkylcarbamoyloxy groups and arylcarbamoyloxy groups.

Examples of the ureide group represented by R include alkylureide groups and arylureide groups.

Examples of the sulfamoylamino group represented by R include alkylsulfamoylamino groups and arylsulfamoylamino groups.

The heterocyclic group represented by R is preferably a 5- to 7-membered ring, including a 2-furyl group, 2-thienyl group, 2-pyrimidinyl group and 2-benzothiazolyl group.

The heterocyclic oxy group represented by R preferably has a 5- to 7-membered heterocyclic ring, including a 3,4,5,6-tetrahydropyranyl-2-oxy group and 1-phenyltetrazole-5-oxy group.

The heterocyclic thio group represented by R is preferably a 5- to 7-membered heterocyclic thio group, including a 2-pyridylthio group, 2-benzothiazolylthio group and 2,4-diphenoxy-1,3,5-triazole-6-thio group.

Examples of the siloxy group represented by R include a trimethylsiloxy group, triethylsiloxy group and dimethylbutylsiloxy group.

Examples of the imide group represented by R include an succinimide group, 3-heptadecylsuccinimide group, phthalimide group and glutarimide group.

Examples of the spiro compound residue represented by R include spiro[3.3]heptan-1-yl.

Examples of the bridged hydrocarbon compound residue represented by R include bicyclo[2.2.1]heptan-1-yl, tricyclo[3.3.1.1$^{3,7}$]decan-1-yl and 7,7-dimethylbicyclo[2.2.1]heptan-1-yl.

Examples of the group capable of splitting off upon reaction with the oxidation product of a color developing agent, represented by X, include halogen atoms such as those of chlorine, bromine and fluorine, and alkoxy, aryloxy, heterocyclic oxy, acyloxy, sulfonyloxy, alkoxycarbonyloxy, aryloxycarbonyl, alkyloxyaryloxy, alkoxyoxaryloxy, alkoxythio, arylthio, heterocyclic thio, alkyloxythiocarbonylthio, acylamino, sulfonamide, nitrogen-containing heterocyclic rings bound via nitrogen atom, alkyloxycarbonylamino, aryloxycarbonylamino, carboxyl,

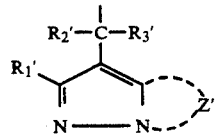

wherein $R_1'$ has the same definition as R above; Z' has the same definition as Z above; $R_2'$ and $R_3'$ independently represent a hydrogen atom, aryl group, alkyl group or heterocyclic group, with preference given to a halogen atom, particularly an atom of chlorine.

Examples of the nitrogen-containing heterocyclic ring formed by Z or Z' include a pyrazole ring, imidazole ring, triazole ring and tetrazole ring; the substituent which may be contained in the ring is exemplified by the examples given for R above.

The compound represented by the Formula M-I is more specifically represented by the following Formulas M-II through M-VII.

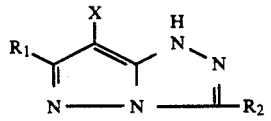

Formula M-II

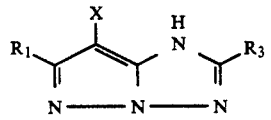

Formula M-III

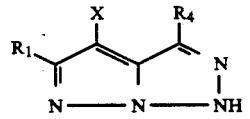

Formula M-IV

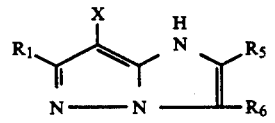

Formula M-V

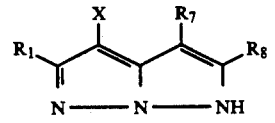

Formula M-VI

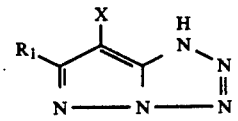

Formula M-VII

With respect to Formulas M-II through M-VII, $R_1$ through $R_8$ and X have the same definitions as R and X above.

The compound represented by Formula M-I is preferably represented by the following Formula M-VIII.

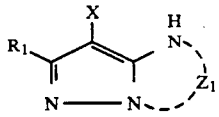

Formula M-VII wherein $R_1$, X and $Z_1$ have the same definitions as R, X and Z in Formula M-I.

Of the magenta couplers represented by Formulas M-II through M-VII, the magenta coupler represented by Formula M-II is preferred.

The substituent which may be contained in the ring formed by Z in Formula M-I and in the ring formed by $Z_1$ in Formula M-VIII, and $R_2$ through $R_8$ in Formulas M-II through M-VI are preferably represented by the following Formula M-IX.

$$-R^1-SO_2-R^2$$ Formula M-IX wherein $R^1$ represents an alkylene group; $R^2$ represents an alkyl group, cycloalkyl group or aryl group.

The alkylene group represented by $R^1$, whether linear or branched, preferably has a carbon number of 2 or more, more preferably 3 to 6 in the linear moiety.

The cycloalkyl group represented by $R^2$ is preferably a 5- or 6-membered ring.

In the formation of positive images, the substituents R and $R_1$ on the heterocyclic ring is most preferably represented by the following Formula M-X.

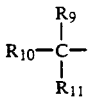

Formula M-X wherein $R_9$, $R_{10}$ and $R_{11}$ have the same definitions as R above.

Two of the $R_9$, $R_{10}$ and $R_{11}$, for example, $R_9$ and $R_{11}$, may bind together to form a saturated or unsaturated ring such as a cycloalkane, cycloalkene or heterocyclic ring, which ring may be bound with $R_{11}$ to form a bridged hydrocarbon compound residue.

With respect to Formula M-X, it is preferable that (i) at least two of $R_9$ through $R_{11}$ are alkyl groups, or (ii) one of $R_9$ through $R_{11}$, for example, $R_{11}$, is a hydrogen atom while the other two, namely $R_9$ and $R_{10}$, bind together to form a cycloalkyl in cooperation with the root carbon atom.

With respect to the case (i), it is preferable that two of $R_9$ through $R_{11}$ are alkyl groups while the remaining one is a hydrogen atom or alkyl group.

In the formation of negative images, the substituents R and $R_1$ on the heterocyclic ring is most preferably represented by the following Formula M-XI.

$$R_{12}-CH_2-$$ Formula M-XI wherein $R_{12}$ has the same definitions as R above.

$R_{12}$ is preferably a hydrogen atom or alkyl group.

Typical examples of the compound of the present invention are given below.

1

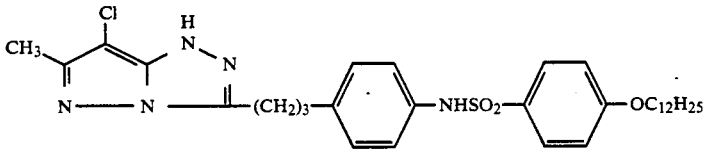

2

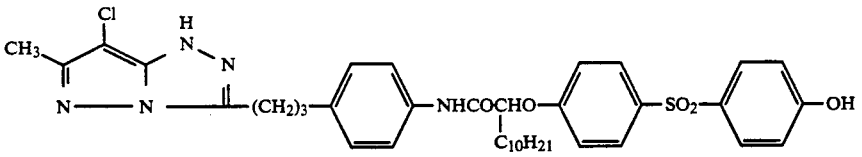

3

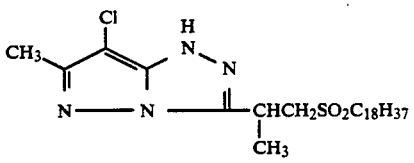

4

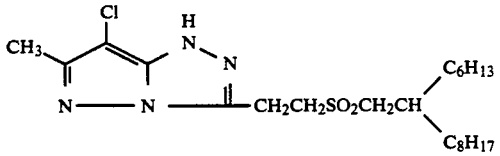

-continued
5
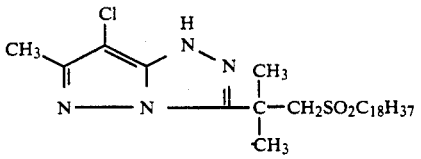
6
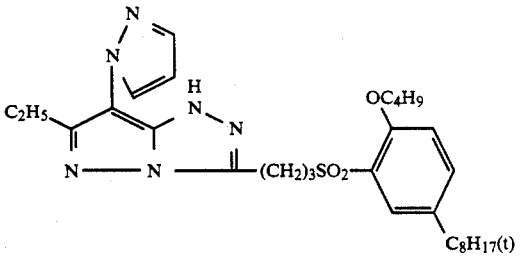
7
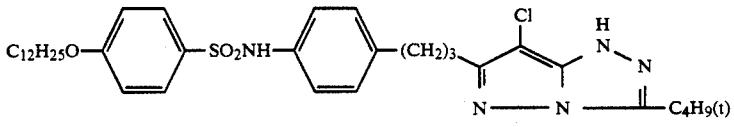
8
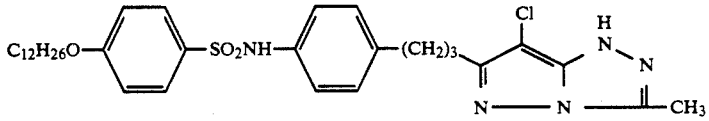
9
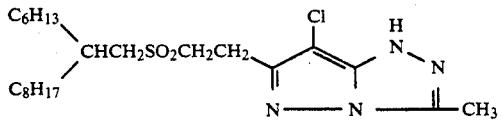
10
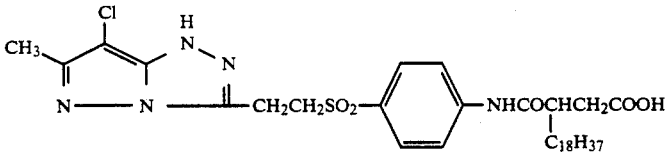
11
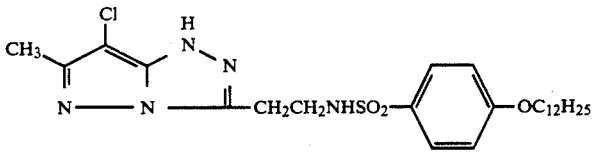
12
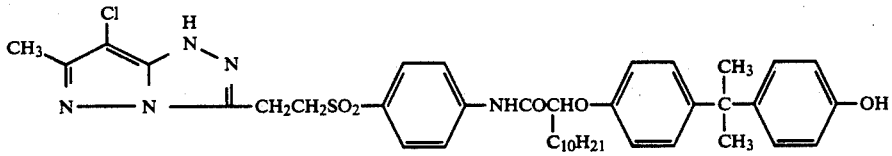
13
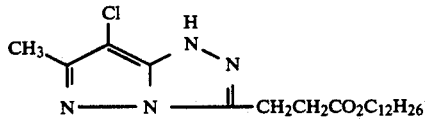
14
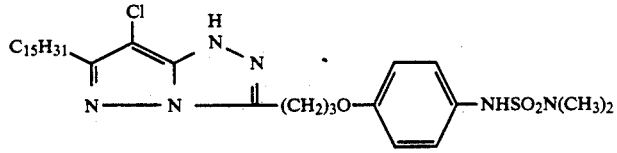

-continued
15
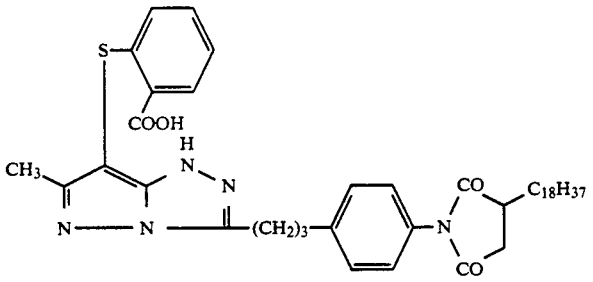
16
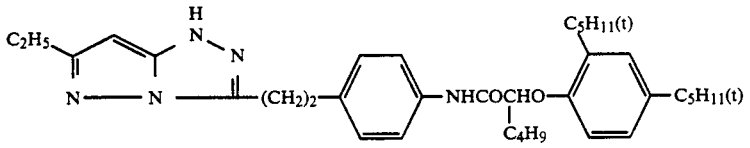
17
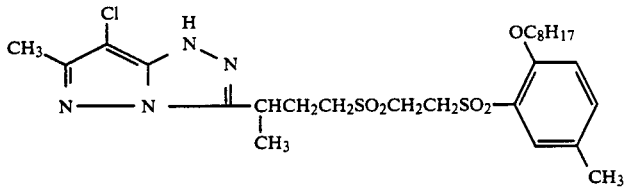
18
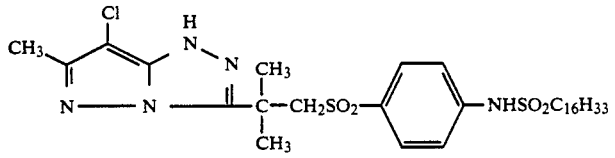
19
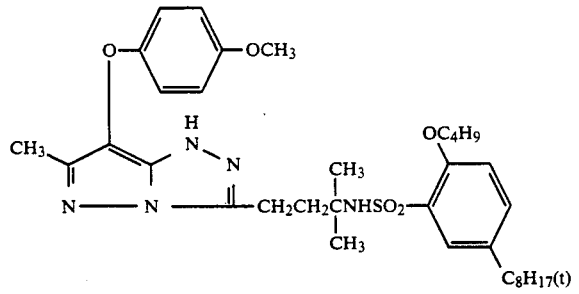
20
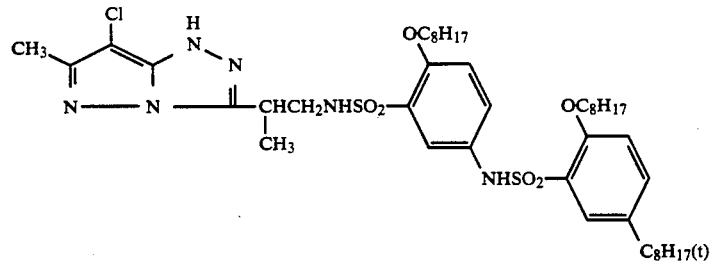
21
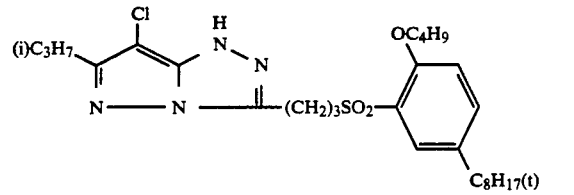

-continued
22
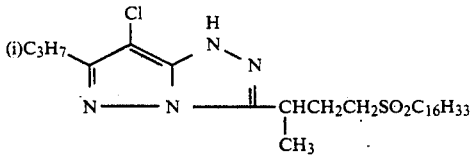
23
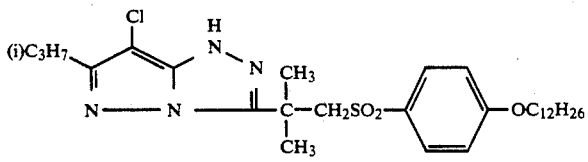
24
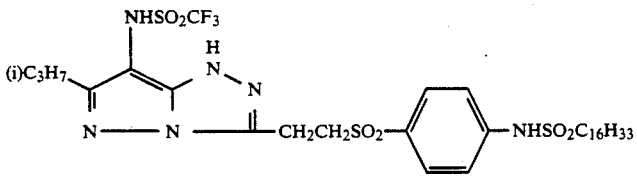
25
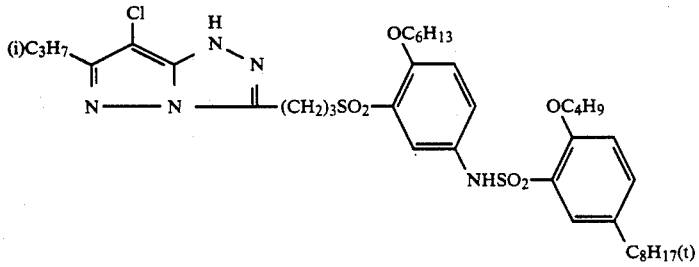
26
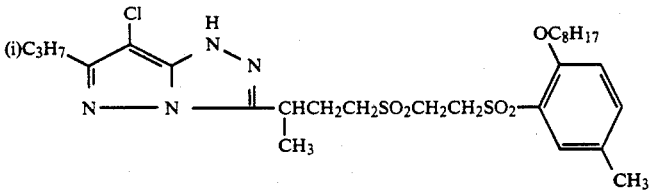
27
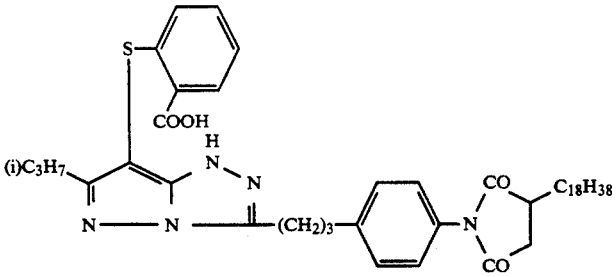
28
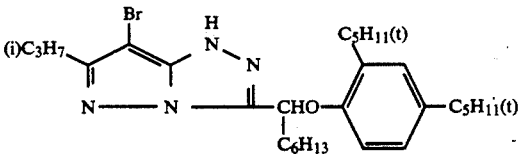
29
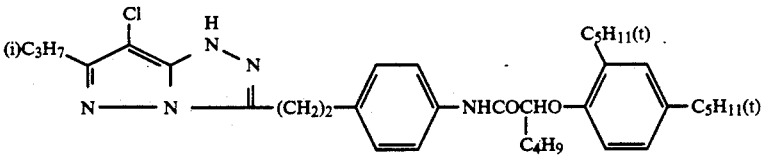

-continued
30
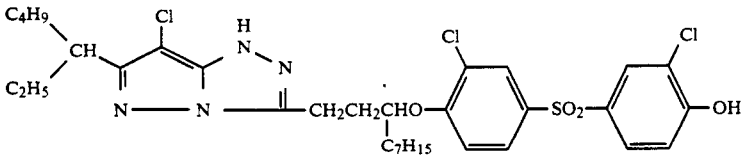
31
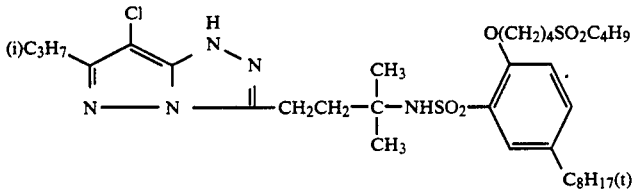
32
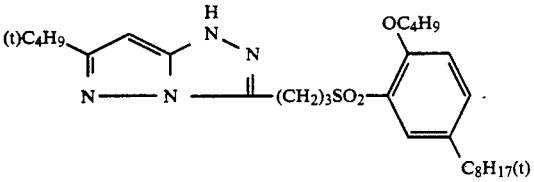
33
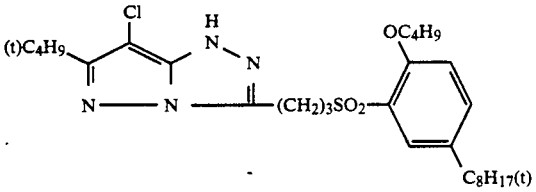
34
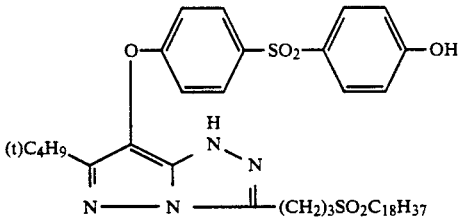
35
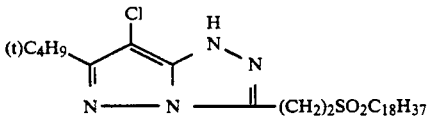
36
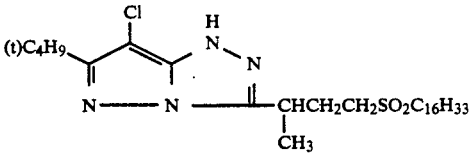
37
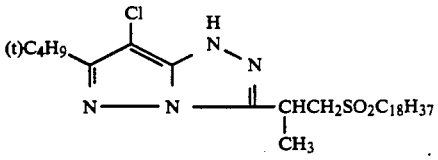
38
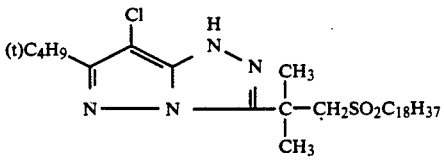

-continued
39
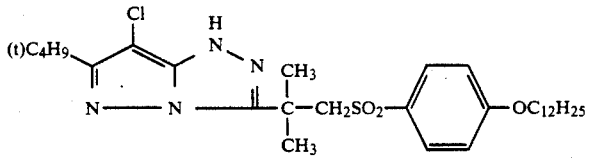
40
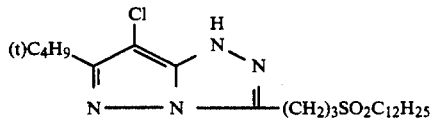
41
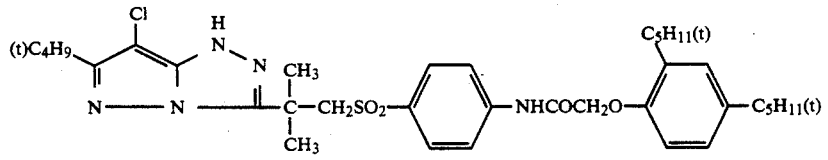
42
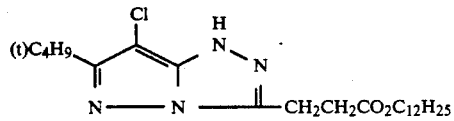
43
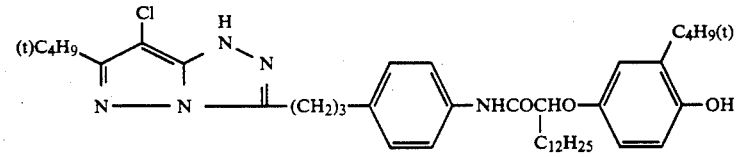
44
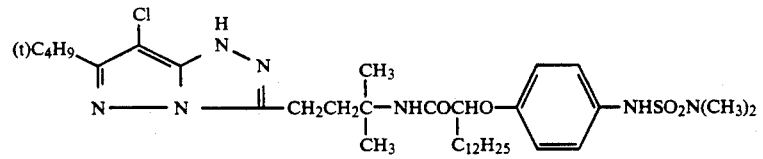
45
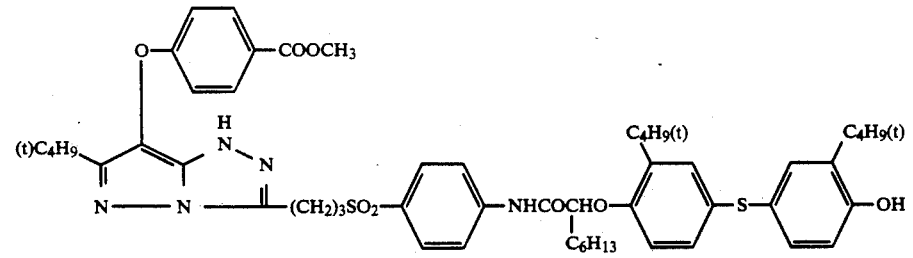
46
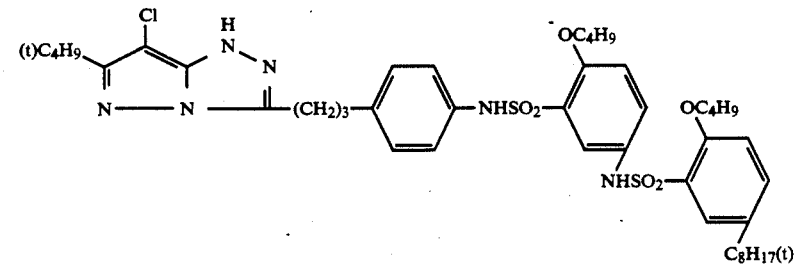

-continued
47
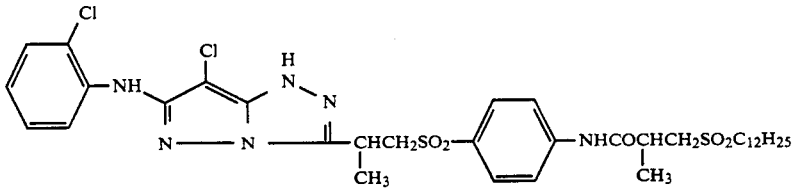
48
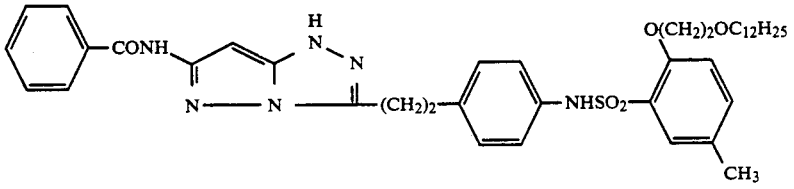
49
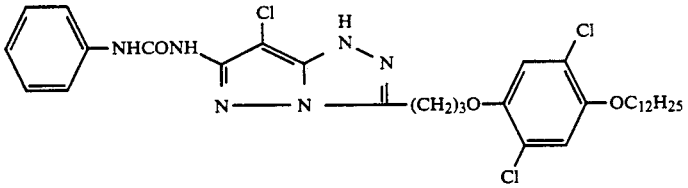
50
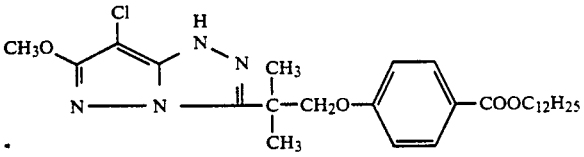
51
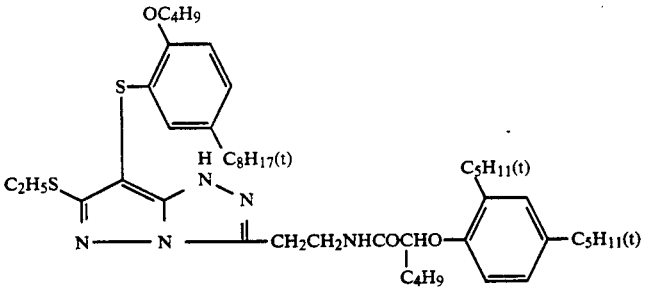
52
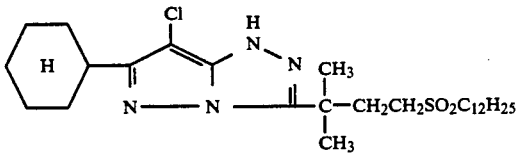
53
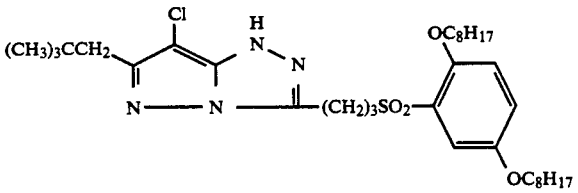

-continued
54
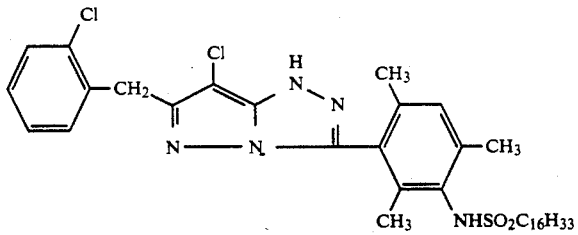
55
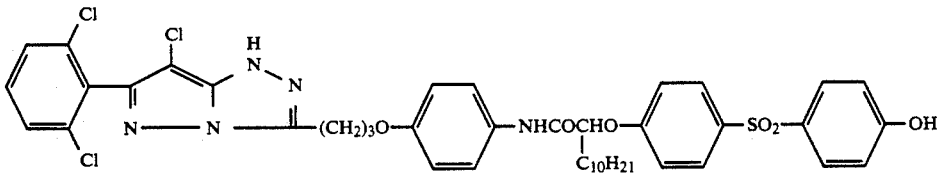
56
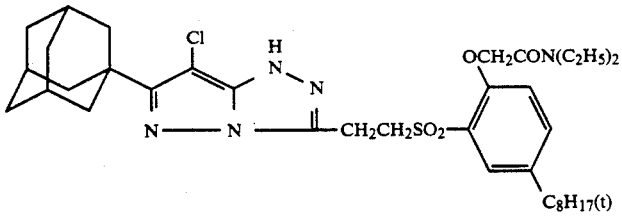
57
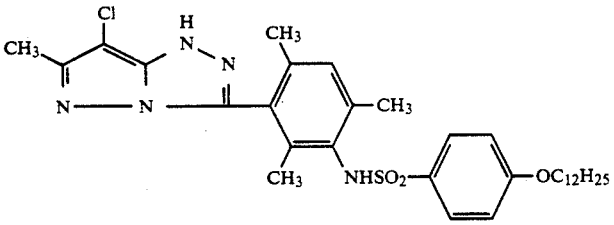
58
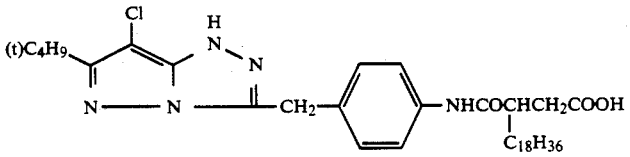
59
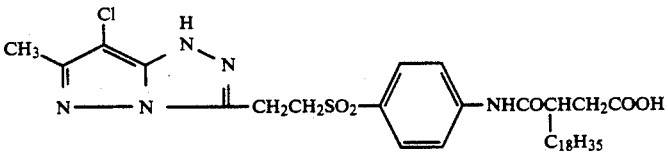
60
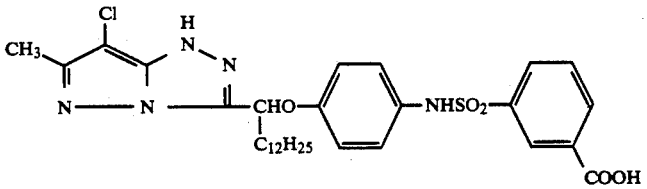
61
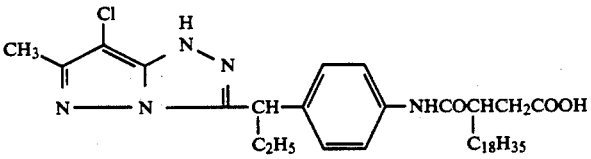

-continued
62
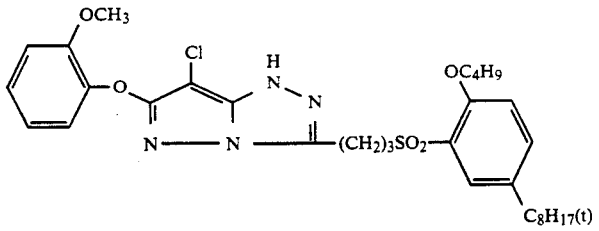
63
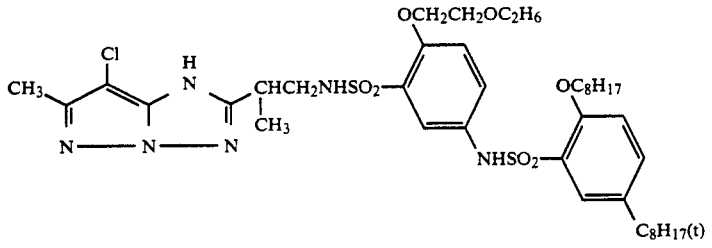
64
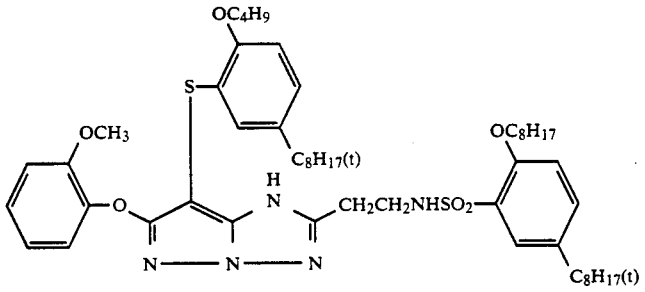
65
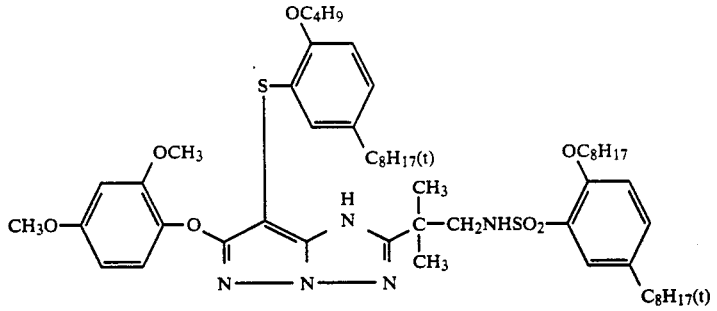
66
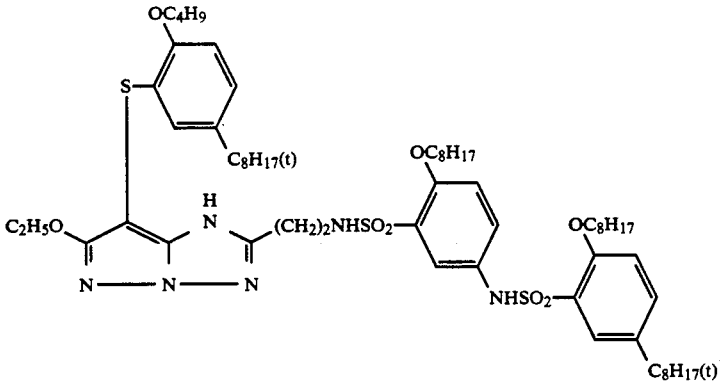

-continued
67
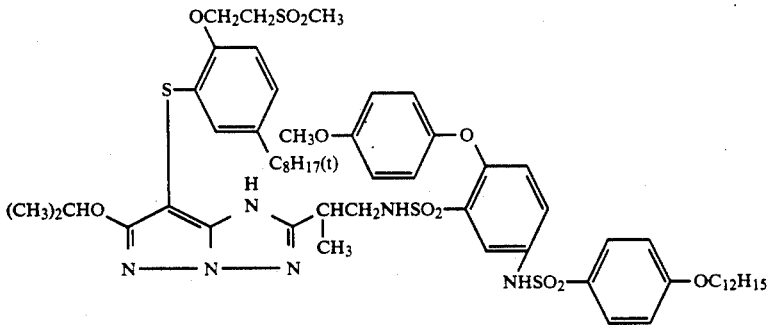
68
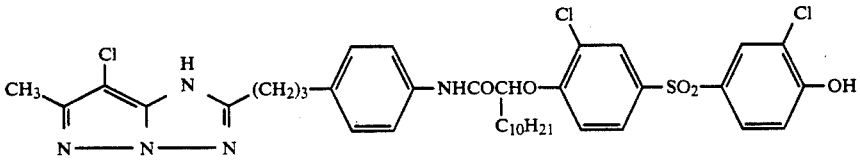
69
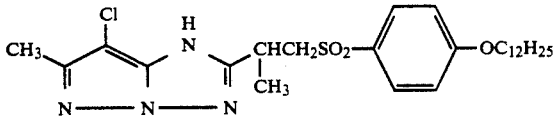
70
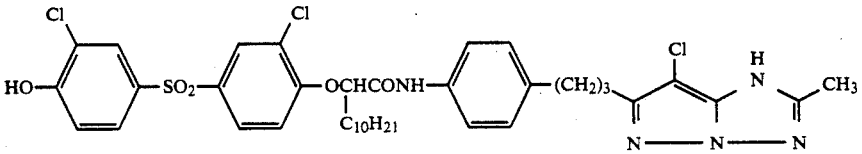
71
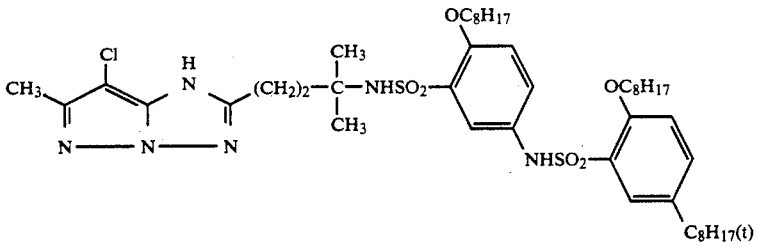
72
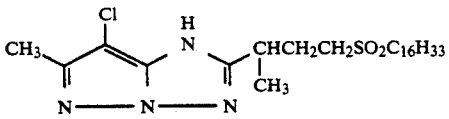
73
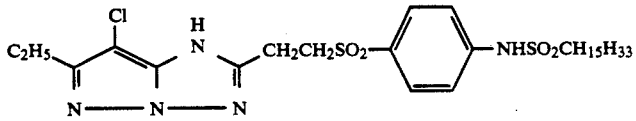
74
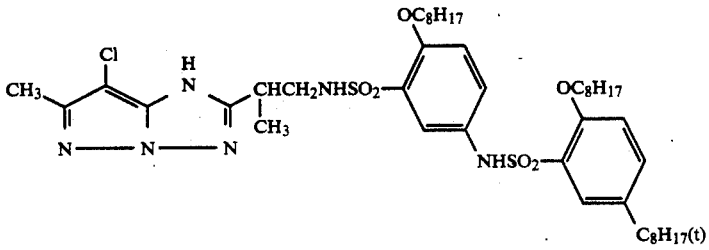

-continued
75
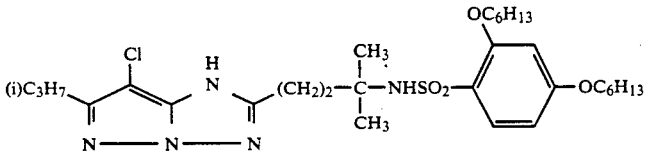
76
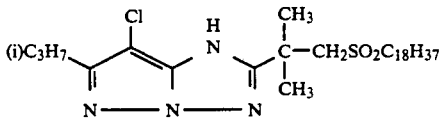
77
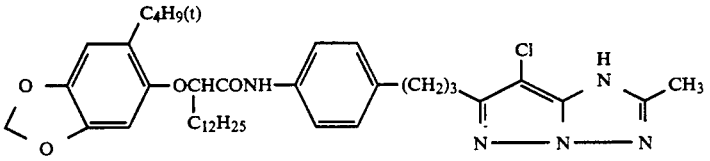
78
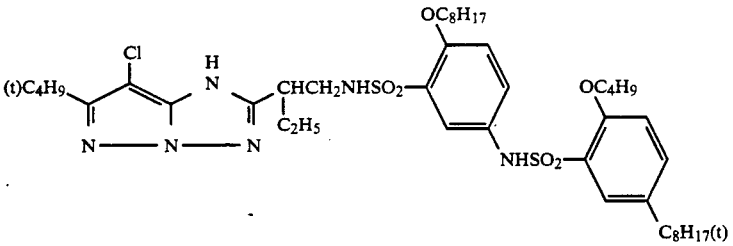
79
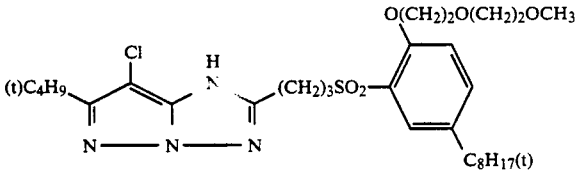
80
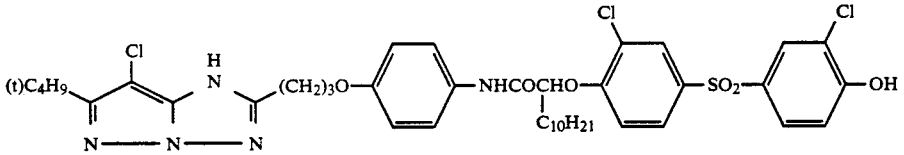
81
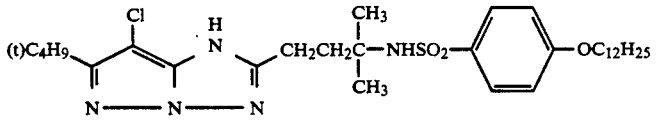
82
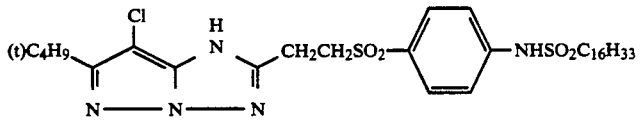
83
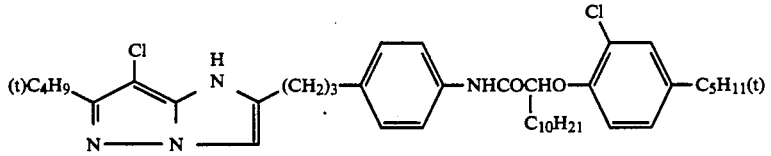

-continued
84
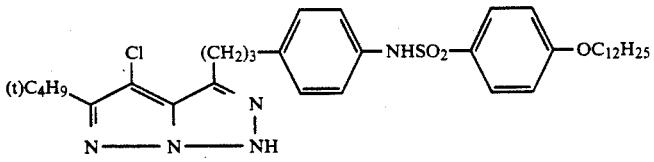
85
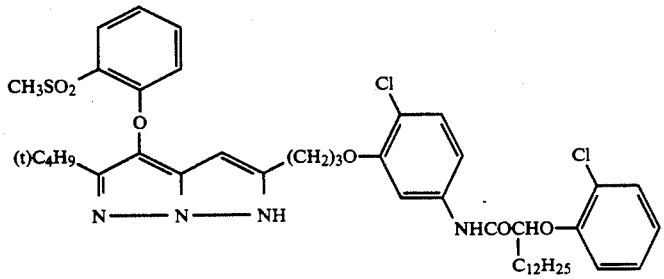
86
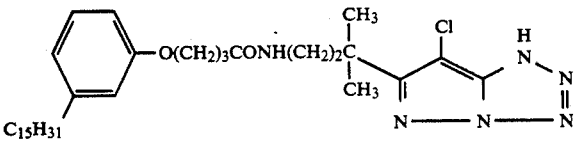
87
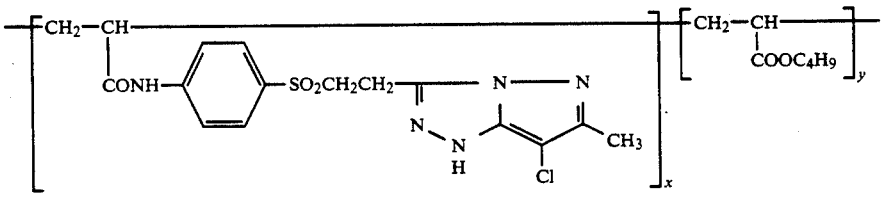
x:y = 50:50
88
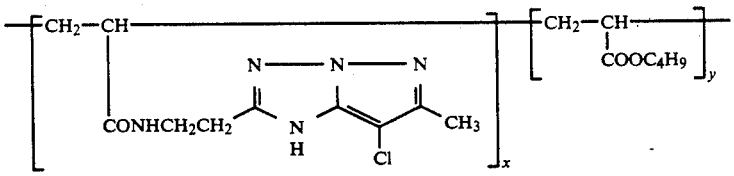
x:y = 50:50
89
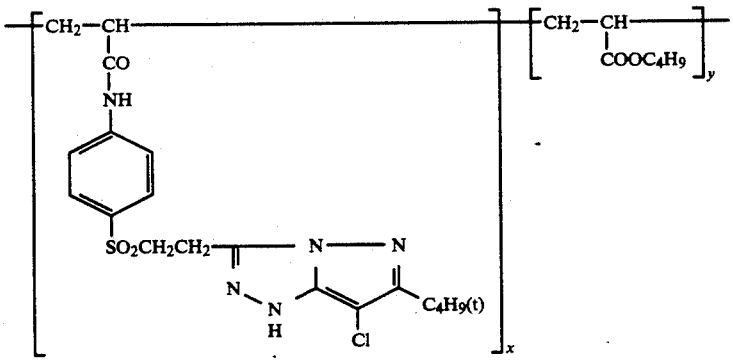
x:y = 50:50

-continued

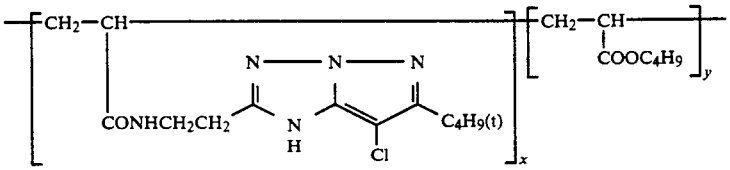

x:y = 50:50

In addition to the typical examples given above, the compound of the present invention is also exemplified by Compound Nos. 1-4, 6, 8-17, 19-24, 26-43, 45-59, 61-104, 106-121, 123-162 and 164-223 described in Japanese Patent O.P.I. Publication No. 166339/1987, pp. 18-32.

The couplers described above can be synthesized in accordance with the Journal of the Chemical Society, Perkin, I (1977), 2047-2052, US Patent No. 3,725,067, Japanese Patent O.P.I. Publication Nos. 99437/1984, 42045/1983, 162548/1984, 171956/1984, 33552/1985, 43659/1985, 172982/1985, 190779/1985, 209457/1987 and 307453/1988 and other publications.

The coupler of the present invention can be used normally at 1 to $10^{-3}$ to 1 mol, preferably $1\times10^{-2}$ to $8\times10^{-1}$ mol per mol of silver halide.

The coupler of the invention may be used in combination with other magenta couplers.

With respect to a light-sensitive material of the present invention wherein the total amount of silver coated is 2 to 10 g/m$^2$, the total amount of silver coated is preferably 3 to 10 g/m$^2$, more preferably 4 to 9 g/m$^2$. With respect to a light-sensitive material of the invention wherein the total amount of silver coated is not more than 1 g/m$^2$, the total amount of silver coated is preferably 0.2 to 0.9 g/m$^2$, more preferably 0.3 to 0.7 g/m$^2$.

It is a more preferred mode of embodiment of the present invention to use a nitrogen-containing heterocyclic mercapto compound in the light-sensitive material incorporating an emulsion based mainly on silver chloride, since it not only enhances the desired effect of the invention but also serves to minimize the influence on field immersion performance due to contamination of color developer with bleach-fixer.

Examples of these nitrogen-containing heterocyclic mercapto compounds include Compound Nos. I'-1 through I'-87 exemplified in Japanese Patent O.P.I. Publication No. 106655/1988, pp. 42-45.

A silver halide emulsion can be prepared by a conventional method such as single or double feeding of the starting materials at constant or accelerated rate. It is preferable to prepare it by double feeding while regulating the pAg (cf. Research Disclosure No. 17643, Sections I and II).

The silver halide emulsion may be chemically sensitized. A sulfur-containing compound such as allylisothiocyanate, allylthiourea or thiosulfate is particularly preferred as a chemical sensitizer. Reducing agents can also be used as chemical sensitizers, including the silver compounds described in Belgian Patent Nos. 493,464 and 568,687 and polyamine or aminomethylsulfinic acid derivatives such as the diethylenetriamine in accordance with Belgian Patent No. 547,323. Noble metals such as gold, platinum, palladium, iridium, ruthenium and rhodium and noble metal compounds also serve as appropriate sensitizers. This chemical sensitization procedure is described by R. Kosiovsky in "Zeitschrift für Wissenschaftliche Photographie", 46, 65-72 (1951) (cf. Research Disclosure No. 17643, Section III).

The silver halide emulsion may be optically sensitized by a known method using, for example, an ordinary polymethine dye such as neutrocyanine, basic or acidic carbocyanine, rhodacyanine or hexacyanine, or a styryl dye, oxonol or related substance (cf. F. M. Hamer, "The Cyanine Dyes and Related Compounds", Ullmanns Enbzyklpadie der Technischen Chemie, 4th edition, vol. 18, p. 431 (1964); Research Disclosure No. 17643, Section IV.

The silver halide emulsion may incorporate an ordinary anti-fogging agent and stabilizer. Azaindene is particularly suitable as a stabilizer, with preference given to tetra- and penta-azaindenes and more preference given to those substituted by a hydroxyl group or amino group. This kind of compounds are described in a paper by Birr titled "Zeitschrift für Wissenschaftliche Photographie", 47, 2-58 (1952) and Research Disclosure No. 17643, Section IV.

Additives can be added to the light-sensitive material by known methods such as those described in U.S. Pat. Nos. 2,322,027, 2,533,514, 3,689,271, 3,764,336 and 3,765,897. Of the components of the light-sensitive material, a coupler and UV absorbent can be incorporated in the form of a charged latex (cf. German Patent Publication No. 2,541,274 and European Patent Application No. 14,921). These components can also be immobilized as polymers in the light-sensitive material (cf. German Patent Publication No. 2,044,992 and U.S. Pat. Nos. 3,370,952 and 4,080,211).

An ordinary support can be used for the light-sensitive material, including a support of cellulose ester such as cellulose acetate and a support of polyester. In the present invention, a reflective support such as a paper support can also be used, which may be coated with polyolefin, particularly polyethylene or polypropylene (cf. Research Disclosure No. 17643, Sections V and VI).

The effect of the present invention is enhanced when adding a vinyl sulfone hardener to the light-sensitive material.

A vinyl sulfone hardener is a compound having a vinyl group bound to a sulfonyl group or a group capable of forming a vinyl group, preferably having at least two vinyl groups bound to a sulfonyl group or groups capable of forming a vinyl group. For example, the compound represented by the following Formula VS-I is preferably used for the invention.

$$L-(SO_2-X)_m \qquad \text{Formula VS-I}$$

wherein L represents a m-valent binding group; X represents a $-CH=CH_2$ or $-CH_2CH_2Y$ group; Y represents a group capable of splitting off upon reaction with base in the form of HY such as a halogen atom, sulfonyloxy group, sulfoxy group (including salt) or tertiary amine residue.

The symbol m represents an integer of 2 to 10; when m is 2 or more, the $—SO_2—X$ groups may be identical or not.

The m-valent binding group L is formed with one or more of an aliphatic hydrocarbon group such as alkylene, alkylidene or alkylidine or a group formed by them, aromatic hydrocarbon group such as arylene or a group formed by them, —O—, —NR'— (R' represents a hydrogen atom or an alkyl group preferably having a carbon number of 1 to 15), —S—, $$-\underset{|}{N}-,$$

—CO, —SO—, $—SO_2—$ or $—SO_3—$; when two or more —NR'— groups are contained, the R' groups may bind together to form a ring. The binding group L further includes those having a substituent such as a hydroxyl group, alkoxy group, carbamoyl group, sulfamoyl group, alkyl group or aryl group.

Examples of preferable groups for X include $—CH{=}CH_2$ and $—CH_2CH_2Cl$.

Typical examples of vinyl sulfone hardeners are given below.

$H_2C{=}CHSO_2CH_2SO_2CH{=}CH_2$ VS-1

$H_2C{=}CHSO_2(CH_2)_2SO_2CH{=}CH_2$ VS-2

$H_2C{=}CHSO_2(CH_2)_3SO_2CH{=}CH_2$ VS-3

$H_2C{=}CHSO_2CH_2OCH_2SO_2CH{=}CH_2$ VS-4

$H_2C{=}CHSO_2(CH_2)_2O(CH_2)_2SO_2CH{=}CH_2$ VS-5

$H_2C{=}CHSO_2CH_2\underset{\underset{OH}{|}}{C}HCH_2SO_2CH{=}CH_2$ VS-6

$H_2C{=}CHSO_2CH_2\underset{\underset{OH}{|}}{C}HCH_2\underset{\underset{OH}{|}}{C}HCH_2SO_2CH{=}CH_2$ VS-7

$H_2C{=}CHSO_2CH_2CONHCH_2NHCOCH_2SO_2CH{=}CH_2$ VS-8

$H_2C{=}CHSO_2CH_2CONH(CH_2)_2NHCOCH_2SO_2CH{=}CH_2$ VS-9

$H_2C{=}CHSO_2CH_2CONHCH_2CH_2CH_2NHCOCH_2SO_2CH{=}CH_2$ VS-10

VS-11

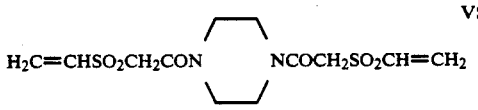

VS-12

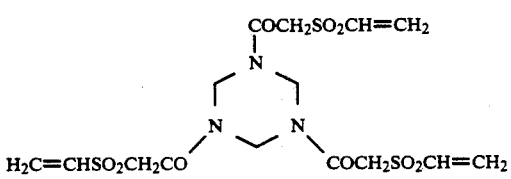

VS-13

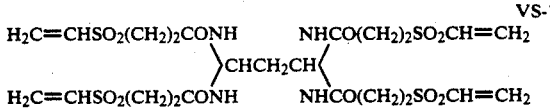

-continued

VS-14

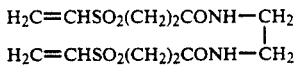

VS-15

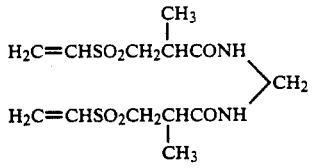

VS-16

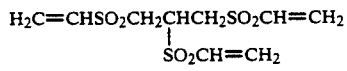

VS-17

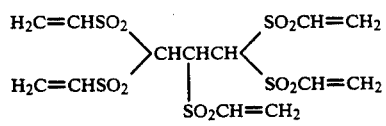

VS-18

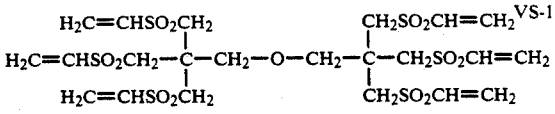

VS-19

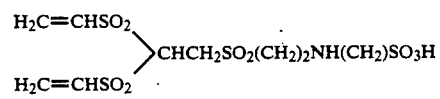

$[(H_2C{=}CHSO_2)_3CCH_2SO_2(CH_2)_2SCH_2]_2CO$ VS-20

VS-21

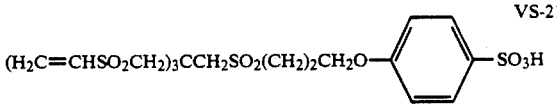

$(H_2C{=}CHSO_2CH_2)_4C$ VS-22

VS-23

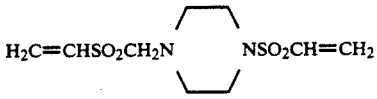

$(H_2C{=}CHSO_2CH_2)_3CC_2H_5$ VS-24

VS-25

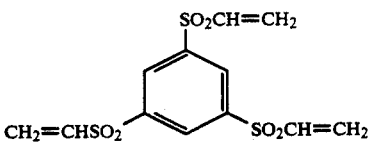

VS-26

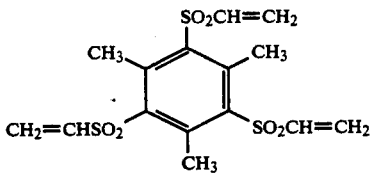

VS-27

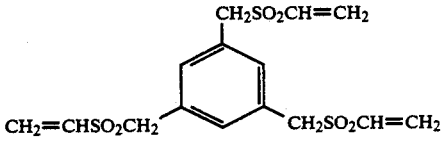

-continued

VS-28

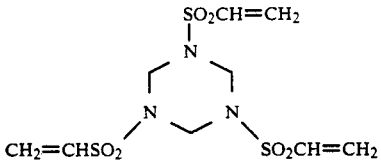

VS-29

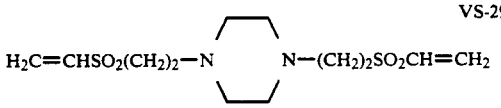

$H_2C{=}CHSO_2(CH_2)_2SO_2(CH_2)_2SO_2CH{=}CH_2$ VS-30

VS-31

$H_2C{=}CHSO_2(CH_2)_2O(CH_2)_2NHONH(CH_2)_2O(CH_2)_2SO_2CH{=}CH_2$

VS-32

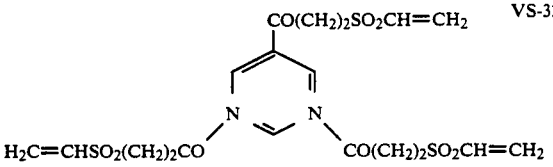

VS-33

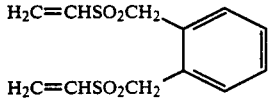

VS-34

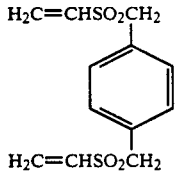

$(H_2C{=}CHSO_2NH)_2CH_2$ VS-35

$H_2C{=}CHSO_2(CH_2)_2NH(CH_2)_2NH(CH_2)_2SO_2CH{=}CH_2$ VS-36

$(H_2C{=}CHSO_2(CH_2)_2CON(CH_3)CH_2)_2CH_2$ VS-37

$Cl(CH_2)_2SO_2CH(C_2H_5)COO(CH_2)_2OCOCH(C_2H_5)SO_2(CH_2)_2Cl$ VS-38

VS-39

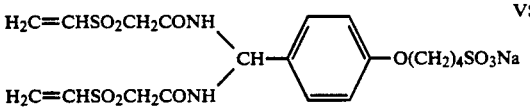

VS-40

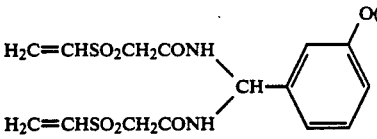

$C_8H_{17}C(CH_2SO_2CH{=}CH_2)_3$ VS-41

VS-42

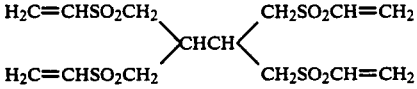

-continued

VS-43

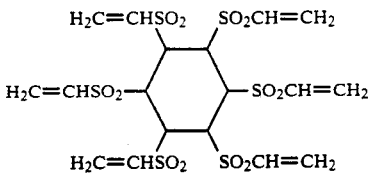

$CH_2(CONHCH_2SO_2CH{=}CH_2)_2$ VS-44

VS-45

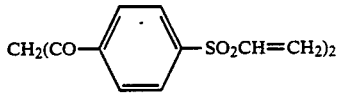

$C[CO(CH_2)_2SO_2CH{=}CH_2]_4$ VS-46

VS-47

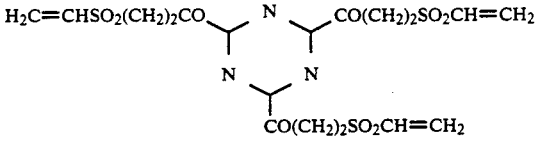

$NH[(CH_2)_2SO_2CH{=}CH_2]_2$ VS-48

$CH_3C(CH_2OCH_2SO_2CH{=}CH_2)_3$ VS-49

$C(CH_2OCH_2SO_2CH{=}CH_2)_4$ VS-50

$N[(CH_2)_2OCH_2SO_2CH{=}CH_2]_3$ VS-51

$(CH_2{=}CHSO_2CH_2)_3CCHSO_2(CH_2)_2Cl$ VS-52

$H_2C{=}CHSO_2CH{=}CH_2$ VS-53

$H_2C{=}CHSO_2CH_2(CH_2SO_2CH_2CH_2OSO_3^{\ominus}Na^{\oplus})_3$ VS-54

$CH_3SO_3(CH_2)_2SO_2(CH_2)_2OSO_2CH_3$ VS-55

VS-56

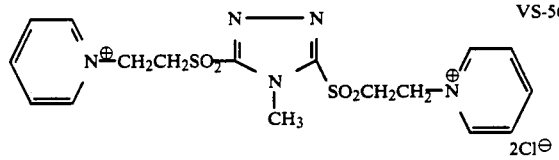

VS-57

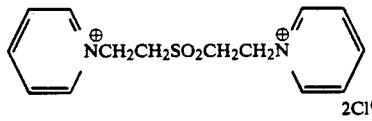

The vinyl sulfone hardeners used for the present invention include the aromatic compounds described in German Patent No. 1,100,942 and U.S. Pat. No. 3,490,911, the alkyl compounds bound via hetero atom described in Japanese Patent Examined Publication Nos. 29622/1969, 25373/1972 and 24259/1972, the sulfonamide ester compounds described in Japanese Patent Examined Publication No. 8736/1972, the 1,3,5-tris[β-(vinylsulfonyl)-propionyl]-hexahydro-S-triazine described in Japanese Patent O.P.I. Publication No. 24435/1974, the alkyl compounds described in Japanese Patent Examined Publication No. 35807/1975 and Japanese Patent O.P.I. Publication No. 44164/1976 and the compounds described in Japanese Patent O.P.I. Publication No. 18944/1984.

These vinyl sulfone hardeners are used in solution in water or in organic solvent at 0.005 to 20% by weight, preferably 0.02 to 10% by weight of the binder such as gelatin.

They are added by the batch method or the in-line addition method.

These hardeners are not subject to limitation with respect to which photographic layer they are added to; for example, they may be added to the uppermost layer, or lowermost layer or all layers.

In the present invention, the silver halide color photographic light-sensitive material preferalby contains at least one of the compounds represented by the following Formulas B-1 through B-3.

Formula B-1

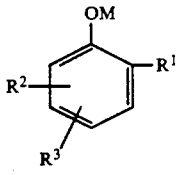

wherein $R^1$ represents an alkyl group, cycloalkyl group, aryl group, hydroxyl group, alkoxycarbonyl group, amino group, carboxylic acid group (including its salt) or sulfonic acid group (including its salt). $R^2$ and $R^3$ independently represent a hydrogen atom, halogen atom, amino group, nitro group, hydroxyl group, alkoxycarbonyl group, carboxylic acid group (including its tips) or sulfonic acid group (including its salt). M represents a hydrogen atom, alkali metal or ammonium group.

Formula B-2

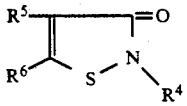

Formula B-3

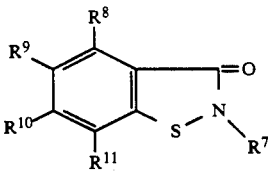

wherein $R^4$ represents a hydrogen atom, halogen atom, alkyl group, aryl group, halogenated alkyl group, $—R^{12}—OR^{13}$, $—CONHR^{14}$ (wherein $R^{12}$ represents an alkylene group; $R^{13}$ and $R^{14}$ independently represent a hydrogen atom, alkyl group or arylalkyl group), or arylalkyl group; $R^5$ and $R^6$ independently represent a hydrogen atom, halogen atom, halogenated alkyl group or alkyl group; $R^7$ represents a hydrogen atom, halogen atom, alkyl group, aryl group, halogenated alkyl group, arylalkyl group, $—R^{15}—OR^{16}$ or $—CONHR^{17}$ (wherein $R^{15}$ represents an alkylene group; $R^{16}$ and $R^{17}$ independently represent a hydrogen atom or alkyl represent), $R^9$, $R^9$, $R^{10}$ and $R^{11}$ independently represent a hydrogen atom, halogen atom, hydroxyl group, alkyl group, amino group or nitro group.

Examples of the compound represented by Formula B-1 are given below.

(B-1-1)

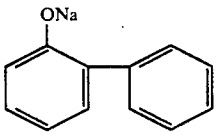

(B-1-2)

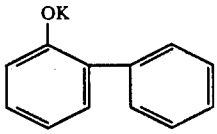

(B-1-3)

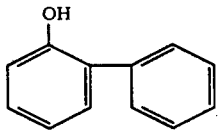

(B-1-4)

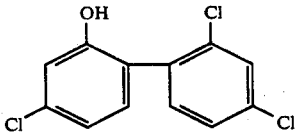

(B-1-5)

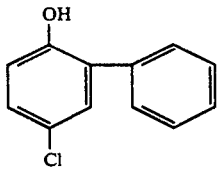

(B-1-6)

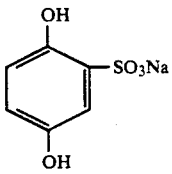

(B-1-7)

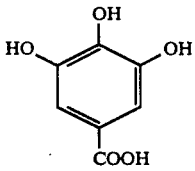

(B-1-8)

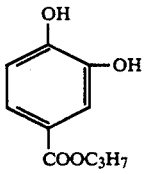

(B-1-9)

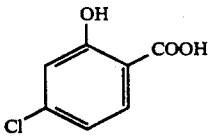

(B-1-10)

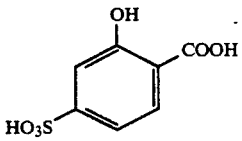

-continued (B-1-11)

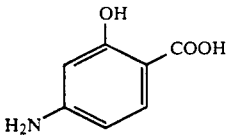

(B-1-12)

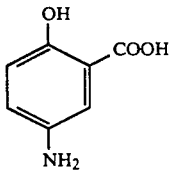

(B-1-13)

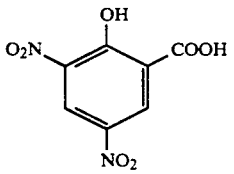

(B-1-14)

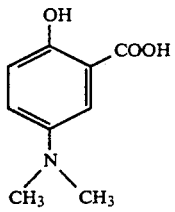

(B-1-15)

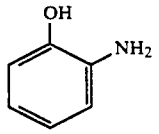

(B-1-16)

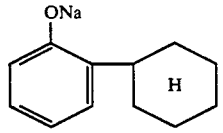

(B-1-17)

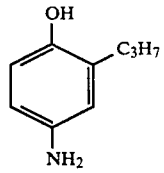

(B-1-18)

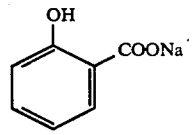

(B-1-19)

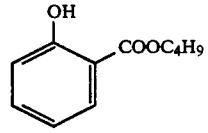

The compound represented by Formula B-1 is commercially available as a preservative for citrus etc., and is easily available by those skilled in the art.

Of the compounds exemplified above, Compound Nos. B-1-1, B-1-2, B-1-3, B-1-4 and B-1-5 are preferable.

The compound of Formula B-1 for the present invention is used preferably at 0.03 to 50 g, more preferably 0.12 to 10 g, and still more preferably 0.15 to 5 g per liter of the stabilizer of the invention.

Examples of the compounds represented by Formulas B-2 and B-3 are given below, but these examples are not to be construed as limitative.

[B-2-1] 2-methyl-4-isothiazolin-3-one
[B-2-2] 5-chloro 2-methyl-4-isothiazolin-3-one
[B-2-3] 2-methyl-5-phenyl-4-isothiazolin-3-one
[B-2-4] 4-bromo-5-chloro-2-methyl-4-isothiazolin-3-one
[B-2-5] 2-hydroxymethyl-4-isothiazolin-3-one
[B-2-6] 2-(2-ethoxyethyl)-4-isothiazolin-3-one
[B-2-7] 2-(N-methyl-carbamoyl)-4-isothiazolin-3-one
[B-2-8] 5-bromomethyl-2-(N-dichlorophenyl-carbamoyl)-4-isothiazolin-3-one
[B-2-9] 5-chloro-2-(2-phenylethyl)-4-isothiazolin-3-one
[B-2-10] 4-methyl-2-(3,4-dichlorophenyl)-4-isothiazolin-3-one
[B-3-1] 1,2-benzisothiazolin-3-one
[B-3-2] 2-(2-bromoethyl)-1,2-benzisothiazolin-3-one
[B-3-3] 2-methyl-1,2-benzisothiazolin-3-one
[B-3-4] 2-ethyl-5-nitro-1,2-benzisothiazolin-3-one
[B-3-5] 2-benzyl-1,2-benzisothiazolin-3-one
[B-3-6] 5-chloro-1,2-benzisothiazolin-3-one With respect to these exemplified compounds, methods of synthesis and example applications to other fields are described in U.S. Pat. Nos. 2,767,172, 2,767,173, 2,767,174 and 2,870,015, British Patent No. 848,130, French Patent No. 1,555,416 and other publications. Some of them are commercially available under trade names Topcide 300 and Topcide 600 (both produced by Permachem Asia), Finecide J-700 (produced by Tokyo Fine Chemical) and Proxel GXL (produced by I.C.I.).

These compounds represented by Formulas B-1 through B-3 are used at 0.1 to 500 mg, preferably 0.5 to 100 mg per $m^2$ of light-sensitive material, and may be used in combination of two or more kinds.

The present invention is applicable to any combination of two kinds of light-sensitive materials such as color paper, color negative film, color positive film, color reversal film for slide, color reversal film for movie, color reversal film for TV and reversal color paper, as long as they are processable by so-called internal development, in which couplers are contained in the light-sensitive materials, but it is most preferable to use color paper as the light-sensitive material B and color negative film as the light-sensitive material A.

The present invention can provide a silver halide color photographic light-sensitive material processing method which permits us to process light-sensitive materials with different amounts of silver coated with the same tank or the same replenisher, which suppresses the occurrence of sludge and scum in the stabilizing tank, which prevents yellow stain and magenta dye fading during storage of color negative film after color processing and which permits us to suppress cyan dye darkening and fading during storage of color paper after color processing.

EXAMPLES

The present invention is hereinafter described in more detail by means of the following examples, but the invention is not limited by these examples.

EXAMPLE 1

Preparation of color paper samples

Layers with the following compositions were formed on a paper support laminated with polyethylene on one face and titanium oxide-containing polyethylene on the first layer side of the other face to yield a multiple layer silver halide color photographic light-sensitive material. The coating solutions were prepared as follows:

First layer coating solution 26.7 g of a yellow coupler Y-1, 10.0 g of a dye image stabilizer ST-1, 6.67 g of another dye image stabilizer ST-2 and 0.67 g of an additive HQ-1 were dissolved in 60 ml of ethyl acetate containing 6.5 g of a high boiling organic solvent DNP. This solution was emulsified and dispersed in 220 ml of a 10% aqueous solution of gelatin containing 7 ml of 20% surfactant SU-1 using an ultrasonic homogenizer to yield a yellow coupler dispersion. This dispersion was mixed with a blue-sensitive silver halide emulsion containing 10 g of silver prepared as follows to yield a first layer coating solution.

Second through seventh coating solutions were prepared in the same manner as with the first layer coating solution.

A hardener H-1, to layers 2 and 4, and another hardener H-2, to layer 7, were added. As coating aids, surfactants SU-2 and SU-3 were added to adjust the surface tension.

| Layer | Composition | Amount of addition ($g/m^2$) |
|---|---|---|
| Layer 7 Protective layer | Gelatin | 0.9 |
| | Antifungal agent F-1 | 0.002 |
| Layer 6 Ultraviolet absorbing layer | Gelatin | 0.35 |
| | UV absorbent UV-1 | 0.10 |
| | UV absorbent UV-2 | 0.04 |
| | UV absorbent UV-3 | 0.16 |
| | Antistaining agent HQ-1 | 0.01 |
| | DNP | 0.2 |
| | PVP | 0.03 |
| | Anti-irradiation dye AI-2 | 0.02 |
| Layer 5 Red-sensitive layer | Gelatin | 1.20 |
| | Red-sensitive silver chlorobromide emulsion Em-R (as silver) | 0.18 |
| | Cyan coupler C-1 | 0.19 |
| | Cyan coupler C-2 | 0.23 |
| | Dye image stabilizer ST-1 | 0.20 |
| | Antistaining agent HQ-1 | 0.01 |
| | HBS-1 | 0.20 |
| | DOP | 0.25 |
| Layer 4 Ultraviolet absorbing layer | Gelatin | 1.0 |
| | UV absorbent UV-1 | 0.28 |
| | UV absorbent UV-2 | 0.09 |
| | UV absorbent UV-3 | 0.38 |
| | Antistaining agent HQ-1 | 0.03 |
| | DNP | 0.35 |
| Layer 3 Green-sensitive layer | Gelatin | 1.30 |
| | Green-sensitive silver chlorobromide emulsion Em-G (as silver) | 0.15 |
| | Magenta coupler M-1 | 0.19 |
| | Magenta coupler M-2 | 0.20 |
| | Dye image stabilizer ST-3 | 0.15 |
| | Dye image stabilizer ST-4 | 0.20 |
| | Dye image stabilizer ST-5 | 0.15 |
| | DNP | 0.20 |
| | Anti-irradiation dye AI-1 | 0.01 |
| Layer 2 Interlayer | Gelatin | 1.20 |
| | Antistaining agent HQ-1 | 0.12 |
| | DIDP | 0.15 |
| | Antifungal agent F-1 | 0.002 |
| Layer 1 Blue-sensitive layer | Gelatin | 1.20 |
| | Blue-sensitive silver chlorobromide emulsion Em-B (as silver) | 0.25 |
| | Yellow coupler Y-1 | 0.80 |
| | Dye image stabilizer ST-1 | 0.30 |
| | Dye image stabilizer ST-2 | 0.20 |
| | Antistaining agent HQ-1 | 0.02 |
| | Anti-irradiation dye AI-3 | 0.01 |
| | DNP | 0.19 |
| Support | Polyethylene-laminated paper | |

Y-1

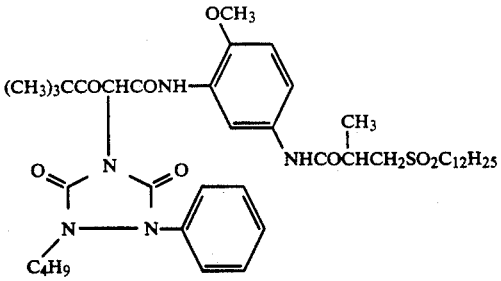

M-1

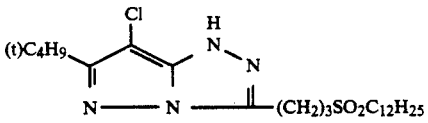

M-2

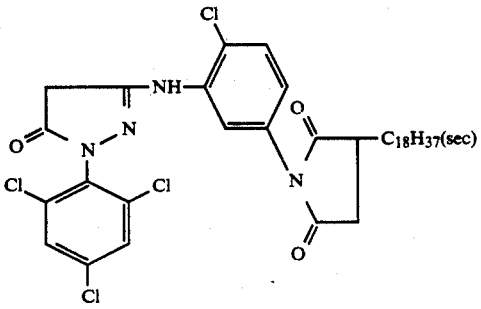

C-1

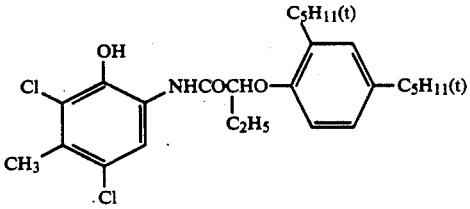

-continued
C-2
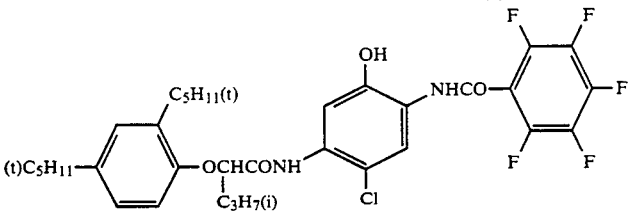
DOP: Dioctyl phthalate DNP: Dinonyl phthalate
DIDP: Diisodecyl phthalate PVP: Polyvinylpyrrolidone
HQ-1
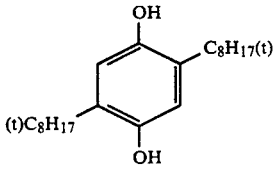
HQ-2
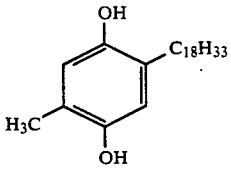
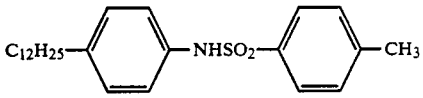
HBS-1
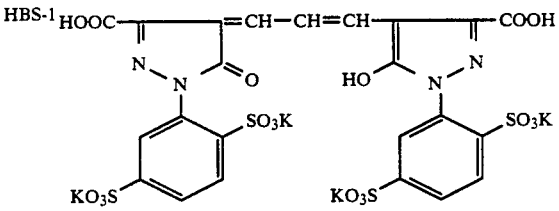
AI-1
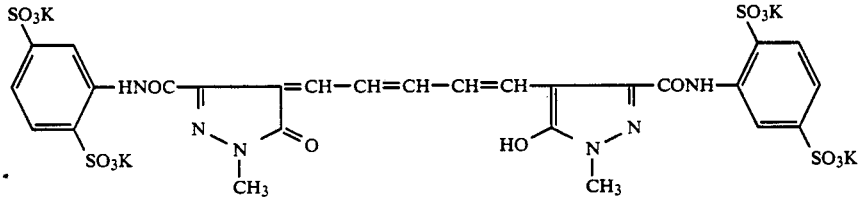
AI-2
AI-3
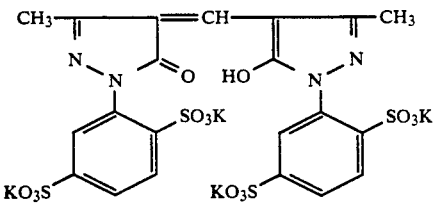
ST-1
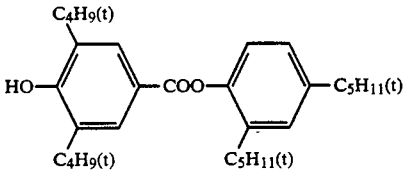
ST-2
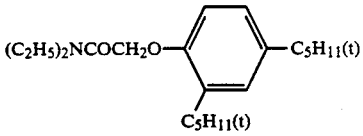
ST-3
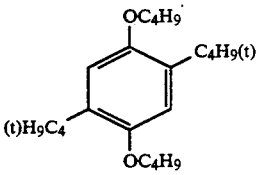
ST-4
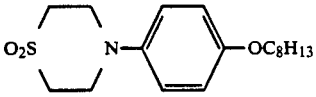
ST-5
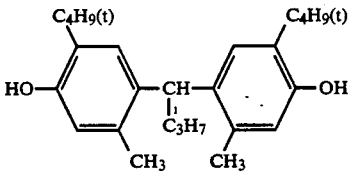
UV-1
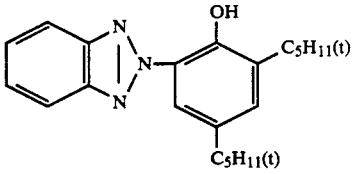
UV-2
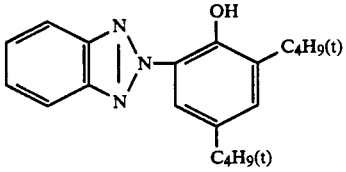

-continued

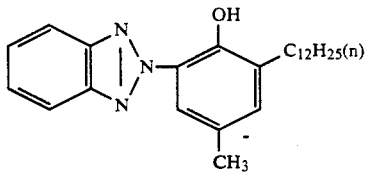

UV-3

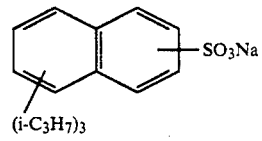

SU-1

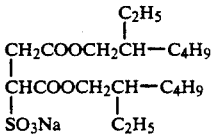

SU-2

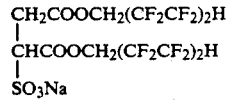

SU-3

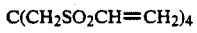

H-1

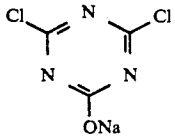

H-2

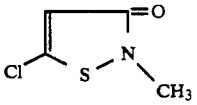

F-1

Preparation of blue-sensitive silver halide emulsion

To 1000 ml of a 2% aqueous solution of gelatin maintained at 40° C., the following solutions A and B were simultaneously added over a period of 30 minutes while maintaining a pAg of 6.5 and a pH of 3.0, after which the following solutions C and D were simultaneously added over a period of 180 minutes while maintaining a pAg of 7.3 and a pH of 5.5.

pAg was regulated by the method described in Japanese Patent O.P.I. Publication No. 45437/1984, and pH was regulated using an aqueous solution of sulfuric acid or sodium hydroxide.

| | |
|---|---|
| Solution A | |
| Sodium chloride | 3.42 g |
| Potassium bromide | 0.03 g |
| Water was added to make a total quantity of 200 ml. | |
| Solution B | |
| Silver nitrate | 10 g |
| Water was added to make a total quantity of 200 ml. | |
| Solution C | |
| Sodium chloride | 102.7 g |
| Potassium bromide | 1.0 g |
| Water was added to make a total quantity of 600 ml. | |
| Solution D | |
| Silver nitrate | 300 g |

Water was added to make a total quantity of 600 ml.

After completion of the addition, the mixture desalted with a 5% aqueous solution of Demol N, a product of Kao Atlas, and a 20% aqueous solution of magnesium sulfate and then mixed with an aqueous solution of gelatin to yield a monodispersed emulsion EMP-1 comprising cubic grains having an average grain size of 0.85 μm, a coefficient of variation (δ/r) of 0.07 and a silver chloride content of 99.5 mol %.

The emulsion EMP-1 was chemically ripened with the following compounds at 50° C. for 90 minutes to yield a blue-sensitive silver halide emulsion Em-B.

| | |
|---|---|
| Sodium thiosulfate | 0.8 mg/mol AgX |
| Chloroauric acid | 0.5 mg/mol AgX |
| Stabilizer STAB-5 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of green-sensitive silver halide emulsion

A monodispersed emulsion EMP-2 comprising cubic grains having an average grain size of 0.43 μm, a coefficient of variation (δ/r) of 0.08 and a silver chloride content of 99.5 mol % was prepared in the same manner as with EMP-1 except that the addition time for Solutions A and B and the addition time for Solutions C and D were changed.

The emulsion EMP-2 was chemically ripened with the following compounds at 55° C. for 120 minutes to yield a green-sensitive silver halide emulsion Em-G.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of red-sensitive silver halide emulsion

A monodispersed emulsion EMP-3 comprising cubic grains having an average grain size of 0.50 μm, a coefficient of variation (δ/r) of 0.08 and a silver chloride content of 99.5 mol % was prepared in the same manner as with EMP-1 except that the addition time for Solutions A and B and the addition time for Solutions C and D were changed.

The emulsion EMP-3 was chemically ripened with the following compounds at 60° C. for 90 minutes to yield a red-sensitive silver halide emulsion Em-R.

| | |
|---|---|
| Sodium thiosulfate | 1.8 mg/mol AgX |
| Chloroauric acid | 2.0 mg/mol AgX |

-continued

| | |
|---|---|
| Stabilizer STAB-1 | $6 \times 10^{-4}$ mol/mol AgX |
| Sensitizing dye RS-1 | $1 \times 10^{-4}$ mol/mol AgX |

BS-1

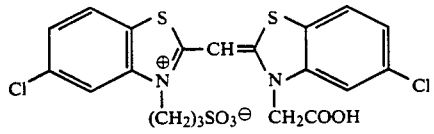

-continued

| | |
|---|---|
| DIR compound D-2 | 0.01 |
| High boiling solvent Oil-1 | 0.5 |
| Gelatin | 1.0 |

Layer 4: High speed red-sensitive emulsion layer RH

BS-2

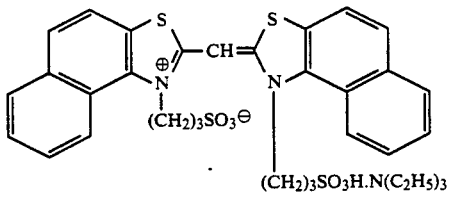

GS-1

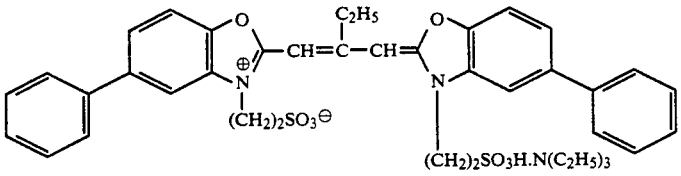

RS-1

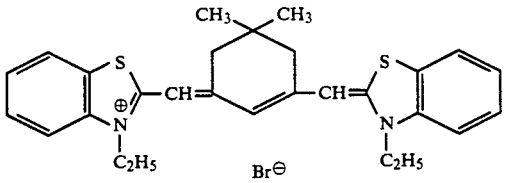

STAB-1

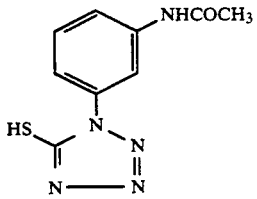

The color paper sample thus prepared had a total amount of silver coated of 0.58 g/m$^2$. Experimental color paper samples were prepared with the total amount of silver coated varied as shown in Table 1 and tested.

Preparation of color negative film sample

In all examples given below, the amount of addition in silver halide photographic light-sensitive material is expressed in gram per m$^2$, unless otherwise stated. The figures for silver halide and colloidal silver have been converted to the amounts of silver. Figures for the amount of sensitizing dyes are shown in mol per mol of silver.

The following layers with the compositions shown below were sequentially formed on a triacetyl cellulose film support in the order from the support side to yield a multiple layered color photographic light-sensitive material sample No. 1.

| | |
|---|---|
| **Layer 1: Anti-halation layer HC** | |
| Black colloidal silver | 0.11 |
| UV absorbent UV-1 | 0.18 |
| Colored cyan coupler CC-1 | 0.02 |
| High boiling solvent Oil-1 | 0.18 |
| High boiling solvent Oil-2 | 0.20 |
| Gelatin | 1.5 |
| **Layer 2: Interlayer IL-1** | |
| Gelatin | 1.2 |
| **Layer 3: Low speed red-sensitive emulsion layer RL** | |
| Silver iodobromide emulsion having a silver iodide content of 3 mol % | 0.75 |
| Sensitizing dye S-1 | $3.2 \times 10^{-4}$ mol/mol silver |
| Sensitizing dye S-2 | $3.2 \times 10^{-4}$ mol/mol silver |
| Sensitizing dye S-3 | $0.2 \times 10^{-4}$ mol/mol silver |
| Cyan coupler C-1 | 0.45 |
| Cyan coupler C-2 | 0.15 |
| Colored cyan coupler CC-1 | 0.07 |
| DIR compound D-1 | 0.001 |
| Silver iodobromide emulsion having a silver iodide content of 7 mol % | 0.75 |
| Sensitizing dye S-1 | $1.5 \times 10^{-4}$ mol/mol silver |
| Sensitizing dye S-2 | $1.6 \times 10^{-4}$ mol/mol silver |
| Sensitizing dye S-3 | $0.1 \times 10^{-4}$ mol/mol silver |
| Cyan coupler C-2 | 0.22 |
| Colored cyan coupler CC-1 | 0.03 |
| DIR compound D-2 | 0.02 |
| High boiling solvent Oil-1 | 0.24 |
| Gelatin | 1.0 |
| **Layer 5: Interlayer IL-2** | |
| Gelatin | 1.0 |
| **Layer 6: Low speed green-sensitive emulsion layer GL** | |
| Silver iodobromide emulsion having a silver iodide content of 4 mol % | 0.9 |
| Sensitizing dye S-4 | $7.0 \times 10^{-4}$ mol/mol silver |
| Sensitizing dye S-5 | $0.8 \times 10^{-4}$ mol/mol silver |
| Magenta coupler M-1 | 0.17 |
| Magenta coupler M-2 | 0.43 |
| Colored magenta coupler CM-1 | 0.10 |
| DIR compound D-3 | 0.02 |
| High boiling solvent Oil-2 | 0.58 |
| Gelatin | 1.1 |
| **Layer 7: High speed green-sensitive emulsion layer GH** | |
| Silver iodobromide emulsion having a silver iodide content of 8 mol % | 0.8 |
| Sensitizing dye S-6 | $1.1 \times 10^{-4}$ mol/mol silver |
| Sensitizing dye S-7 | $2.0 \times 10^{-4}$ mol/mol silver |
| Sensitizing dye S-8 | $0.3 \times 10^{-4}$ mol/mol silver |
| Magenta coupler M-1 | 0.03 |
| Magenta coupler M-2 | 0.13 |
| Colored magenta coupler CM-1 | 0.04 |
| DIR compound D-3 | 0.006 |
| High boiling solvent Oil-2 | 0.35 |
| Gelatin | 0.9 |
| **Layer 8: Yellow filter layer YC** | |
| Yellow colloidal silver | 0.1 |
| Additive HS-1 | 0.07 |
| Additive HS-2 | 0.07 |
| Additive SC-2 | 0.12 |
| High boiling solvent Oil-2 | 0.15 |
| Gelatin | 1.0 |
| **Layer 9 Low speed blue-sensitive emulsion layer BL** | |
| Silver iodobromide emulsion having | 0.5 |

-continued

| | |
|---|---|
| a silver iodide content of 6 mol % | |
| Sensitizing dye S-9 | $5.8 \times 10^{-4}$ mol/mol silver |
| Yellow coupler Y-1 | 0.58 |
| Yellow coupler Y-2 | 0.34 |
| DIR compound D-1 | 0.003 |
| DIR compound D-2 | 0.006 |
| High boiling solvent Oil-2 | 0.18 |
| Gelatin | 1.2 |
| Layer 10: High speed blue-sensitive emulsion layer BH | |
| Silver iodobromide emulsion having a silver iodide content of 12 mol % | 0.5 |
| Sensitizing dye S-10 | $3.0 \times 10^{-4}$ mol/mol silver |
| Sensitizing dye S-11 | $1.2 \times 10^{-4}$ mol/mol silver |
| Yellow coupler Y-1 | 0.18 |
| Yellow coupler Y-2 | 0.10 |
| High boiling solvent Oil-2 | 0.05 |
| Gelatin | 1.0 |
| Layer 11: First protective layer PRO-1 | |
| Silver iodobromide emulsion (fine grains) | 0.3 |
| UV absorbent UV-1 | 0.07 |
| UV absorbent UV-2 | 0.1 |
| Additive HS-1 | 0.2 |
| Additive HS-2 | 0.1 |
| High boiling solvent Oil-1 | 0.07 |
| High boiling solvent Oil-3 | 0.07 |

-continued

| | |
|---|---|
| Gelatin | 0.8 |
| Layer 12: Second protective layer PRO-2 | |
| Alkali-soluble matting agent (average grain size 2 μm) | 0.13 |
| Polymethyl methacrylate (average grain size 3 μm) | 0.02 |
| Gelatin | 0.5 |

In addition to these compositions, a coating aid SU-2, a dispersing agent SU-1, hardeners H-1 and H-2 and dyes AI-1 and AI-2 were added to appropriate layers.

The emulsions used to prepare the sample described above are shown in Table 1, all of which are monodispersed emulsions.

The total amount of silver coated (total for all emulsion layers) of the color negative film sample thus prepared was 4.5 g/m$^2$.

Experimental samples were prepared with the total amount of silver coated varied so that the percent amount of silver coated on each emulsion layer became the same as with each layer of the color negative film sample wherein the total amount of silver coated is 4.50 g/m$^2$.

C-1

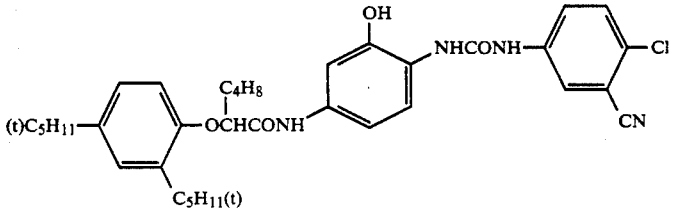

C-2

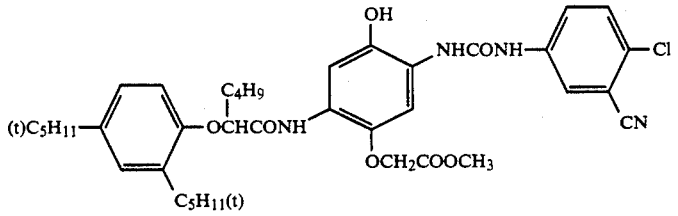

M-1

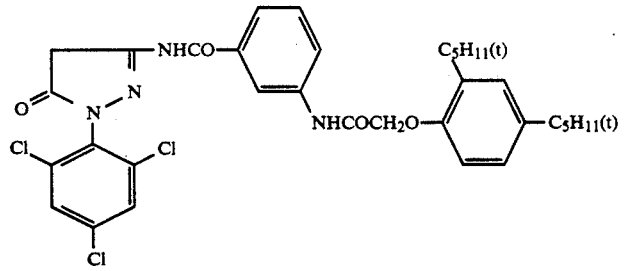

M-2

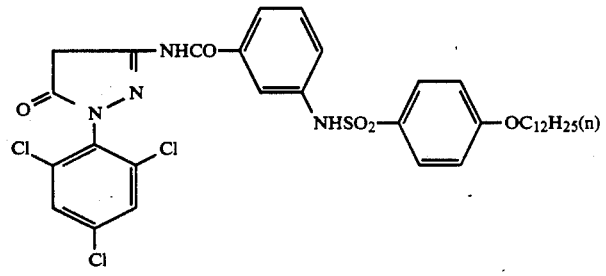

-continued
Y-1
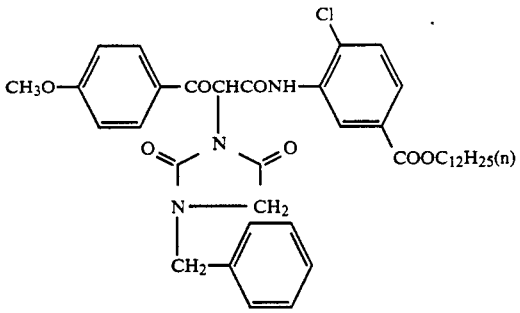
Y-2
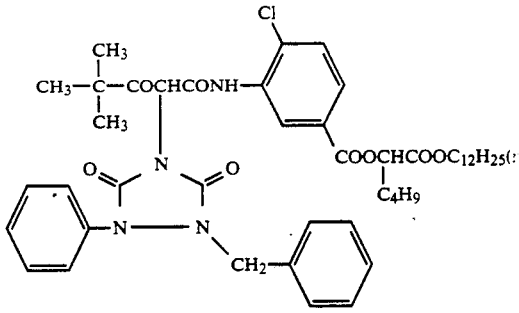
CC-1
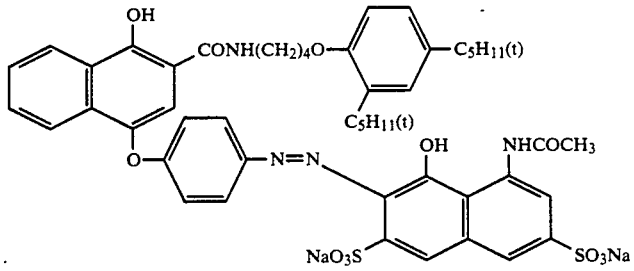
CM-1
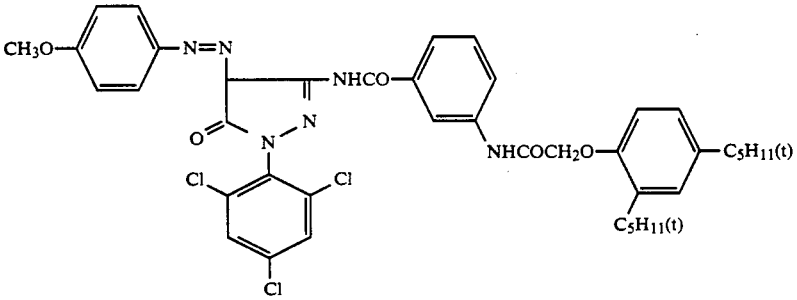
D-1
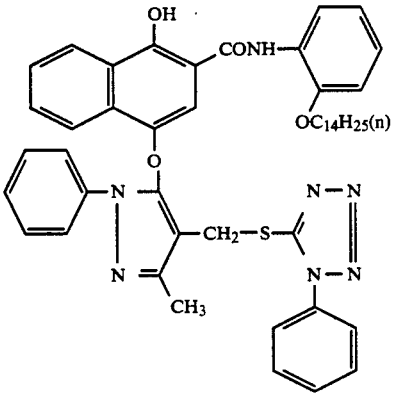
D-2
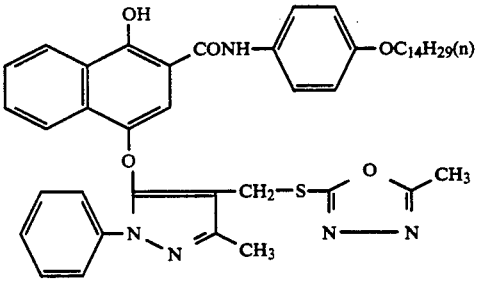

-continued
D-3
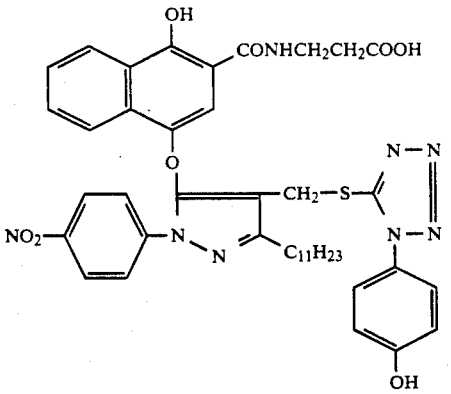
UV-1
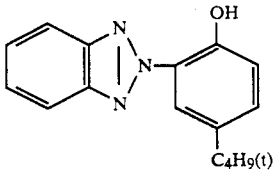
UV-2
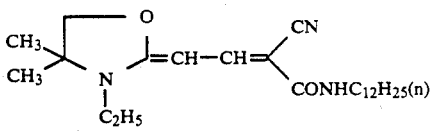
S-1
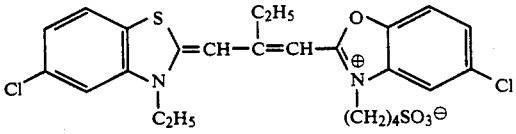
S-2
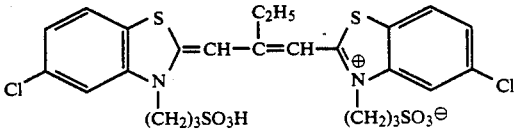
S-3
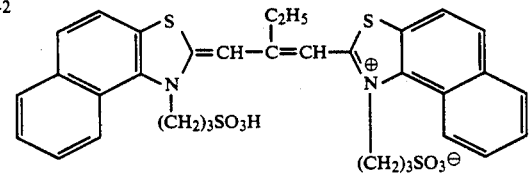
S-4
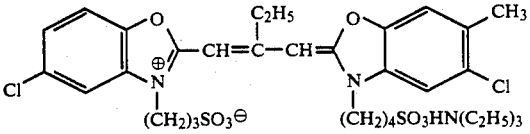
S-5
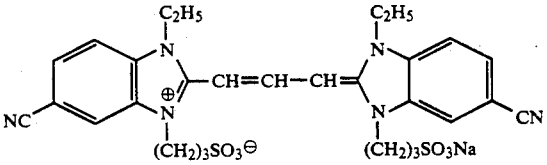
S-6
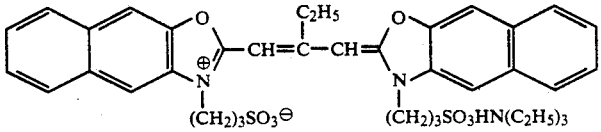
S-7
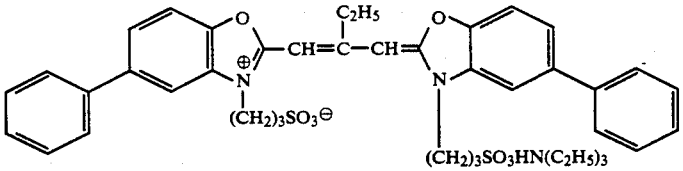
S-8
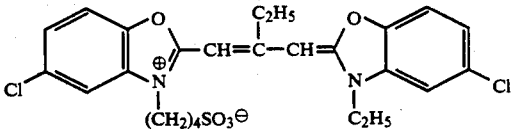
S-9
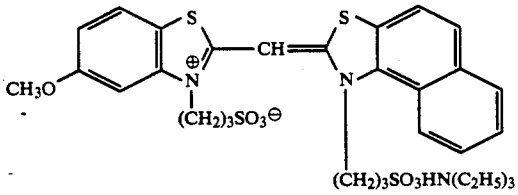
S-10
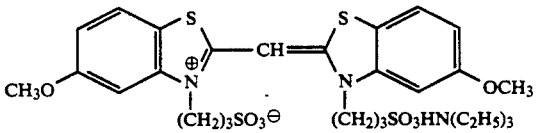

-continued
S-11
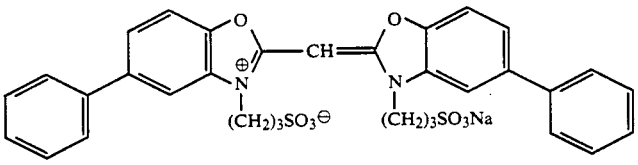
HS-1
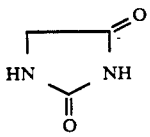
HS-2
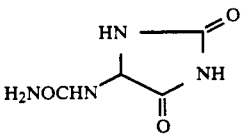
H-1
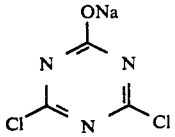
H-2
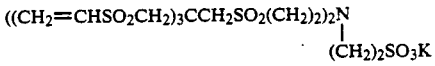
SU-1
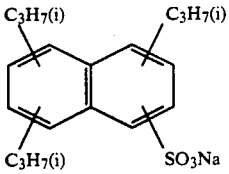
(Alkanol XC)
SU-2
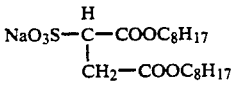
SC-1
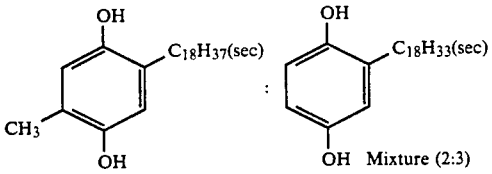
Mixture (2:3)
Oil-1
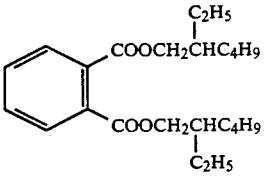
Oil-2
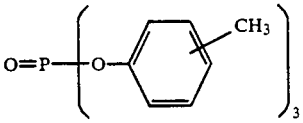
Oil-3
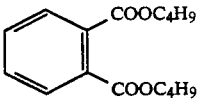
AI-1
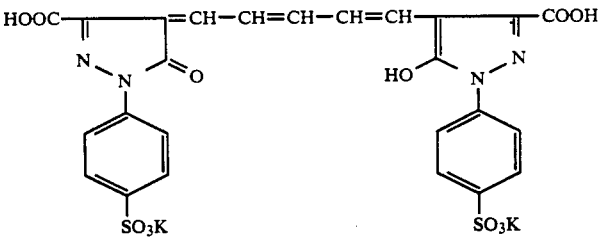
AI-2
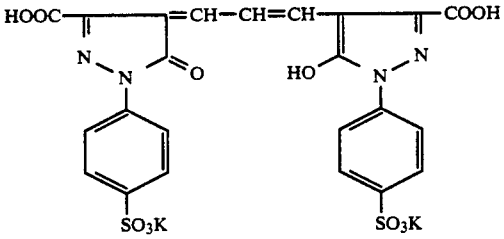
The color paper samples thus obtained were subjected to exposure in accordance with a conventional method and then to running processing using the following procedures.

| | | | |
|---|---|---|---|
| (1) Color developing | 38° C. | 20 seconds | 80 |
| (2) Bleaching | 38° C. | 20 seconds | 40 |
| (3) Fixation | 38° C. | 20 seconds | 40 |
| (4) Stabilization* | 30° C. | 20 seconds for the first tank, 20 seconds for the second tank, 20 seconds for the third tank | 120 |
| (5) Drying | 60–80° C. | 30 seconds | |

*The first through third stabilizing tanks are based on the counter current method, with the replenisher supplied to the third tank.

The color negative film samples thus obtained were subjected to exposure in accordance with a conventional method and then processed using the following procedures and processing solutions. The bleacher, fixer and stabilizer were supplied from the same tanks as with color paper.

| Color negative film processing | | | |
|---|---|---|---|
| Procedure | Processing time | Processing temperature | Amount of replenisher |
| Color developing | 1 minute 30 seconds | 38° C. | 540 ml |
| Bleaching | 45 seconds | 38° C. | 155 ml |
| Fixation | 1 minute 30 seconds | 38° C. | 300 ml |
| Stabilization | 90 seconds | 38° C. | 775 ml |
| Drying | 30 seconds | 40–70° C. | — |

Note: Figures for the amount of replenisher are per $m^2$ of light-sensitive material.

Stabilization was conducted by the counter current method using three tanks, in which the replenisher was supplied to the final tank of stabilizer and the overflow was allowed to enter in the preceding tank.

| Color developer tank solution for color paper | |
|---|---|
| Triethanolamine | 10 g |
| Diethylene glycol | 5 g |
| N,N-diethylhydroxylamine | 3.0 g |
| Potassium bromide | 20 mg |
| Potassium chloride | 2.2 g |
| Diethylenetriaminepentaacetic acid | 5 g |
| Potassium sulfite | 0.2 g |
| Color developing agent 3-methyl-4-amino-N-ethyl-N-(β-methanesulfonamidoethyl)-aniline sulfate | 8.0 g |
| Potassium carbonate | 25 g |
| Potassium hydrogen carbonate | 5 g |

Water was added to make a total quantity of 1 l, and potassium hydroxide or sulfuric acid was added to obtain a pH of 10.10.

| Color developer replenisher for color paper | |
|---|---|
| Triethanolamine | 14.0 g |
| Diethylene glycol | 8.0 g |
| N,N-diethylhydroxylamine | 4.0 g |
| Potassium bromide | 8 mg |
| Diethylenediaminepentaacetic acid | 7.5 g |
| Potassium sulfite | 0.3 g |
| Color developing agent 3-methyl-4-amino-N-ethyl-N-(β-methanesulfonamidoethyl)-aniline sulfate | 12 g |
| Potassium carbonate | 30 g |
| Potassium hydrogen carbonate | 1 g |

Water was added to make a total quantity of 1, and potassium hydroxide or sulfuric acid was added to obtain a pH of 10.80.

| Color developer tank solution for color negative film | |
|---|---|
| Diethylenetriaminepentaacetic acid | 1.0 g |
| Potassium sulfite | 4.0 g |
| Potassium bromide | 1.3 g |
| Hydroxylamine sulfate | 2.4 g |
| Color developing agent 4-(N-ethyl-N-β-hydroxyethylamino)-2-methylaniline sulfate | 4.2 g |
| Potassium iodide | 2.3 mg |
| Potassium carbonate | 30 g |

Water was added to make a total quantity of 1, and potassium hydroxide or sulfuric acid was added to obtain a pH of 10.01.

| Color developer replenisher for color negative film | |
|---|---|
| Diethylenetriaminepentaacetic acid | 1.2 g |
| Potassium sulfite | 4.8 g |
| Hydroxylamine sulfate | 3.0 g |
| Color developing agent 4-(N-ethyl-N-β-hydroxyethylamino)-2-methylaniline sulfate | 6.1 g |
| Potassium carbonate | 30 g |
| Potassium bromide | 0.5 g |

Water was added to make a total quantity of 1 l, and potassium hydroxide or sulfuric acid was added to obtain a pH of 10.07.

The bleacher used had the following composition.

| | |
|---|---|
| Ferric ammonium 1,3-diaminopropanetetraacetate | 0.35 mol |
| Disodium ethylenediaminetetraacetate | 2 g |
| Ammonium bromide | 150 g |
| Glacial acetic acid | 40 ml |
| Ammonium sulfate | 40 g |

Water was added to make a total quantity of 1 l, and aqueous ammonia or glacial acetic acid was added to obtain a pH of 4.5.

The bleach-fixer used had the following composition.

| | |
|---|---|
| Ferric ammonium 1,3-diaminopropanetetraacetate | 0.40 mol |
| Disodium ethylenediaminetetraacetate | 2 g |
| Ammonium bromide | 170 g |
| Ammonium nitrate | 50 g |
| Glacial acetic acid | 61 ml |

Water was added to make a total quantity of 1 l, and aqueous ammonia or glacial acetic acid was added to obtain a pH of 3.5.

The fixer and fixer replenisher used had the following composition.

| | |
|---|---|
| Sodium thiosulfate | 50 g |
| Potassium thiocyanate | 2.0 mol |
| Anhydrous potassium bisulfite | 20 g |
| Sodium metabisulfite | 4.0 g |
| Disodium ethylenediaminetetraacetate | 1 g |

Water was added to make a total quantity of 1 l, and aqueous ammonia or glacial acetic acid was added to obtain a pH of 6.5.

The stabilizer and stabilizer replenisher used had the following composition.

| | |
|---|---|
| 1,2-benzisothiazolin-3-one | 0.1 g |

-continued

| | |
|---|---|
| 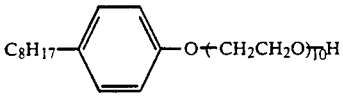 | 2.0 ml |
| Siloxane (I-76, produced by UCC) | 0.1 g |
| Formaldehyde (37% w/w) or a compound of the invention | |
| Amount shown in Table 1 | |

Water was added to make a total quantity of 1 l, and the pH was adjusted to 8.5.

The automatic developing machine used is configured to include the procedures shown in FIG. 1, specifically a procedure A for color negative films and another procedure B for color paper, equipped with a stabilizing tank of the three-tank cascade type.

In FIG. 1, the symbols denote the following: 1*a* for a color developing tank for color negative films, 1*b* for a color developer tank for color paper, 2 for a bleacher tank, 3 for a fixer tank, 4 for a first stabilizing tank, 5 for a second stabilizing tank and 6 for a third stabilizing tank, and 7 through 11 for constant discharge pumps for replenisher.

Other color paper and color negative film samples were prepared in the same manner as above except that the formaldehyde contained in the stabilizer and stabilizer replenisher described above was replaced with a compound listed in Table 1, and subjected to running processing.

Running processing was conducted by filling the automatic developing machine with the color developer tank solutions for color paper and color negative films and with a bleacher tank solution, a fixer tank solution and a stabilizer tank solution, and processing the color paper and color negative film samples while supplying the color developer replenisher, bleach-fixer replenisher and stabilizer replenisher using constant discharge pumps.

Running processing was conducted discontinuously until the total amount of the stabilizer replenisher added became 3 times the capacity of the color developer tank.

The processing ratio of color paper and color negative film was 1 of color paper to 7 of color negative film by area. After completion of running processing, the first stabilizer tank was examined for scum. Also, the magenta density in the unexposed portion of the processed color paper sample was determined after completion of running processing.

The results are given in Table 1.

TABLE 1

| | Amount of silver coated ($g/m^2$) | | Occurrence of scum in the first stabilizer tank | | | Green color density in the unexposed portion of color paper | | |
|---|---|---|---|---|---|---|---|---|
| Experiment number | Color paper $g/m^2$ | Color negative film $g/m^2$ | Not added | Formaldehyde (37%) 2.5 g/l | Exemplified Compound A-1-1 0.3 g/l | Not added | Formaldehyde (37%) 2.5 g/l | Exemplified Compound A-1-1 0.3 g/l |
| (1) | 0.2 | 4.5 | b | b–c | a | 0.08 | 0.05 | 0.03 |
| (2) | 0.3 | 4.5 | b | c | a | 0.08 | 0.06 | 0.04 |
| (3) | 0.4 | 4.5 | b–c | cc | a | 0.09 | 0.06 | 0.04 |
| (4) | 0.5 | 4.5 | b–c | ccc | a | 0.10 | 0.07 | 0.04 |
| (5) | 0.7 | 4.5 | b–c | ccc | a | 0.11 | 0.07 | 0.04 |
| (6) | 0.9 | 4.5 | c | ccc | a | 0.13 | 0.07 | 0.04 |
| (7) | 1.0 | 4.5 | c | ccc | a | 0.15 | 0.09 | 0.04 |
| (8) | 1.2 | 4.5 | c | ccc | b | 0.15 | 0.15 | 0.09 |
| (9) | 1.5 | 4.5 | cc | ccc | b–c | 0.20 | 0.20 | 0.13 |
| (10) | 0.58 | 1.0 | b | c | b | 0.07 | 0.06 | 0.04 |
| (11) | 0.58 | 1.5 | b | cc | b–c | 0.07 | 0.06 | 0.04 |
| (12) | 0.58 | 2.0 | b | ccc | a | 0.09 | 0.07 | 0.04 |
| (13) | 0.58 | 3.0 | b–c | ccc | a | 0.10 | 0.07 | 0.04 |
| (14) | 0.58 | 4.0 | b–c | ccc | a | 0.10 | 0.07 | 0.04 |
| (15) | 0.58 | 5.0 | b–c | ccc | a | 0.13 | 0.08 | 0.04 |
| (16) | 0.58 | 7.0 | c | ccc | a | 0.15 | 0.10 | 0.04 |
| (17) | 0.58 | 9.0 | c | ccc | a | 0.18 | 0.12 | 0.04 |
| (18) | 0.58 | 10.0 | cc | ccc | a | 0.20 | 0.12 | 0.05 |
| (19) | 0.58 | 12.0 | cc | cccc | c | 0.25 | 0.15 | 0.14 |
| (20) | 0.58 | 15.0 | ccc | cccc | cc | 0.28 | 0.20 | 0.19 |

In Table 1, the symbol a means no scum, b means slight scum, c means distinct scum, and c indicates the degree of occurrence of scum, i.e., the degree of occurrence of scum increases as the number of c increases.

From Table 1, it is evident that when two light-sensitive materials which meet the requirements of the invention are used in combination, the degree of occurrence of scum and the degree of stain in the unexposed portion of paper are higher in the case of a formalin-containing stabilizer or a stabilizer containing neither formalin nor the compound of the invention, while the use of a stabilizer supplemented with the compound of the invention does not cause scum or increase in the density in the unexposed portion of color paper.

EXAMPLE 2

Running processing was conducted in the same manner as in Example 1 except that the concentration of a compound of the present invention A-1-1 in the stabilizer was changed as shown in Table 2. The density of the green color transmitted through the color negative film at a density of nearly 1.0 and the density of the blue color transmitted through the unexposed portion were determined, and the difference in density was calculated between the values obtained before and after storage at 60° C., 80% RH for 3 weeks ($\Delta G_{1.0}$, $\Delta Rmax$). The first stabilizer tank was examined for scum.

The results are given in Table 2.

EXAMPLE 3

Color paper and color negative film samples having an amount of silver coated of 0.58 and 4.5 g per $m^2$ were prepared as directed in Example 1 and processed in the same manner as in Example 1 except that the formaldehyde in the stabilizer was replaced with a compound listed in Table 2. After completion of processing, the samples were evaluated in the same manner as in Example 1. The color negative film and color paper samples were stored at 60° C., 80% RH for 3 weeks, and the transmission density of the green color of the color negative film at a density of nearly 1.0 and the red reflection density of the maximum density portion of the color paper were determined before and after storage.

The results are given in Table 2.

TABLE 2

| Compound | Occurrence of scum | Green density | $\Delta G_{1.0}$ | ΔRmax | Remark |
|---|---|---|---|---|---|
| Not added | b–c | 0.08 | −0.32 | −0.09 | Comparative |
| Formaldehyde (37%) 2.5 g/l | ccc | 0.07 | +0.03 | −0.32 | Comparative |
| A-1-1 | a | 0.04 | 0 | −0.05 | Inventive |
| F-1-1 | a | 0.04 | +0.01 | −0.06 | Inventive |
| F-2-1 | a | 0.04 | 0 | −0.05 | Inventive |
| F-5-1 | a | 0.04 | +0.02 | −0.06 | Inventive |
| F-5-3 | a | 0.04 | −0.01 | −0.05 | Inventive |
| F-8-1 | a | 0.04 | −0.01 | −0.07 | Inventive |
| F-9-6 | a | 0.04 | 0 | −0.06 | Inventive |
| F-10-4 | a | 0.04 | +0.01 | −0.05 | Inventive |
| F-10-7 | a | 0.04 | +0.01 | −0.06 | Inventive |

From the results given in Table 2, it is evident that when using a stabilizer containing a compound of the present invention to process a color paper and color negative film, neither scum in the stabilizer nor magenta stain in the color paper does not occur and there is little variation in the density after storage of the color negative film and color paper.

F-1-10, F-3-1, F-3-4, F-4-1, F-6-1, F-7-1, F-7-15, F-10-13 and F-10-17 were also found to have an effect similar to that obtained with the exemplified compounds of the invention.

EXAMPLE 4

Experiments were made in the same manner as in Example with the silver halide composition of the color paper used in Example 3 was changed for all layers (emulsion layers) as shown in Table 3, and the occurrence of scum in the stabilizer and magenta stain of the color paper were examined.

TABLE 3

| Silver halide composition | Occurrence of scum | Green density |
|---|---|---|
| AgBrCl (AgCl 30 mol %) | c | 0.08 |
| AgBrCl (AgCl 40 mol %) | b–c | 0.08 |
| AgBrCl (AgCl 50 mol %) | a | 0.05 |
| AgBrCl (AgCl 65 mol %) | a | 0.05 |
| AgBrCl (AgCl 80 mol %) | a | 0.05 |
| AgBrCl (AgCl 90 mol %) | a | 0.04 |
| AgBrCl (AgCl 95 mol %) | a | 0.04 |
| AgBrCl (AgCl 99 mol %) | a | 0.04 |
| AgBrCl (AgCl 99.5 mol %) | a | 0.04 |

As seen in Table 3, when using a sample wherein the molar ratio of silver chloride is not less than 50 mol %, scum does not occur and there is no magenta stain in the unexposed portion of color paper.

EXAMPLE 5

Experiments were made in the same manner as in Example 1 using the color paper and color negative film samples used in Example 2 with the formaldehyde in the stabilizer replaced with Exemplified Compound A-1-1 and the amount of addition varied as shown in Table 4. After processing, the color paper and color negative film samples were stored under the same conditions as in Example 2, and the difference in density was calculated between the values obtained before and after storage.

TABLE 4

| A-1-1 (g/l) | $\Delta G_{1.0}$* | ΔRmax** |
|---|---|---|
| 0 | −0.32 | −0.09 |
| 0.01 | −0.06 | −0.08 |
| 0.05 | −0.01 | −0.05 |
| 0.1 | 0 | −0.05 |
| 0.3 | −0.01 | −0.05 |
| 1.0 | −0.02 | −0.05 |
| 3.0 | −0.05 | −0.07 |
| 10.0 | −0.06 | −0.07 |
| 30.0 | −0.10 | −0.09 |
| 90.0 | −0.15 | −0.15 |

*Difference in the density of green color transmitted through color negative film at a density of nearly between the values obtained before and after storage.
**Difference in the density of red color transmitted through color paper between the values obtained before and after storage.

As seen in Table 4, the addition amount of the compound of the present invention is preferably 0.05 to 10 g per liter of stabilizer.

EXAMPLE 6

Experiments were made in the same manner as in Example 1 except that the cyan coupler in the color paper sample was replaced respectively with Cyan Coupler Nos. C'-2, C'-27, C'-32, C'-33, C'-34, C'-36, C'-37, C'-38, C'-39, C'-53, C''-2, C''-8 and C''-9 described in Japanese Patent O.P.I. Publication No. 106655/1988, pp. 34–42. The reduction in the density of red color improved further by about 10 to 20%.

EXAMPLE 7

Experiments were made in the same manner as in Example 1 except that the magenta coupler M-2 in the color negative film prepared in Example 1 was replaced respectively with magenta couplers represented by Formula M-I, specifically Exemplified Magenta Couplers 1, 2, 4, 10, 20, 21, 31, 40, 60, 63, 64, 74, 76 and 81. As a result, the reduction in the density of green color after storage of color negative film improved by 5 to 10%. Generally, the scum improved slightly.

EXAMPLE 8

Experiments were made in the same manner as in Example 1 except that the following procedures were used. Results similar to those in Example 1 were obtained. The color developer and stabilizer used were the same as in Example 1.

| Procedure | Processing temperature | Processing time | Amount of replenisher |
|---|---|---|---|
| Color paper processing conditions | | | |
| (1) Color developing | 38.0 ± 0.3° C. | 45 seconds | 80 ml |

-continued

| Procedure | Processing temperature | Processing time | Amount of replenisher |
|---|---|---|---|
| (2) Bleach-fixation | 35.0 ± 0.5° C. | 45 seconds | 51 ml |
| (3) Stabilization (three-tank cascade) | 30–34° C. | 90 seconds | 120 ml |
| (4) Drying | 60–80° C. | 30 seconds | — |
| Color negative film processing conditions | | | |
| Color developing | 38° C. | 3 minutes 15 seconds | 540 ml |
| Bleach-fixation | 30–35° C. | 2 minutes 30 seconds | 670 ml |
| Stabilization 1 | 30–35° C. | 20 seconds | — |
| Stabilization 2 | 30–35° C. | 20 seconds | — |
| Stabilization 3 | 30–35° C. | 20 seconds | 775 ml |
| Drying | 70–80° C. | 60 seconds | — |

Note: Figures for the amount of replenisher are per $m^2$ of light-sensitive material.

Stabilization was conducted by the counter current method with a flow from stabilizer tank 3 to 1, and a part of the stabilizer was allowed to enter in the bleach-fixer (50 ml/$m^2$).

The processing solutions had the following compositions.

| Bleach-fixer (the tank solution and the replenisher had the same composition) | |
|---|---|
| Ammonium thiosulfate (70%) | 250 ml |
| Ammonium thiocyanate | 100 g |
| Sodium sulfite | 20 g |
| Ferric (III) ammonium diethylenetriaminepentaacetate | 150 g |
| Disodium ethylenediaminetetraacetate | 5 g |
| Ammonium bromide | 40 g |

Water was added to make a total quantity of 1l, and acetic acid or aqueous ammonia was added to obtain a pH of 7.0.

EXAMPLE 9

Figure 2:
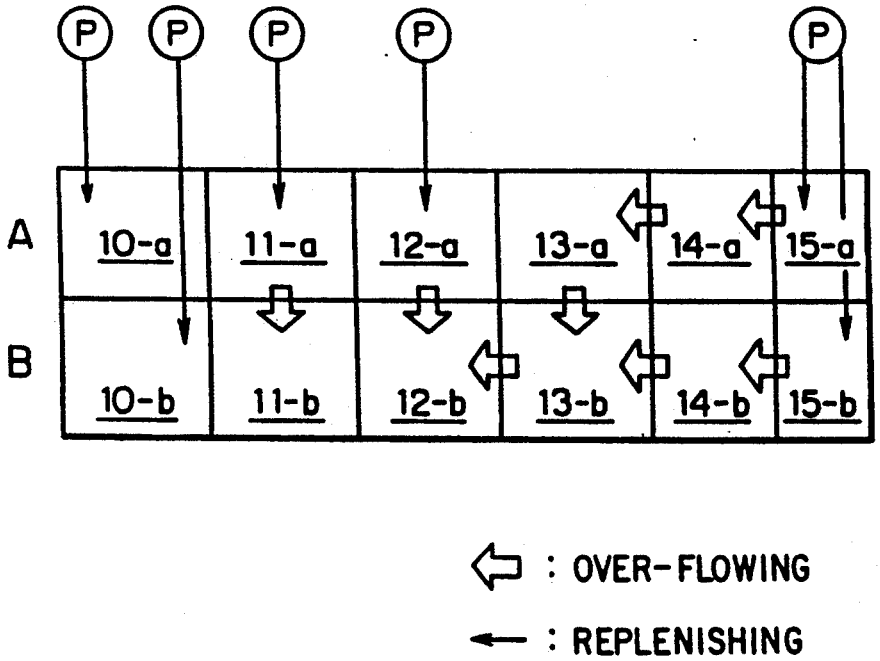
FIG. 2 is a flow diagram of another process in the same automatic developing machine as above.

Evaluation was conducted in the same manner as in Example 1 except that the composition of the stabilizer for color paper was changed as shown below and the procedures were changed as shown in FIG. 2. Although the results obtained were similar to those obtained in Example 1, the density of green color transmitted through the unexposed portion of color paper improved by 0.01 to 0.02 and the occurrence of scum in the first stabilizer tank tended to improve.

In FIG. 2, the symbol A shows the processing procedures for color negative film, and B is for the processing procedures for color paper; the symbols 10-*a*, 11-*a*, 12-*a*, 13-*a*, 14-*a* and 15-*a* respect denote a color developer tank, bleacher tank, fixer tank, first stabilizer tank, second stabilizer tank and third stabilizer tank for color negative film processing; the symbols 10-*b*, 11-*b*, 12-*b*, 13-*b*, 14-*b* and 15-*b* respectively denote a color developer tank, bleacher tank, fixer tank, first stabilizer tank, second stabilizer tank and third stabilizer tank for color paper processing.

The stabilizer and stabilizer replenisher for color paper had the following composition.

| | |
|---|---|
| 1,2-benzisothiazolin-3-one | 0.1 g |
| 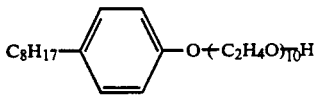 | 2.0 ml |

-continued

| | |
|---|---|
| Formaldehyde (37% w/w) or a compound of the invention | |
| Amount shown in Table 1 | |
| Fluorescent brightening agent Tinopearl SFP | 2.0 g |

Water was added to make a total quantity of 1 l, and the pH was adjusted to 8.5.

What is claimed is:

1. A method for processing at least two different kinds of silver halide color photographic light-sensitive materials including first and second light-sensitive materials comprising developing, bleaching, fixing and stabilizing wherein said first and second light-sensitive materials are processed with the same stabilizing solution containing a hexamethylenetetramine compound or at least one of the compounds represented by the following formulas F-1 through F-10, and wherein said first and second light-sensitive materials are a silver halide color photographic material A comprising silver halide grains with a total amount of silver coated of 2 g/$m^2$ to 10 g/$m^2$ and another silver halide color photographic light-sensitive material B comprising silver halide grains with a total amount of silver coated of not more than 1 g/$m^2$, respectively;

formula F-1

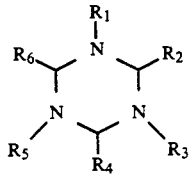

wherein $R_1$ through $R_6$ independently represent a hydrogen atom or monovalent organic group, formula F-2

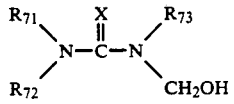

formula F-3

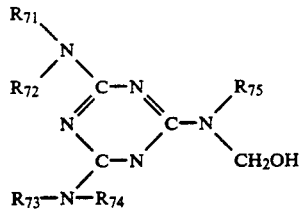

formula F-4

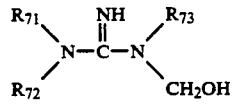

wherein $R_{71}$ through $R_{75}$ independently represent a hydrogen atom or methylol group; X represents an oxygen or sulfur atom, formula F-5

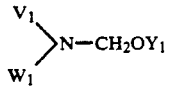

-continued formula F-6

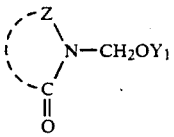

wherein $V_1$ and $W_1$ independently represent a hydrogen atom, lower alkyl group or electron-attracting group; $V_1$ and $W_1$ may bind to form a 5- or 6- membered nitrogen-containing heterocyclic ring; $Y_1$ represents a hydrogen atom or a group capable of being split off upon hydrolysis; Z represents a group of non-metallic atoms necessary for forming a simple or condensed nitrogen-containing heterocyclic ring together with a nitrogen atom and C=O group;

formula F-7

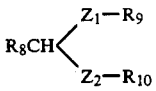

wherein $R_8$ represents a hydrogen atom or an aliphatic group; $R_9$ and $R_{10}$ independently represent an aliphatic group or aryl group; $R_9$ and $R_{10}$ may bind together to form a ring; $Z_1$ and $Z_2$ independently represent an oxygen atom, a sulfur atom or —N($R_{11}$)—, wherein $Z_1$ and $Z_2$ do not represent an oxygen atom concurrently; $R_{11}$ represents a hydrogen atom, hydroxyl group, aliphatic group or aryl group, formula F-8

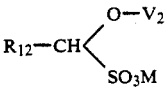

formula F-9

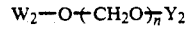

formula F-10

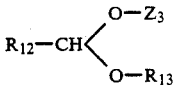

wherein $R_{12}$ represents a hydrogen atom or aliphatic group; $V_2$ represents a group capable of being split off upon hydrolysis; M represents a cation; $W_2$ and $Y_2$ independently represent a hydrogen atom or a group capable of being split off upon hydrolysis; n represents an integer of 1 to 10; $Z_3$ and $R_{13}$ independently a hydrogen atom, aliphatic group, aryl group or a group capable of being split off upon hydrolysis; $Z_3$ and $R_{13}$ may bind to form a ring.

2. A method of claim 1, wherein said silver halide color photographic light-sensitive material A comprises silver iodobromide grains having a silver iodide content of 2 to 30 mol %.

3. A method of claim 1, wherein said silver halide color photographic light-sensitive material B comprises silver halide grains having a silver chloride content of not less than 50 mol %.

4. A method of claim 1, wherein said hexamethylenetetramine compound is represented by formula A-1:

formula A-1

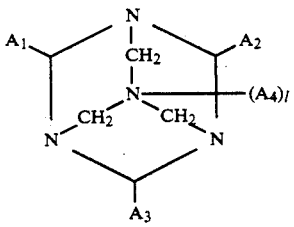

wherein $A_1$ through $A_4$ represent a hydrogen atom, alkyl group, alkenyl group or pyridyl group; l represents an integer of 0 or 1.

5. A method of claim 1, wherein said compound represented by formula F-1 though F-10 is contained in an amount of 0.01 to 20 grams per liter of stabilizer solution.

6. A method of claim 1, wherein said stabilizer solution contains a chelating agent having a stability constant of an iron (III) chelate of not less than 8.

7. A method of claim 1, wherein said stabilizer solution contains an ammonium compound.

8. A method of claim 1, wherein said stabilizer solution contains a sulfite compound.

9. A method of claim 1, wherein said stabilizer solution contains a metal salt.

10. A method of claim 1, wherein said photographic material A and B each are processed over a period of 3 to 120 seconds.

* * * * *

UNITED STATES PATENT AND TRADEMARK OFFICE

CERTIFICATE OF CORRECTION

PATENT NO. : 5,188,925
DATED : February 23, 1993
INVENTOR(S) : Moeko Hagiwara et al.

It is certified that error appears in the above-indentified patent and that said Letters Patent is hereby corrected as shown below:

Claim 1, column 94, line 2 after "independently" insert --represents--.

Claim 5, column 94, line 31, change "formula" to --formulas--.

Claim 5, column 94, line 31, change "F-1 though F-10" to --F-1 through F-10--.

Signed and Sealed this

Twenty-second Day of February, 1994

Bruce Lehman

*Attest:*

BRUCE LEHMAN

*Attesting Officer*

*Commissioner of Patents and Trademarks*